United States Patent [19]

Swenson et al.

[11] 4,171,666

[45] Oct. 23, 1979

[54] APPARATUS FOR FABRICATING SLOTTED PARTITION STRIPS FOR USE IN ASSEMBLING MULTI-CELL PARTITIONS

[75] Inventors: Dale R. Swenson, Hartsville; Sidney E. Moore, McBee; Hurley R. Brooking, Hartsville; Harlan L. Carroll, Cassatt, all of S.C.

[73] Assignee: Sonoco Products Company, Hartsville, S.C.

[21] Appl. No.: 855,622

[22] Filed: Nov. 29, 1977

[51] Int. Cl.[2] ..... B31B 1/16

[52] U.S. Cl. ..... 93/58.2 R; 83/302; 83/336; 83/677

[58] Field of Search ..... 93/58.2 R, 58 R, 58.4, 93/37 R, 37 SP, 37 EC; 83/302, 300, 332, 336, 677

[56] References Cited

U.S. PATENT DOCUMENTS

| | | | |
|---|---|---|---|
| 592,172 | 11/1894 | Herr | 251/258 |
| 609,684 | 8/1898 | Lahr | 93/38 |
| 1,996,812 | 4/1935 | Jensen et al. | 93/37 R |
| 2,092,760 | 9/1937 | Jensen et al. | 93/37 R |
| 2,283,492 | 5/1942 | Delegard | 93/38 |
| 2,345,411 | 3/1944 | Moeller | 93/58.2 R |
| 2,494,437 | 1/1950 | George et al. | 93/37 R |
| 2,563,947 | 8/1951 | Locke | 93/37 R X |
| 2,723,602 | 11/1955 | Schroeder | 93/37 R |
| 2,767,625 | 10/1956 | Schroeder | 93/37 R |
| 2,962,943 | 12/1960 | Mumper | 93/37 R |
| 3,133,481 | 5/1964 | McCormick et al. | 93/37 R |
| 3,251,256 | 5/1966 | McGrath | 83/677 X |
| 3,646,857 | 3/1972 | McDougal | 93/37 R |
| 3,685,401 | 8/1972 | Peters | 93/37 R |
| 3,690,225 | 9/1972 | Monaco et al. | 93/37 R |
| 3,809,593 | 5/1974 | Burke et al. | 156/257 |
| 3,952,637 | 4/1976 | Lambert et al. | 83/332 X |
| 3,998,136 | 12/1976 | Peters | 93/37 R |

*Primary Examiner*—James F. Coan

*Attorney, Agent, or Firm*—Bell, Seltzer, Park & Gibson

[57] ABSTRACT

Apparatus for successively fabricating slotted partition strips for use in assembling multi-cell partitions utilized in cartons, crates and the like as characterized by construction providing for adjustability thereof for fabrication of varying sizes and types of partition strips, as follows. Devices supply a continuous length of material such as paper board. Devices successively transversely cut the continuous length of material into individual strips of desired height. Devices are provided for varying the height of the strips cut by the strip cutting devices. Devices successively longitudinally cut a desired number of spaced-apart slots in each of the strips extending inwardly a desired distance from the leading cut edge thereof to define a predetermined number of flaps on the leading edge. Adjustment devices are provided for varying the height of the slots cut in the strips by the slot cutting devices. Devices continuously feed the material and cut transverse strips in a generally linear path of travel from the supply devices through the strip cutting devices and the slot cutting devices.

11 Claims, 55 Drawing Figures

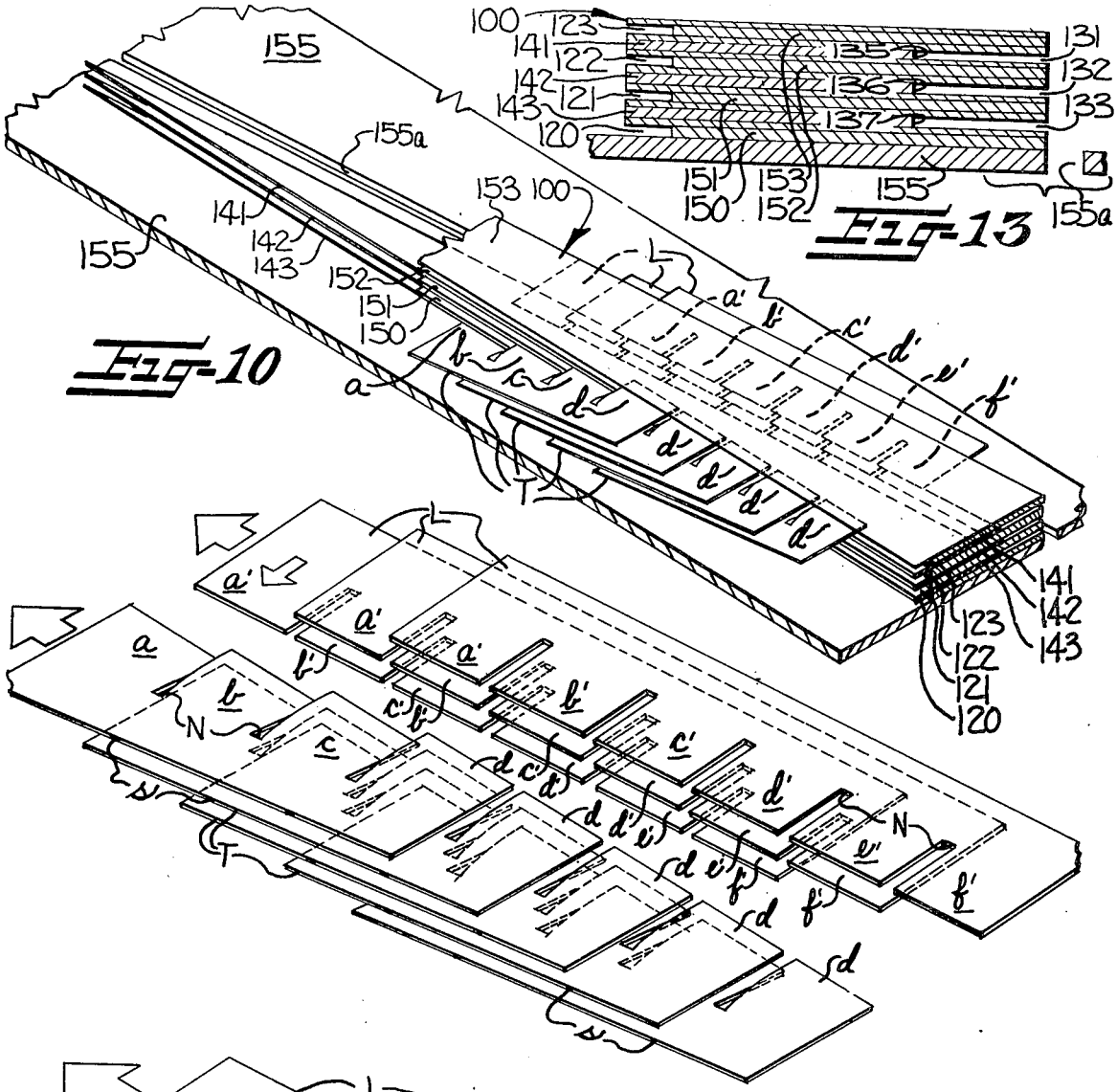
Fig-10
Fig-13
Fig-11
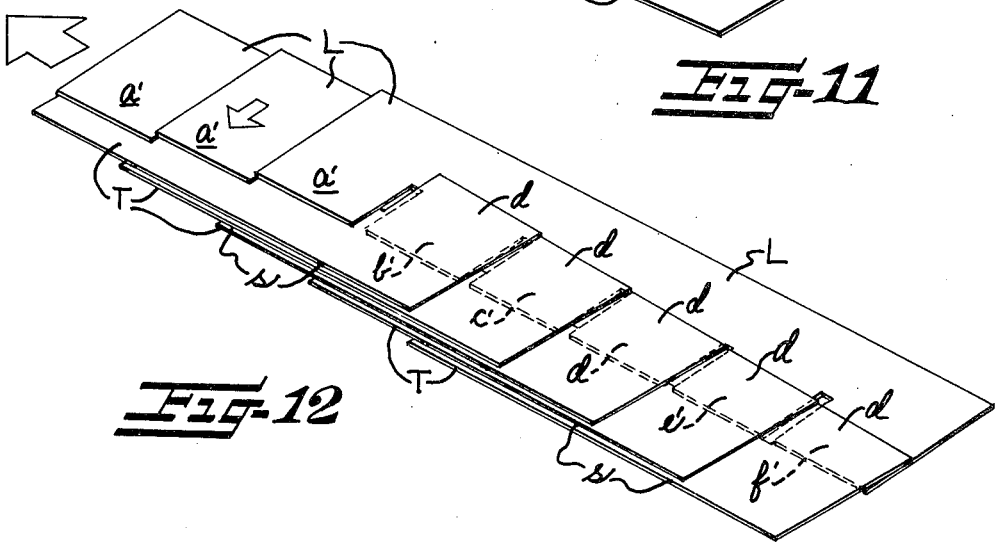
Fig-12

170
170a
170c
175
174
173
172
171
171a
172a
173a
174a
175a
171b
177
177a
177b
177c
178
153
155
160
161
100
28
27A 100
191a
192a
193a
195
194
196
191
187
131
132
133
183a
183
180
181
182
182a
184
185a
185
100b
102
102a
102b
102c
197
198
197a
198a
186
187a
185b 202
204
H'
I'
J'
206
H
I
J 205
204
H'
H
I'
I
J'
J
202
155
206
215

202
H'
H
I
J
I'
J'

205
204
H'
I'
L
J'
155
215
206
216
200
202
42
205
H'
L
202
H'
42
43
43
155
216
215

APPARATUS FOR FABRICATING SLOTTED PARTITION STRIPS FOR USE IN ASSEMBLING MULTI-CELL PARTITIONS

This invention relates to an apparatus for successively fabricating slotted partition strips for use in assembling multi-cell partitions utilized in cartons, crates and the like and in which the apparatus is characterized by a construction providing for adjustability thereof for fabrication of varying sizes and types of partition strips.

In addition, the present application describes and illustrates respective separate inventions in an apparatus including the combination of a mechanism for fabricating partition strips and a mechanism for assembling such partition strips into multi-cell partitions and the subcombination of a mechanism for assembling partition strips. Inasmuch as different inventive entities are involved, these separate inventions are being claimed in respective separate applications, Ser. No. 855,711 and 855,713, filed concurrently herewith and assigned to the assignee of the present application, utilizing substantially the same specifications and drawings for purposes of clarity and completeness of disclosure and to set forth the best mode of operation.

BACKGROUND OF THE INVENTION

Multi-cell partitions, sometimes known as "inner pack assemblies" are conventionally utilized in cartons, boxes, crates and other containers for separating articles packed therein to prevent breakage or damage to articles caused by contact between the articles. These multi-cell partitions are conventionally constructed of paper board such as chip board, fiber board and the like and include a plurality of intermeshing slotted transverse and longitudinal partition strips which must be separately fabricated and assembled in desired intermeshing relationship at their slotted edges for providing desired multi-cell partitions. These partitions are also constructed in varying numbers of cells, such as twelve, twenty-four, etc., and are of varying heights, lengths and widths for use in varying size cartons, boxes, crates and the like.

Heretofore, machines have been proposed for fabricating and/or assembling multi-cell partitions. Most of these previously proposed machines were constructed for assembling the intermeshing longitudinal and transverse partition strips into a partition in the open condition thereof as subsequently used in a carton, box, crate or the like. For the most part, these machines successively assembled partitions by an intermittent operation rather than providing for substantially continuous flow of the material and strips during both fabrication and assembly. Thus, while these machines may fabricate and assemble multi-cell partitions, they lack the speed and/or versatility necessary for satisfactory commercial operation, e.g., satisfactory speed for producing a desired number of partitions in a given time for commercially profitable operation and desired flexibility in adjustment of the machine for producing varying cell types and sizes of partitions.

Examples of such machines for fabricating and assembling or assembling alone multi-cell partitions in the open condition may be seen from the following prior art patents considered with respect to this invention;

| U.S. PAT. NO. | INVENTOR | ISSUE DATE |
|---|---|---|
| 592,172 | Herr | November 13, 1894 |
| 609,684 | Lahr | August 23, 1898 |
| 1,996,812 | Jensen et al. | April 9, 1935 |
| 2,092,760 | Jensen et al. | September 14, 1937 |
| 2,283,492 | Delegard | May 19, 1942 |
| 2,494,437 | George et al. | January 10, 1950 |
| 2,723,602 | Schroeder | November 15, 1955 |
| 2,767,625 | Schroeder | October 23, 1956 |
| 3,133,481 | McCormick et al. | May 19, 1964 |
| 3,685,401 | Peters | August 22, 1972 |
| 3,690,225 | Monaco et al. | September 12, 1972 |
| 3,809,593 | Burke et al. | May 7, 1974 |

Another approach to assembling multi-cell partitions having slotted transverse and longitudinal partition strips is to assemble the partitions in a collapsed condition, in which condition they are usually stored and shipped, capable of being erected to an open condition for use in cartons, boxes, crates and the like. Examples of such a machine for assembling multi-cell partitions in the collapsed condition may be seen in the following patents:

| U.S. PAT. NO. | INVENTOR | ISSUE DATE |
|---|---|---|
| 3,646,857 | McDougal | March 7, 1972 |
| 3,998,136 | Peters | December 21, 1976 |

However, the apparatus of the McDougal patent provides for intermittent movement of the longitudinal and transverse partition strips during assembly thereof and, accordingly, lacks the speed necessary for profitable commercial operation. Moreover, the apparatus of this McDougal patent does not provide for adjustment thereof to assemble varying cell types and sizes of partitions.

The Peters patent provides for continuous, rather than intermittent, assembly of multi-cell partition strips in the collapsed condition. However, while the machine of this patent may provide satisfactory commercial speeds, the machine has not yet been commercialized and it is not known whether such machine will in fact operate at commercially desired speeds during its continuous operation for assembling multi-cell partitions in the collapsed condition. Notwithstanding, this latest proposed machine does not include adjustment mechanisms therein nor other features which would provide for fabrication and assembly of multi-cell partitions in the collapsed condition of varying cell types and sizes at commercially desired speeds of operation.

OBJECTS AND SUMMARY OF THE INVENTION

Accordingly, it is the object of this invention to provide an improved apparatus for successively fabricating and assembling multi-cell partitions having a plurality of intermeshing slotted transverse and longitudinal partition strips for use in cartons, crates and the like which overcomes problems presented by prior apparatus.

It has been found by this invention that the above object may be accomplished by providing an apparatus, characterized by a construction providing for substantially continuous linear movement or flow of the partition strips during respective fabrication and assembly, assembly of the partition strips in collapsed condition, and adjustability for fabrication of varying sizes and types of partitions to provide the desired speed and versatility for satisfactory commercial operation, generally as follows:

Adjustable means are provided for continuously fabricating transverse and longitudinal partition strips from a continuous length of material, such as paper board, of desired width corresponding to the desired length of the partition strips, into individual strips of desired height having a desired number of spaced-apart slots in each extending inwardly a desired distance from the leading edge thereof to define a desired number of flaps on the leading edge of each partition strip.

Partition assembling means are provided which include an elongate horizontally extending guide means defining a plurality of longitudinally and horizontally extending vertically spaced parallel staggered grooved trackways in respective opposite sides thereof for respectively receiving the leading slotted edges of the transverse and longitudinal partition strips therein on opposite sides thereof at a receiving end thereof. The grooved trackways correspond in number and position to the desired intermeshing relationship of the longitudinal and transverse partition strips when assembled into a partition in collapsed intermeshing relationship. For example, the strips of one of a series of the fabricated transverse and longitudinal partition strips are positioned with successive flaps of each strip in vertically staggered and spaced positions in the grooved trackways on one side of the guide means, and the strips of the other series of the fabricated transverse and longitudinal partition strips are positioned in the grooved trackways on the other side of the guide means in successive vertically staggered and spaced relationship with all of the flaps of each respective strip in a common substantially horizontal plane or grooved trackway.

Elongate cam means are movably positioned interiorly within at least certain of the grooved trackways of the guide means so that the grooves therein extend inwardly from the opposite longitudinal outer edges of the guide means at a converging predetermined angle from the receiving end of the guide means to the other end thereof. Means are provided for continuously feeding the transverse and longitudinal partition strips along the cam means and in the grooved trackways from the receiving end to the remote end of the guide means for converging and intermeshing the slotted edges of the partition strips for assembling partitions in collapsed condition. Adjustment means are provided for the cam means for longitudinally moving the cam means within the guide means for varying the longitudinal position thereof and thus the depth of the grooved trackways along the guide means for assembling various sizes and types of partitions.

The partition strip fabricating means preferably include separate fabricating means for the respective transverse and longitudinal partition strips. Each fabricating means includes means for continuously feeding the material and the strips as they are being fabricated in a generally linear horizontal path of travel in which the respective paths of travel for the longitudinal and the transverse partition strips are in opposing directions. The guide means of the partition assembling means is positioned generally transversely of and between the paths of travel of the strips through the respective fabricating means for receiving the respective fabricated transverse and longitudinal strips on opposite sides thereof at the receiving end thereof.

The transverse and longitudinal partition strip fabricating means may include a pair of longitudinally extending parallel transverse partition strip fabricating means positioned on one side of the guide means of the partition assembly means, and a pair of longitudinally extending parallel longitudinal strip fabricating means positioned on the other side of the guide means of the partition assembling means. With this arrangement, the partition assembling means would comprise a pair of longitudinally extending parallel superimposed assembling means for respectively receiving and assembling longitudinal and transverse partition strips from one of each of the transverse and longitudinal partition strip fabricating means in a generally "piggy-back" arrangement.

Preferably, each of the partition strip fabricating means includes means for supplying a continuous length of material, such as chip board, fiber board and the like. Means are provided for receiving the continuous length of material and transversely cutting the continuous length of material into individual strips of desired height and including adjustment means for varying the height of the strips. Means successively longitudinally cut a desired number of spaced-apart slots in each of the cut strips which slots extend inwardly a desired distance from a cut edge of each strip to define a predetermined number of flaps on the edge. Means substantially continuously feed the material and the cut transverse strips in a generally linear horizontal path of travel from the supply means through the strip cutting means and the slot cutting means. Adjustment means for varying the height of the slots cut in the strips are provided. With this arrangement, the length of each fabricated strip may be adjustably predetermined by providing a predetermined width to the continuous length of material being utilized.

Preferably, the grooved trackways in the elongate guide means of the partition assembling means are in the form of a plurality of longitudinally and horizontally extending vertically spaced parallel trackway openings in one side thereof extending a predetermined distance inwardly of the guide means and a plurality of longitudinally and horizontally extending vertically spaced trackway slots in the other side thereof which extend through the guide means to the one side thereof in parallel, alternating, vertically staggered relationship to the trackway openings. With this arrangement, the elongate cam means are of less longitudinal length than the guide means and are movably positioned interiorly within the trackway slots to extend from the receiving end toward the remote end of the guide means for defining open portions in the trackway slots extending inwardly from the other side of the guide means at a converging predetermined angle to the trackway openings from the receiving end to the remote end of the guide means.

Means successively position strips of one of the series of the fabricated transverse and longitudinal partition strips with successive flaps thereof in successive vertically spaced openings at the receiving end of the guide means. Means successively position strips of the other of the series of fabricated transverse and longitudinal partition strips with all of the flaps thereof in successive vertically spaced slots at the receiving end of the guide means. Continuous feeding means successively engage the transverse and longitudinal partition strips at the receiving end of the guide means and continuously move the strips longitudinally along the guide means and the cam means to the remote end thereof, while separating a predetermined number of strips into opposing groups of longitudinally staggered strips and aligning the slots of the strips of the opposing groups so that the opposing groups of strips will converge and intermesh as they are being fed along the guide means for assembling a partition.

Thus, this invention provides an improved apparatus for successively fabricating and assembling multi-cell partitions having a plurality of intermeshing slotted transverse and longitudinal strips for use in cartons, crates and the like and which provides mechanisms for substantially continuous movement of the partition strips during fabrication and assembly, for assembly of the partition strips in a collapsed condition, and for adjustability for fabrication and assembly of varying sizes and cell types of partitions to provide desired speed and versatility for commercial operation. The novel devices of this improved apparatus have been broadly described above and their specific novel constructions will be described hereinafter in connection with a specific description of a preferred embodiment of this invention.

BRIEF DESCRIPTION OF THE DRAWINGS

Some of the objects of the invention having been stated, other objects will appear as the description proceeds, when taken in connection with the accompanying drawings, in which:

FIG. 10 is an enlarged perspective view of the forward, egress, portion of the partition converging guide and cam means looking generally in the direction of the arrow 10 in FIG. 9A, and showing a cooperating pair of groups transverse and longitudinal partition strips as they are convergingly approaching the forward, terminal, end of the cam means;

FIG. 11 is an enlarged perspective view illustrating the condition of the two groups of transverse and longitudinal partition strips of FIG. 10, but showing the same removed from the grooved trackways and the associated cam means for purposes of clarity;

FIG. 12 is an enlarged view similar to FIG. 11, looking generally in the direction of arrow 12 in FIG. 9A, and illustrating the two opposing groups of partition strips in substantially parallel and substantially fully nested or intermeshing relationship;

FIG. 13 is an enlarged detail similar to the right-hand end of FIG. 10, but better illustrating the grooved trackways cam means for the primary, upper, production line;

DESCRIPTION OF PREFERRED EMBODIMENT

GENERAL DESCRIPTION

According to the present invention, it is contemplated that multi-cell partitions (FIG. 2), for use in forming cells in cartons, crates, boxes and the like, may be produced from pliable sheet stock, such as paper chip board or fiber board of desired thickness from about 0.030 to 0.060 inches, simultaneously and in substantially continuous succession along two generally parallel production lines termed herein as primary and secondary production lines. The assembly portions of the two generally parallel production lines are preferably in superimposed relationship (FIGS. 1 and 25) for fabricating partition strips and assembling the same in a generally "piggy-back" relationship. Each of the primary and secondary production lines includes respective transverse and longitudinal partition strip fabricating stations and partition assembling stations or "assemblers" which successively fabricate and assemble the multi-cell partitions and which are characterized by constructions providing for substantially continuous movement of the partition strips, assembly of the partition strips in a collapsed condition, and adjustability of the mechanisms for fabrication and assembly of various sizes and types of partitions to provide desired speed and versatility for commercial operation.

Figure 1:
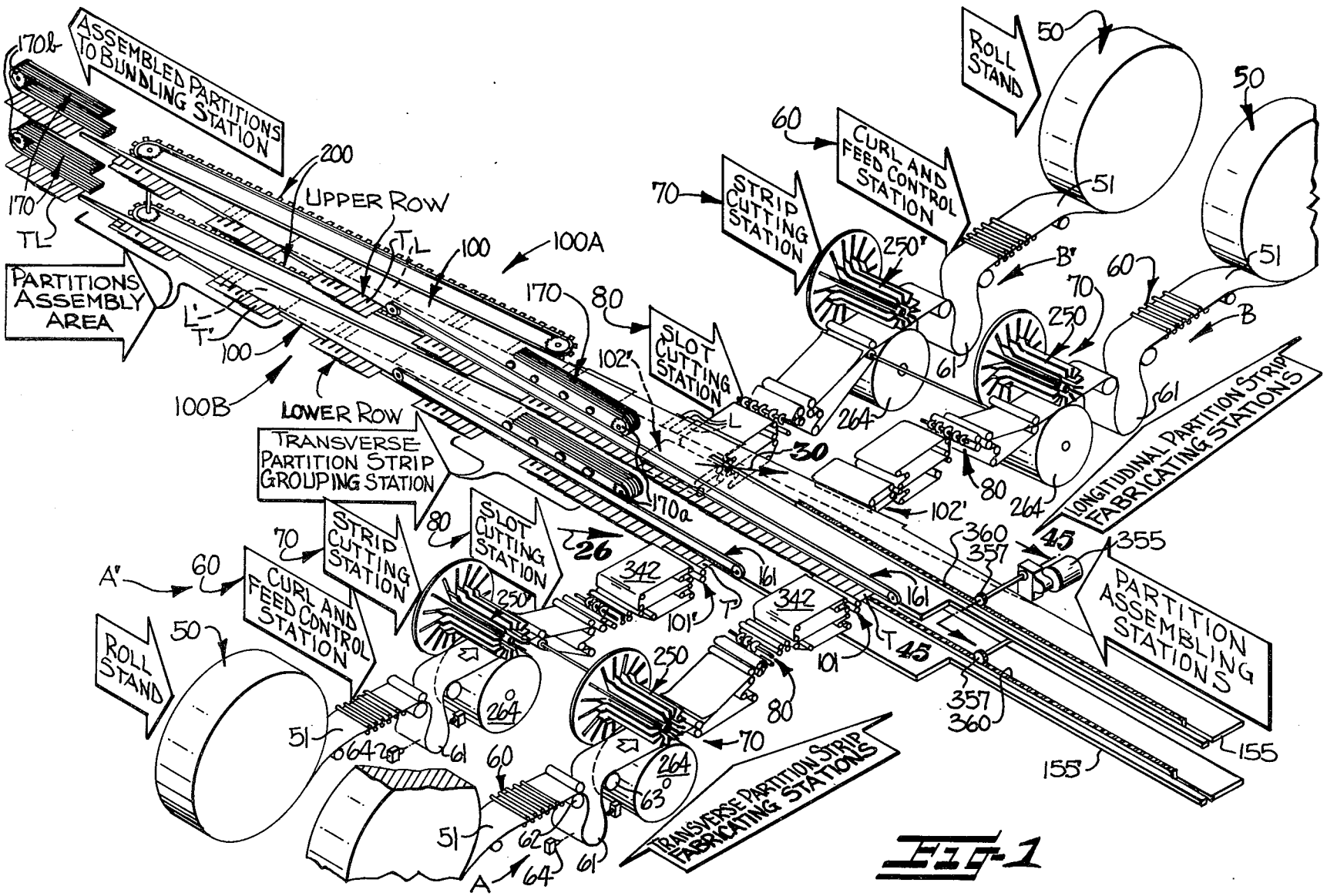
FIG. 1 is a schematic perspective view illustrating apparatus of the continuous production of multiple container cell partition assemblies according to the present invention.

With this in mind, it will be observed in FIG. 1 that primary and secondary "transverse" partition strips are formed at respective primary and secondary "transverse" partition strip fabricating stations A, A′ at one side of primary and secondary partition assembling stations or assemblers 100A, 100B, and primary and secondary "longitudinal" partition strips are formed at respective primary and secondary "longitudinal" partition strip fabricating stations B, B′ at the other side of the partition assembling stations. At the outset, it is to be noted that the terms "transverse" and "longitudinal", as applied to the partition strips, are used herein simply to distinguish those partition strips being formed at one side of the apparatus from those partition strips being formed at the other side of the apparatus and are not to be considered as imposing a limitation upon the partition strips within this disclosure.

Figure 2:
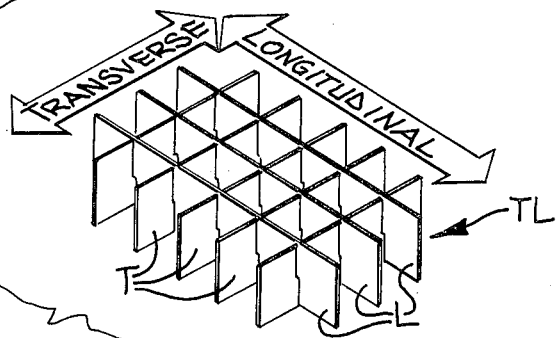
FIG. 2 is a perspective view of a typical twenty-four cell partition assembly.

In fact, both types of partition strips are of elongate form, and although the transverse partition strips T, shown in the partition assembly TL of FIG. 2, are shown as being of lesser length than the longitudinal strips L there shown, since the apparatus is adjustable, it is contemplated that both types of strips may be of any desired length. Also, the transverse and longitudinal strips may be fed to the partition assembling stations from those sides of the assembling stations opposite from the respective sides being described herein without departing from the invention.

The terms "primary" and "secondary" are used herein to distinguish those partition strips and assemblies being produced on one of the two production lines from those partition strips and assemblies being produced on the other of the two production lines, it being noted that the primary partition strips are fed to and advanced along the primary assembling station on a level above that of the secondary partition strips in the particular illustrated embodiment of the apparatus.

I. Partition Strip Fabricating Stations

Each partition strip fabricating station A, A', B, B' includes a sheet material supply station 50 serving as a suitable source of pliable sheet material, such as paper board which may take the form of a roll carried by a suitable roll stand. From the supply station 50, each respective sheet of material 15 is advanced through a feed control station 60 which forms the respective sheet 51 into a catenary loop 61 suspended from and between a pair of spaced substantially parallel rollers or guides 62, 63. The size of the loop 61 in the sheet controls the operation of the respective feed control station 60 by suitable detecting means embodied in a suitable photoelectric device 64, such feed control means being well known in various arts.

From the catenary, defined between rollers 62, 63 of each partition fabricating station A, A', B, B', the sheet 51 passes through a respective strip cutting station 70 in which the respective sheet 51 is cut transversely thereof and substantially throughout its width to form a corresponding partition strip whose dimension (width) longitudinally of its path of travel will ultimately determine the height of the respective partition strips and the partitions being formed therefrom.

Details of those two strip cutting stations 70, 70 of the transverse partition strip fabricating stations A, A', for cutting transverse partition strips from the sheets 51 in the primary and secondary production lines, are shown in FIGS. 14–21. With the exception of control means shown in FIGS. 19–21, the two strip cutting stations 70, 70 for the longitudinal partition fabricating stations B, B' may be identical to those for the transverse partition fabricating stations A, A' and thus will not be separately described in detail, although the same reference characters will apply to the strip cutting stations of the longitudinal partition fabricating stations, where applicable, when the more detailed description appears later herein. Each strip cutting station 70 includes rotary radially-extending circumferentially-spaced cutting blades which may be radially adjusted inwardly and outwardly for adjusting the circumferential spacing therebetween for varying the distance between cuts and therefore the desired height of partition strips cut thereby for varying sizes and types of partition assemblies.

Figure 3:
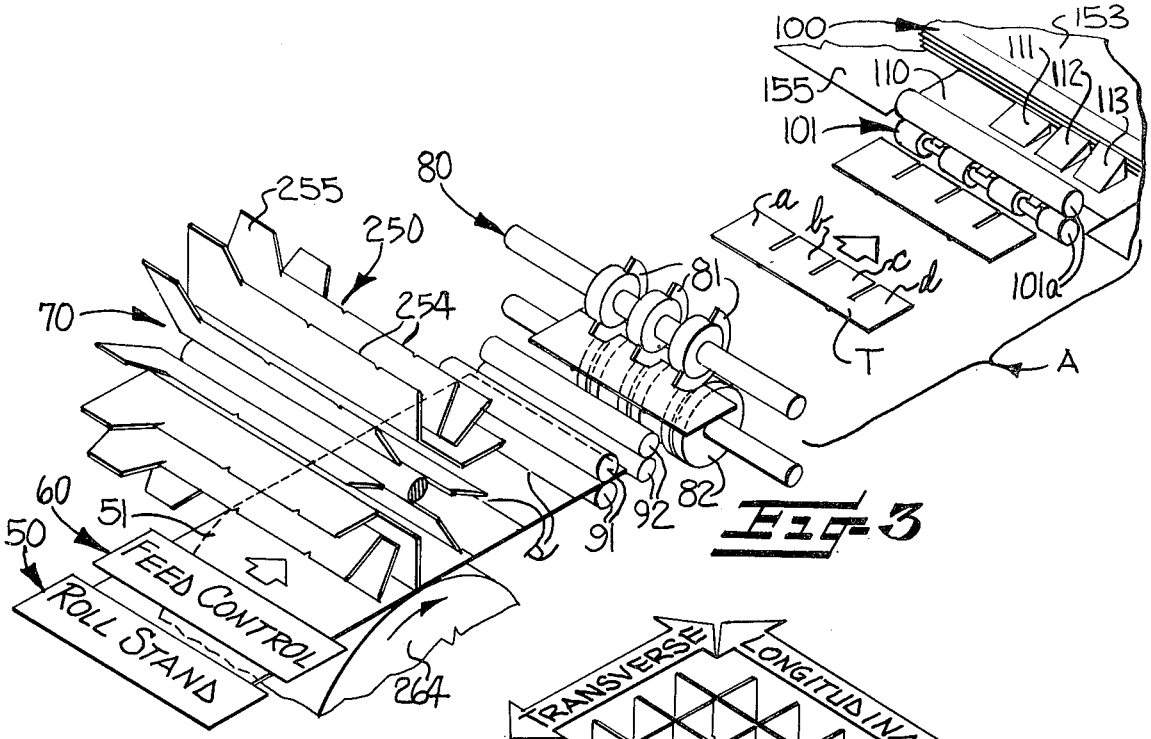
FIG. 3 is an enlarged partially exploded, schematic perspective view of one of the transverse partition fabricating stations shown in the left-hand portion of FIG. 1.
Figure 6:
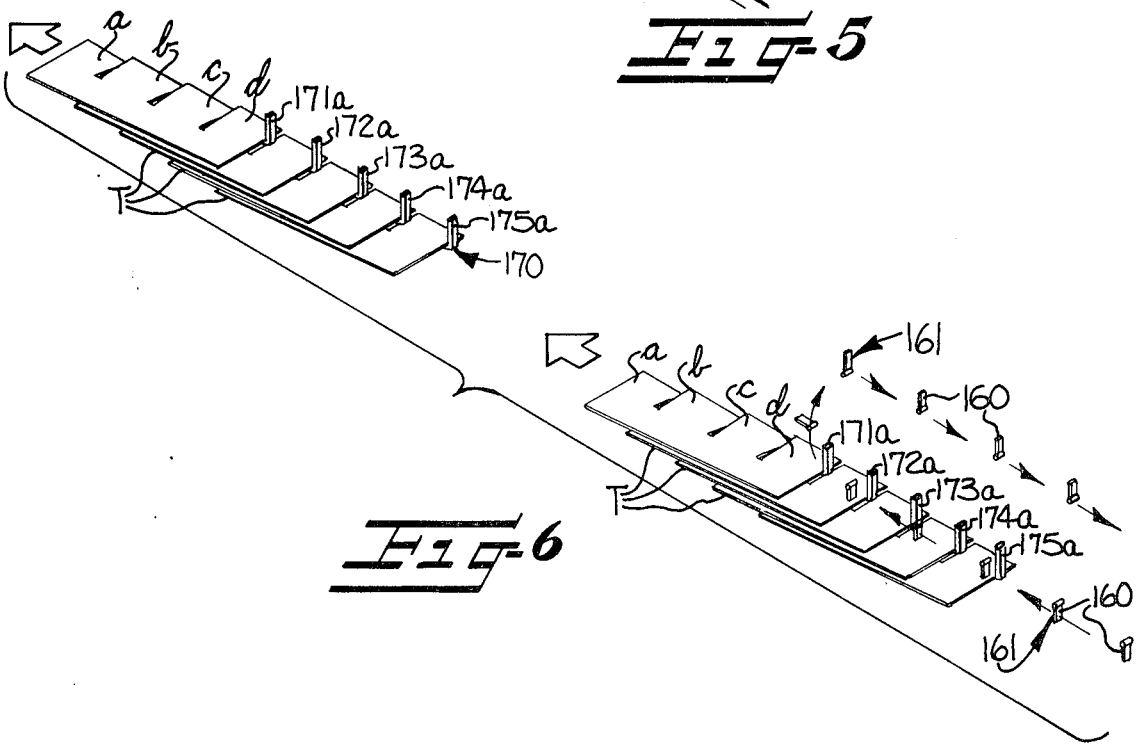
FIG. 6 is a schematic view illustrating a further staggering of the transverse partition strips in each successive upper group as well as the separating of successive groups from one another as they are advanced downstream of the flap-offsetting unit of FIGS. 4 and 5 and along the grooved trackways.
Figure 7:
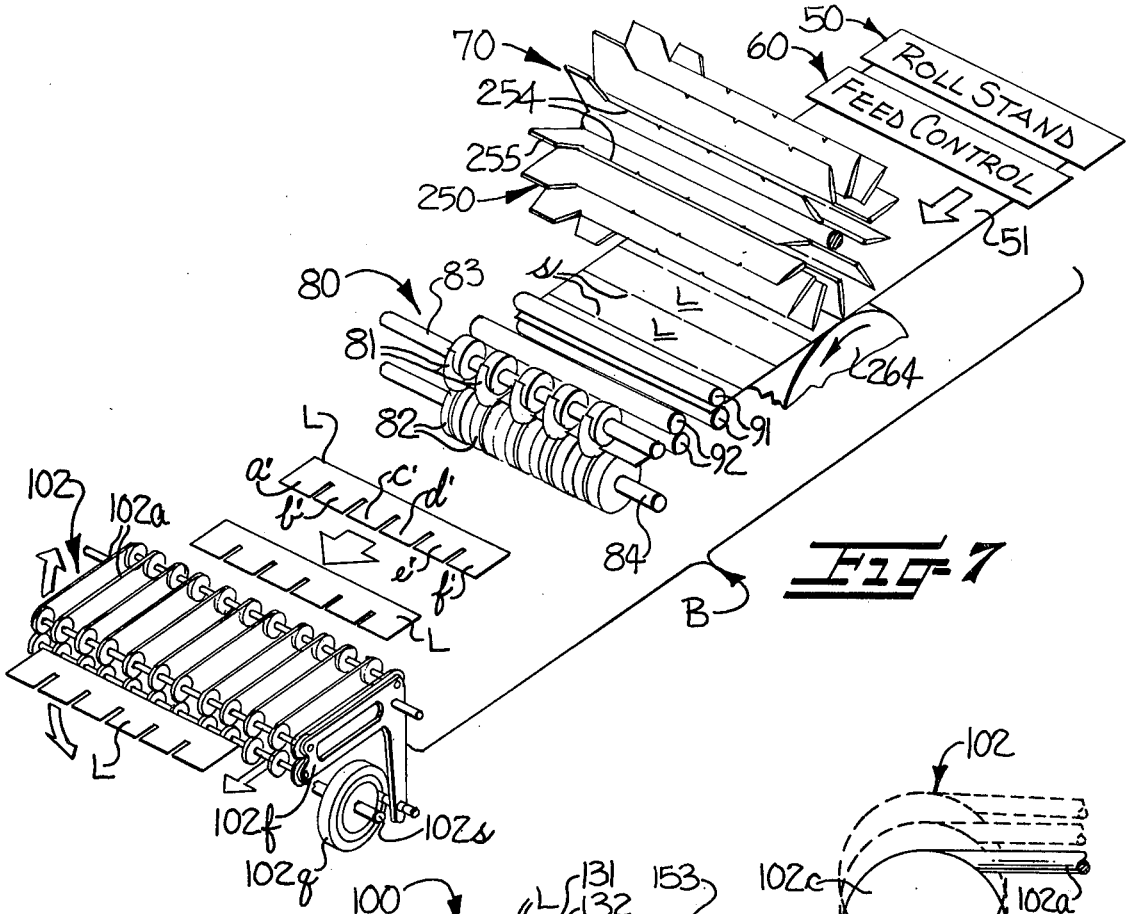
FIG. 7 is an enlarged partially exploded schematic view of the primary or upper one of the longitudinal partition fabricating stations B shown in the right-hand portion of FIG. 1.

Each strip cutting station 70 is arranged so that it does not completely sever the corresponding sheet material, but instead, the successive partition strips being fabricated thereby are interconnected by two or more very small or tiny tabs or spurs, such as those indicated at s in FIGS. 3 and 7. In this regard, the cutting blades of each strip cutting station 70 may be provided with interrupted cutting edges or may be formed in sections so as to leave small uncut gaps in each line of cut, which gaps form the aforementioned spurs s. The transverse partition strips being formed at the strip cutting stations 70 of the partition strip fabricating stations A, A' are respectively designated at T, T' (FIGS. 1, 2–6, 9, 9A, 10, 11, 12, 46 and 47), and the longitudinal partition strips being formed at the strip cutting stations 70 of the respective longitudinal partition strip fabricating stations B, B' are respectively designated at L, L'(FIGS 1, 2, 7–12, 46 and 47).

The successive partition strips, formed at the strip cutting station 70 of each partition strip fabricating station A, A', B, B', are maintained in interconnected relationship by the spurs s (FIGS. 3 and 7) to aid in removing the partially severed sheet material from the confined space of the strip cutting means and subsequently effecting a predetermined spaced-apart relationship between successive partition strips as they are fed through a respective slot cutting station 80 wherein each successive partition strip is slit inwardly from one longitudinal edge thereof to form a series of open slots or notches therein, which in turn, define a plurality of cell-defining tabs or flaps on the corresponding longitudinal edge portion or leading edge of the respective partition strip. Although the slot cutting stations 80 will be described later herein in detail, it is to be noted (FIG. 23) that each slot cutting station 80 includes a series of transversely spaced segmental rotary cutting blades 81 which cooperate with respective grooved rotary dies or rollers 82 therebeneath, and the phase or angular relation of the latter cutting blades 81 about their axis is such with respect to the feeding of successive strips cut by the strip cutting station 70 as to precisely predetermine the length of each slot or notch being formed in each partition strip without stopping advancement of such partition strips thereby.

Three such slots or notches, indicated at N (FIGS. 3, 4, 5 and 6), are provided in a corresponding longitudinal edge of each of the transverse partition strips T, T', thus forming four cell tabs or flaps a, b, c, d on each transverse partition strip T, T'. Of course, the number of slots N to be formed in each transverse partition strip T, T' may be varied to accord with the number of longitudinal partition strips to be assembled therewith in accordance with the type of partition to be fabricated and assembled. Similarly, the slot cutting stations 80 of the longitudinal partition strip fabricating stations B, B' form slots or notches N in a corresponding edge of each of the longitudinal partition strips L, L' (FIGS. 7, 8, 10, 11 and 12) and these notches define a row or series of six tabs or flaps a'–f' along the corresponding edge of the longitudinal partition strips L, L'.

It should be noted that, as each pliable sheet 51, with its partition strips interconnected by the spurs s, passes between the respective strip cutting station 70 and the respective slot cutting station 80, such sheet 51 passes through the nips of two spaced sets of detaching rolls 91, 92 (FIGS. 3, 7, 22 and 24); the front set 92 of which is driven at a faster speed than the rear set 91 so that each successive partition strip passing through the nip of rolls 92 is overfed and separated from the next succeeding partition strip passing through the nip of the preceding set of detaching rolls 91. Thus, the successive partition strips are pulled apart from each other by rupturing the tiny spurs s at the juncture of adjacent partition strips. It is to be noted that it is the "phase" or angular relation of segmental cutting blades 81 to the front detaching rolls 92 which determines the length of the slots N to be cut in each partition strip.

Figure 23:
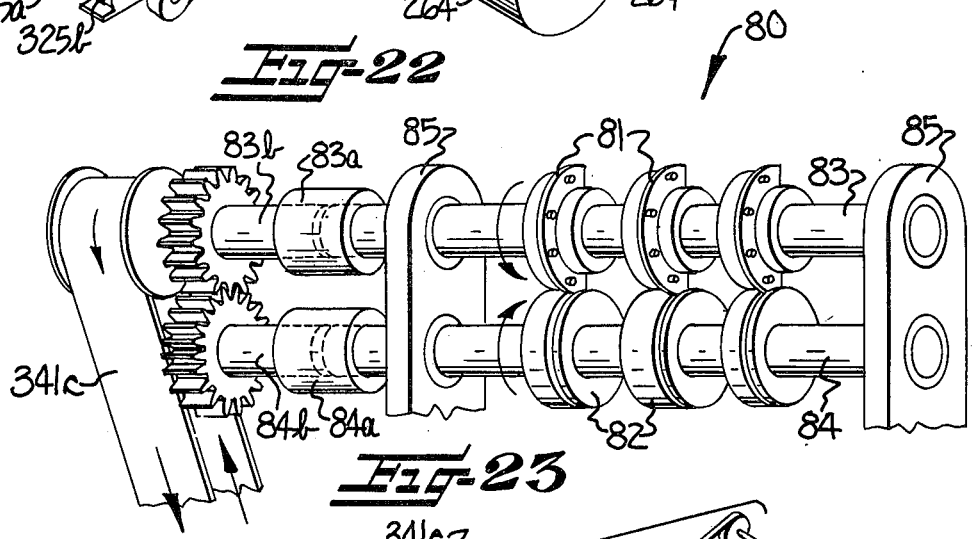
FIG. 23 is an enlarged fragmentary view looking generally along line 23—23 of FIG. 22 and illustrating means on one of the slot cutting stations for cutting slits or notches in successive severed transverse partition strips to form a row of tabs or flaps on each successive partition strip.

Referring again to the slot cutting station 80 of FIG. 23, since the number of slots N in the partition strips, and flaps defined thereby, are varied in accordance with the number of cells to be defined by the partition assembly being produced, it will be observed that the segmental cuttng blades 81 and the grooved cutting dies 82 are adjustably secured on respective mounting shafts 83, 84 journaled in a pair of bearing stands 85. The bearing stands 85 are removably secured, as by bolts or screws (not shown), to the frame of the apparatus so that the cutter assembly, including the rotary cutting blades 81, the rotary dies 82, the shafts 83, 84 and the bearing stands 85, may be replaced as a unit in the event that a different number of cutting blades 81 may be required for cutting a desired number of slots N in the partition strips being formed.

To further facilitate replacement of the cutter assembly, removable or axially adjustable shafts couplings 83*a*, 84*a* may be employed for connecting mounting shafts 83, 84 to respective stationarily supported rotary drive shafts 83*b*, 84*b*, which are driven by means to be later described. Thus, any desired number of slots N may be cut in each successive partition strip, and such slots may be spaced any desired distance apart by axially adjusting the cutting blades 81 and the grooved rotary dies 82 along the respective mounting shafts 83, 84.

In this regard, by way of example, whereas five four-flap transverse partition strips T are assembled with the three six-flap longitudinal partition strips L in the 24-cell partition assembly TL of FIG. 2, it is apparent that, in the formation of a 12-cell partition assembly, only three three-flap transverse partition strips and two four-flap longitudinal partition strips may be required. Although three segmental cutting blades 81 and cooperating dies 82 are shown in FIG. 23 for forming the transverse partition strips T utilized in forming a 24-cell partition assembly TL, it is apparent that five such blades 81 would be present in each slot cutting station 80 of the longitudinal partition strip fabricating stations B, B'.

II. Guide Means With Trackways Of Partition Assembling Stations:

From the die cutting station 80 of each transverse partition fabricating station A, A' the respective partition strips T, T' are directed through suitable delivery and positioning conveyor means, to be later described, so that they are delivered in predetermined spaced relationship to the respective partition assembling stations 100A, 100B having guide means 100 with respective sets of elongate grooved trackways which extend longitudinally of the overall apparatus and transversely of the paths of flow of the partition strips as they are being formed at the partition strip fabricating stations A, A', B, B'.

For the purposes of this description, and to aid in the orientation of the various components of the apparatus with respect to one another, it may be assumed that the longitudinal axis of the apparatus in FIG. 1 extends in a substantially horizontal plane, with those partition strips, T, L being formed at and emerging from the respective primary transverse and longitudinal partition strip fabricating stations A, B being directed by respective delivery means into respective sets of upper grooved trackways at the corresponding sides of the primary assembler 100A of the apparatus, and with the partition strips T', L' emerging from the proximal ends of the respective secondary transverse and longitudinal partition strip fabricating stations A', B' being directed by respective delivery conveyor means into corresponding lower sets of grooved trackways at opposite sides of the secondary assembler 100B of the apparatus. The delivery and positioning means for the transverse partition strips T, T' are generally designated at 101, 101' in FIGS. 1, 3, 4, 5, 9, 22, 24, 26 and 44 and the delivery and positioning conveyor means for the longitudinal partition strips L, L' are generally designated at 102, 102' in FIGS. 1, 7, 9 and 30–35 and 44. The delivery and positioning means 101, 101' take the form of delivery rolls and the delivery and positioning means 102, 102' take the form of delivery belts constituting endless delivery conveyor means (see FIGS. 26 and 30).

As the leading, slotted longitudinal edges of the transverse partition strips T, T' emerging from the respective partition strip fabricating stations A, A' approach the corresponding aforementioned grooved trackways of the primary partition assembler 100A, various flaps a–d thereof are deflected or offset with respect to one another so that the flaps enter the grooves of the corresponding trackways in offset condition. More specifically, with reference to the leading transverse partition strip T in FIGS. 3 and 4 and each successive transverse partition strip in FIG. 5, the lower surfaces of the flaps a–d engage flap-offsetting or deflecting surfaces 110–113, respectively (FIGS. 4 and 5), causing the left-hand flap a in FIGS. 3 and 4 to slide into a lower longitudinal grooved trackway or guideway 120 in guide means 100 and causing the next succeeding flap b of the same transverse partition strip T to be offset in an upward direction into a longitudinal grooved trackway 121 immediately above grooved trackway 120.

Similarly, the flaps c, d of the same transverse partition strip T are deflected upwardly along the respective surfaces 112, 113 to respective higher elevations so that the leading edge portion of flap c enters another longitudinal grooved trackway 122 immediately above the grooved trackway 121 and the leading portion of the flap d enters the uppermost longitudinal grooved trackway 123. Each of these grooved trackways 120, 121, 122, 123 extends inwardly a predetermined distance of the guide means 100 to provide surfaces (FIGS. 9, 9A, 10, 13 and 44–47) against which the leading edges of the flaps a–d, along the longitudinal slotted edge of the respective transverse partition strip T, are held in engagement by an adjustable outer edge guide rail 125 (FIGS. 9, 9A and 46) during the advancement thereof longitudinally and forwardly along the grooved trackways 120–123.

With reference to the primary production line, as the flaps a–d of a certain number of successive transverse partition strips T (five in this instance ) being fed from the primary transverse partition fabricating station A are introduced into the longitudinal openings of the respective grooved trackways 120–123 (FIG. 13) at one side of the apparatus, a group of three longitudinal partition strips L are being delivered into the longitudinal slots of a set of three vertically spaced grooved trackways 131, 132, 133 positioned on the opposite side of the guide means 100 of partition assembling station 100A from the grooved trackways 120–123. The trackways 131, 132, 133 for the longitudinal partition strips L are alternately arranged or staggered with respect to the grooved trackways 120–123 for the transverse partition strips T. More specifically, referring to FIGS. 13 and 46 it will be observed that the level of grooved trackway 131 is approximately halfway between the levels of trackways 122, 123; the level of grooved trackway 132 is approximately halfway between the levels of the grooved trackways 121, 122; and the level of the grooved trackway 133 is approximately halfway between the levels of the grooved trackways 120, 121.

It is important to note that the grooved trackways 120–123 are in the form of a plurality of longitudinally and substantially horizontally extending vartically spaced parallel trackway openings or grooves in one side of the elongate guide means 100 and extending a predetermined distance inwardly of the guide means 100, and the grooved trackways 131–133 are in the form of a plurality of longitudinally and substantially horizontally extending vertically spaced parallel trackway openings or slots in the other side of the elongate guide means. The latter trackway slots extend through the guide means 100 to the last-mentioned one side thereof in parallel, alternating, vertically staggered relation to the trackway openings of the grooved trackways 120–123. The inner extremities of the grooved trackways or slots 131–133 are defined by longitudinal cam surfaces 135–137 forming corresponding edges of respective elongate, sheet-like cam plates 141–143 which converge forwardly at a preferred angle of about five degrees (5°) with respect to the inner extremities of the openings of the grooved trackways 120–123 to constitute cam means for convergingly guiding the longitudinal partition strips L into intermeshing or nesting relation with corresponding transverse partition strips T. The cam plates 141–143 are arranged in alternation with elongate, forwardly and rearwardly extending, partition assembling guide plates or track plates 150–153 in which the respective transverse-partition trackway grooves 120–123 are formed. These guide plate 150–153 constitute stationary components of the guide means 100. By this arrangement, with particular reference to FIGS. 9A and 44, it can be seen that the elongate cam means are of less longitudinal length than the guide means 100 and the cam means are movably positioned interiorly within the trackway slots for the grooved trackways 131–133 to extend from the receiving end toward the remote or forward end of the guide means for defining open portions in the trackway slots extending inwardly from that side of the guide means opposite from the openings of the grooved trackways 120–123 at a converging predetermined angle to the trackway openings from the receiving end to the remote or forward end of the guide means. The entire assembly of partition-assembling guide plates 150–153 and cam plates 141–143 is supported on an elongate, upper platform 155 which serves as one of the main longitudinal frame members of the apparatus (see FIG. 44).

It should be noted that, as preferred, the longitudinal inner surfaces of the grooved trackways 120–123 for the transverse partition strips T (see FIGS. 9, 9A, 10, 13 and 44), and those edges of guide plates 150–153 in which the grooved trackways 120–123 are formed, extend parallel to the production flow along the assembling station 100A and normal to the production flow along the respective transverse partition strip fabricating station A. It follows, therefore, that the longitudinal cam surfaces 135–137 defining the inner surfaces of the respective grooved trackways 131–133 for the longitudinal partition strips L, and those edges of guide plates 150–153 which define the outer extremities of the latter grooved trackways 131–133, should then extend forwardly at an angle of approximately five degrees (5°) with respect to the production flow along the assembling station 100A so that the longitudinal cam surfaces 135–137 converge forwardly at the preferred angle with respect to the inner extremities of the transverse-strip grooved trackways 120–123. Of course, it is preferred that the direction of flow of production along the respective longitudinal partition strip fabricating station B is normal to the path of travel of the longitudinal partition strips L along the elongate grooved trackways 131–133.

To accommodate the secondary or lower production line, it will be observed that the frame also includes a lower trackway supporting platform 155' extending longitudinally beneath the upper platform 155 and on which is mounted an assembly of partition assembling cam plates and guide plates (FIG. 38) which may be identical to plates 141–143, 150–153 on upper platform 155, and to which the same reference characters apply where applicable.

As heretofore indicated, as the flaps a–d of a certain number of successive transverse partition strips T are introduced into the respective grooved trackways 120–123, three of the longitudinal partition strips L, in this instance, are being fed from the primary longitudinal partition fabricating station B into the grooved trackways 131–133. In this regard, it will be noted that the flaps a'–f' of the longitudinal partition strips are not offset in the manner in which the flaps of the transverse partition strips are offset, but instead, the first longitudinal partition strip L of each group of three such strips has the slotted longitudinal edge and all of the flaps thereof introduced into the uppermost grooved trackway 131, the second longitudinal strip L of the corresponding group has its notched longtiudinal edge with all of the flaps thereof introduced into the intermediate trackway 132, and the third or last of the longitudinal partition strips L in the respective group has its notched edge with all of the flaps thereof introduced into the lowermost trackway 133.

Thus, it can be appreciated that the leading flap a of each successive transverse partition T in the corresponding group of five is positioned below the level of the lowermost longitudinal partition strip L of the respective group (see FIG. 46), which strip L is positioned in the lower grooved trackway 133; the next succeeding flap b of each successive transverse partition strip T in the respective group is positioned above the level of the lowermost longitudinal partition strip L and below the level of the intermediate longitudinal partition strip L in the respective group; the next succeeding flap c of each successive transverse partition T in the respective group is positioned above the level of the aforementioned intermediate longitudinal partition strip L in the middle grooved trackway 132 and is positioned below the level of the uppermost longitudinal partition strip L in the respective group; and the rearmost flap d of each successive transverse partition strip T in the corresponding group is positioned above the level of that longitudinal partition strip L positioned in the uppermost grooved trackway 131.

From the foregoing description of the slot cutting stations 80 (FIGS. 1, 3, 7, 22, 23 and 24) it is apparent that the number of slots N and flaps of the partition strips T, T', L, L' may be varied according to the number of cells desired in each partition strip assembly being produced. It is to be noted, however, that the number of transverse-partition-strip grooved trackways, such as trackways 120–123 (FIG. 13), should be at least equal the number of flaps on each transverse partition strip. Similarly, the number of longitudinal-partition-strip grooved trackways; e.g., trackways 131–133 should be at least equal to the maximum number of longitudinal partition strips to be employed in each partition strip assembly to be produced on the apparatus.

The number of flap-deflecting or guiding surfaces, such as 110–113 (FIG. 4), should also correspond to the number of transverse-partition-strip grooved trackways, and the wedge-shaped members defining the inclined deflecting surfaces 111, 112, 113 should be adjustably mounted on platform 155 for adjustment relative to each other and parallel to the corresponding grooved trackways of facilitate manufacture of partition strip assemblies whose transverse partition strips may have flaps which are quite wide or quite narrow during a given production run as compared to another production run.

III. Means for Longitudinally Displacing And Grouping Transverse Partition Strips Of Partition Assembling Stations:

Means will now be described for continuously longitudinally feeding, displacing and staggering partition strips T, T' in respective forward paths transversely of their paths of delivery into the guideways 120–123 by the respective delivery means or pairs of delivery rolls 101, 101' and to thereby facilitate subsequent uniform positioning and separating of the transverse partition strips T, T' into groups according to the number of such strips (five in this instance) to be present in each partition assembly.

Figure 5:
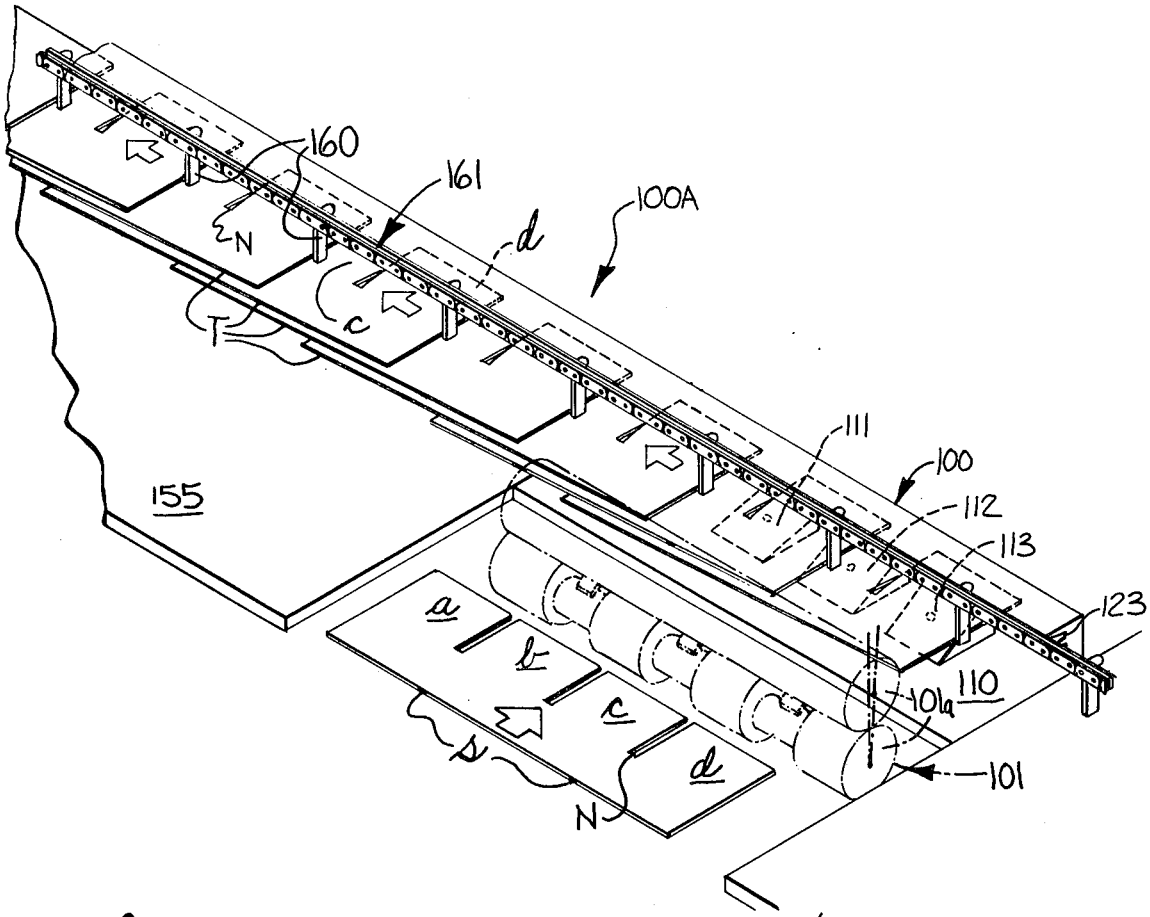
FIG. 5 is an illustration of means for advancing and progressively longitudinally staggering the transverse partition strips in each successive upper group being fed to the upper grooved trackways.
Figure 9:
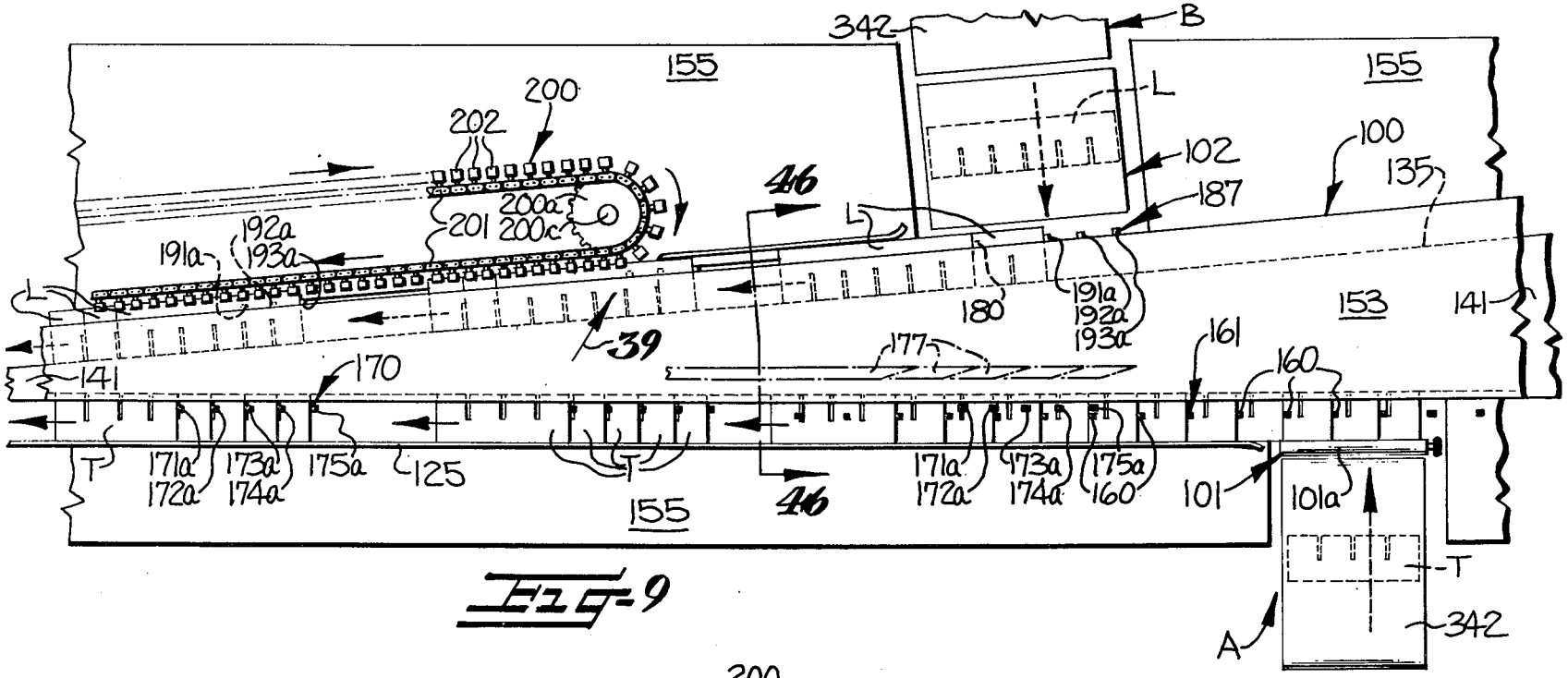
FIGS. 9 and 9A collectively present a plan view of the cooperating grooved trackways at opposite sides of the apparatus and illustrating elongate guide means and cam means, with cooperating moving means for convergingly moving the successive groups of transverse and longitudinal partition strips into nesting or intermeshing relationship during forward travel thereof.

It will be observed in FIGS. 1, 5 and 9 that the narrow trailing end edges of successive transverse partition strips T being discharged from the delivery rolls 101 of the respective transverse partition fabricating station A are engaged by respective strip-propelling and staggering fingers 160 substantially equally spaced and arranged in series along an endless strip-staggering conveyor means 161 illustrated in the form of an endless sprocket chain in FIGS. 1 and 5. Conveyor fingers 160 are also shown in FIGS. 9, 27, 27A, 28 and 29.

Figure 9A:
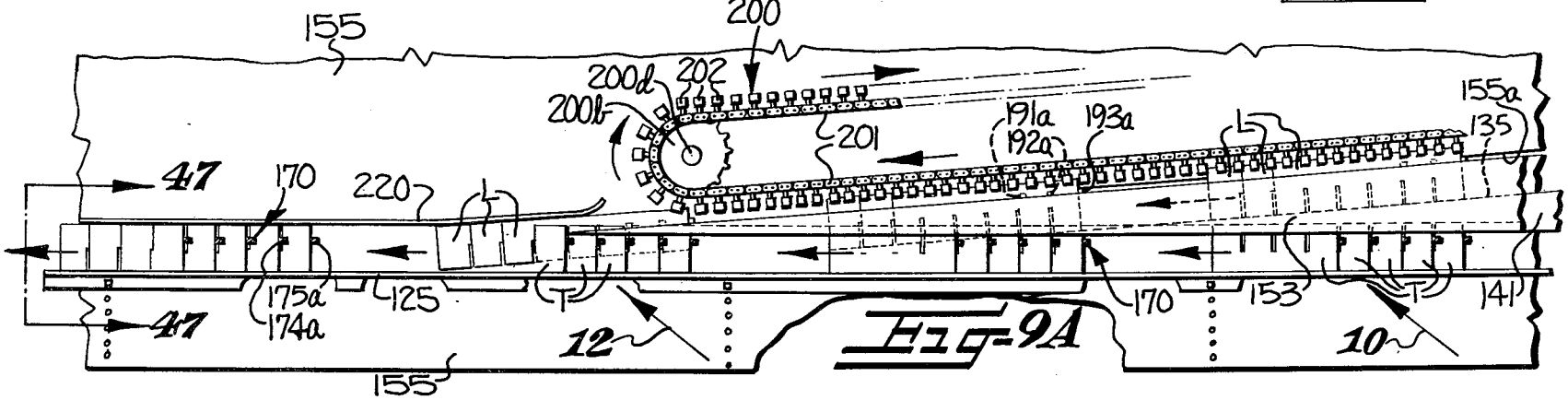

Chain 161 is mounted on a pair of sprocket wheels **161*a*, 161*b* (FIGS. 1 and 25) mounted on shafts carried by the machine frame. The strip-propelling fingers 160 are spaced from each other a distance substantially greater than the distance from the rear end edge of each transverse partition strip T to the next adjacent notch or slot N therein; e.g., about 4½ to 6 inches apart, to facilitate subsequent gathering or separating of the transverse partition strips T into groups in which notches or slots N of those transverse partition strips immediately above one another are substantially vertically aligned with one another as shown in FIGS. 6 and 9A**, for example.

Thus, it can be seen in FIGS. 9, 9A and 27 that the trailing edges of the delivered transverse partition strips T are initially spaced a predetermined distance apart which is greater than that distance they are to be spaced when they are subsequently gathered into respective separated groups for being assembled with a corresponding group of the longitudinal partition strips L. This facilitates spacing successive groups of transverse partition strips T apart from each other longitudinally of their travel toward the egress or remote end of the guide means 100 of the partition assembling station 100A so that successive groups of transverse partitions will not interfere with each other during the assembling operations.

Figure 25:
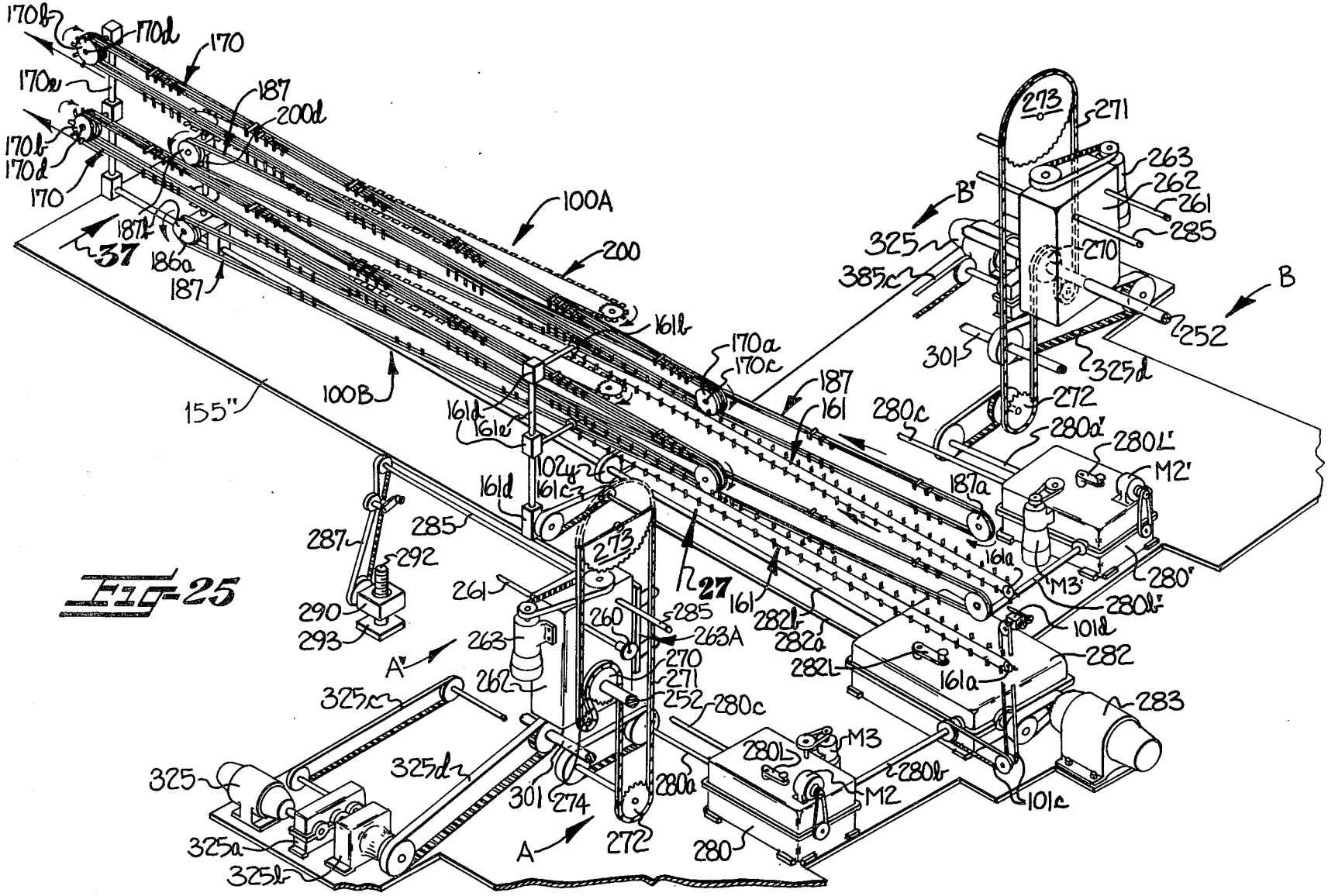
FIG. 25 is a perspective view illustrating various drive mechanisms.

In order to separate the successive forwardly moving transverse partition strips T into groups of overlapping strips downstream of the respective transverse partition strip fabricating station A, and to also facilitate assembly of partitions having a different number of transverse partition strips than the five transverse partition strips T shown in FIG. 2, there will be observed in FIGS. 1 and 25 a partition strip separating and grouping conveyor means broadly designated at 170, the right-hand or rear portion of which is spaced a substantial distance downstream, forwardly, from the rear portion of the strip-staggering conveyor means 161. It is important to note that the strip-staggering conveyor means 161 extends a substantial distance beyond the rear end portion of the partition-grouping conveyor means 170, and it also terminates a substantial distance rearwardly of the front or egress end of the partition-converging cam means heretofore described. On the other hand, the forward portion of the respective partition-grouping conveyor means 170 terminates forwardly of the egress end of the aforementioned partition-converging cam means.

Figures 27, 27A, 27B:
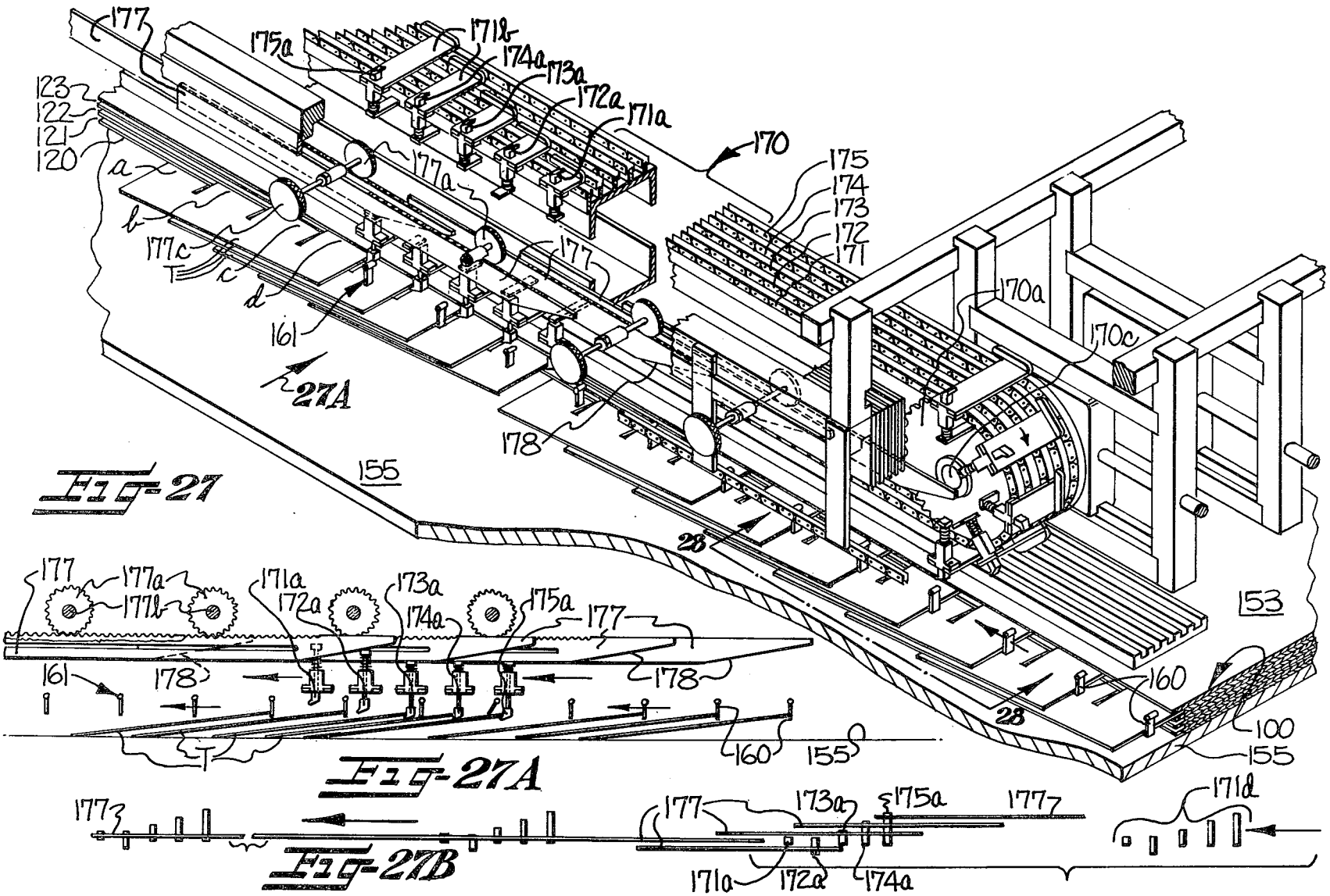
FIG. 27 is an enlarged perspective view taken looking generally in the direction of the arrow 27 in FIG. 25, and showing the relationship between the strip staggering means and the grouping means for forming successive groups of transverse partition strips delivered from the primary fabricating station A of FIG. 1.
FIG. 27A is a schematic elevational view looking generally in the direction of arrow 27A in FIG. 27 and especially illustrating a series of adjustable cam tracks for sequentially activating transverse-strip-propelling fingers in effecting grouping of transverse partition strips in their travel through the respective assembler.
FIG. 27B is a scehmatic plan view of the cam tracks for effecting desired sequential operation of the strip-propelling fingers 171*a*–175*a;*

As best shown in FIGS. 25, 27, 28 and 29, the partition separating and grouping conveyor means 170 for the transverse partition strips T being directed along the upper group of grooved trackways 120–123 comprises a plurality of endless conveyor elements or endless sprocket chains corresponding in number at least to the maximum number of transverse partition strips T to be present in the largest partition assembly for which the apparatus is manufactured. In this instance, the partition-grouping conveyor means 170 is shown as comprising five endless conveyor elements or sprocket chains 171–175 (see also FIG. 38) which carry respective yieldably mounted or spring-loaded transverse-strip-propelling fingers **171*a*, 172*a*, 173*a*, 174*a*, 175*a* arranged in spaced sets or groups along the partition-strip-grouping conveyor means 170 (FIGS. 27 and 27A). Each endless sprocket chain 171–175 is mounted on a respective pair of rear and front sprocket wheels 170*a*, 170*b* (FIGS. 1, 25, 27, 28, 37 and 38) mounted on shafts 170*c*, 170*d* carried by the machine frame. The drive for conveyor means 161 and 170** will be later described.

Each of the transverse-strip-propelling fingers **171*a*–175*a* is movably mounted in a respective bracket 171*b* suitably attached to the respective endless conveyor element or sprocket chain so that, by adjusting the sprocket chains 171–175 longitudinally relative to each other, the longitudinal spacing of the partition strip-propelling fingers 171*a*–175*a*** may be adjusted to accommodate the desired number of transverse partition strips to be present in each group while also taking into consideration the spacing of the notches or slots N in the repsective transverse partition strips T.

Figure 28:
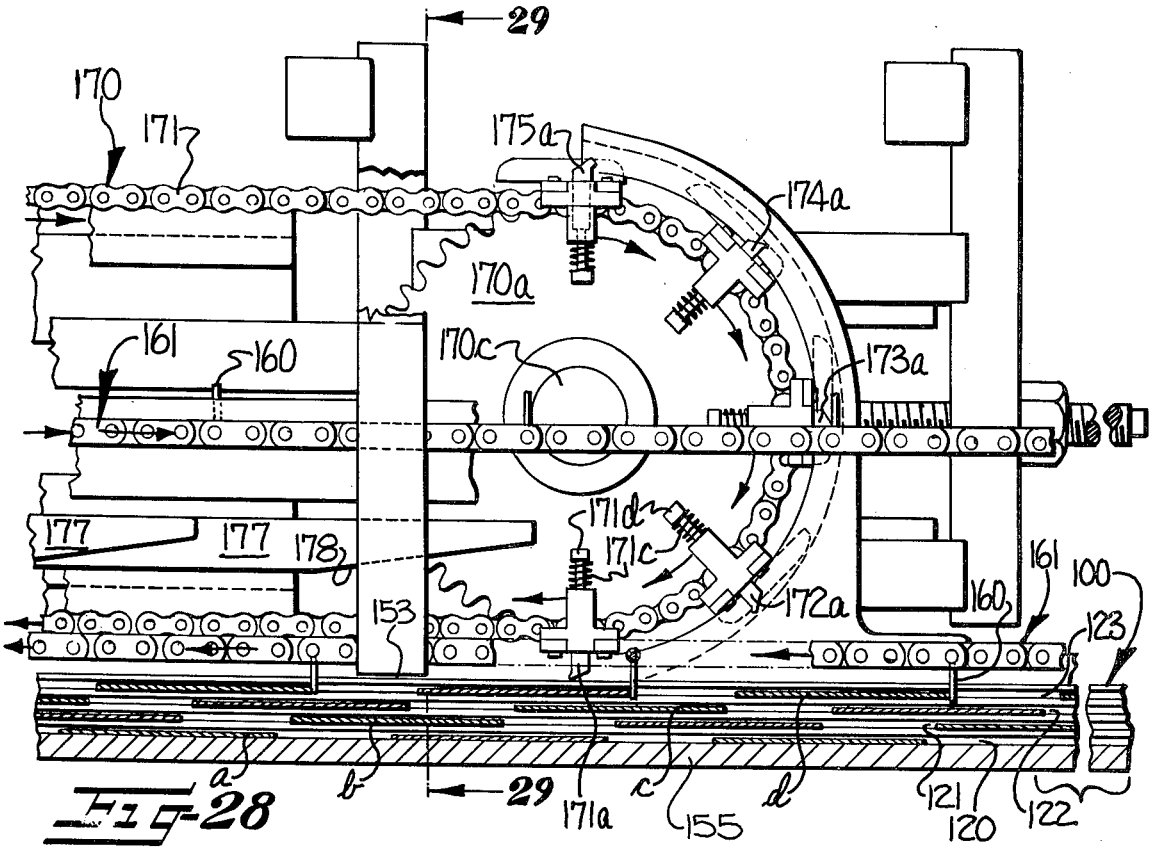
FIG. 28 is an enlarged fragmentary elevational view with parts in section and other parts broken away and being taken substantially along line 28—28 of FIG. 27.
Figure 29:
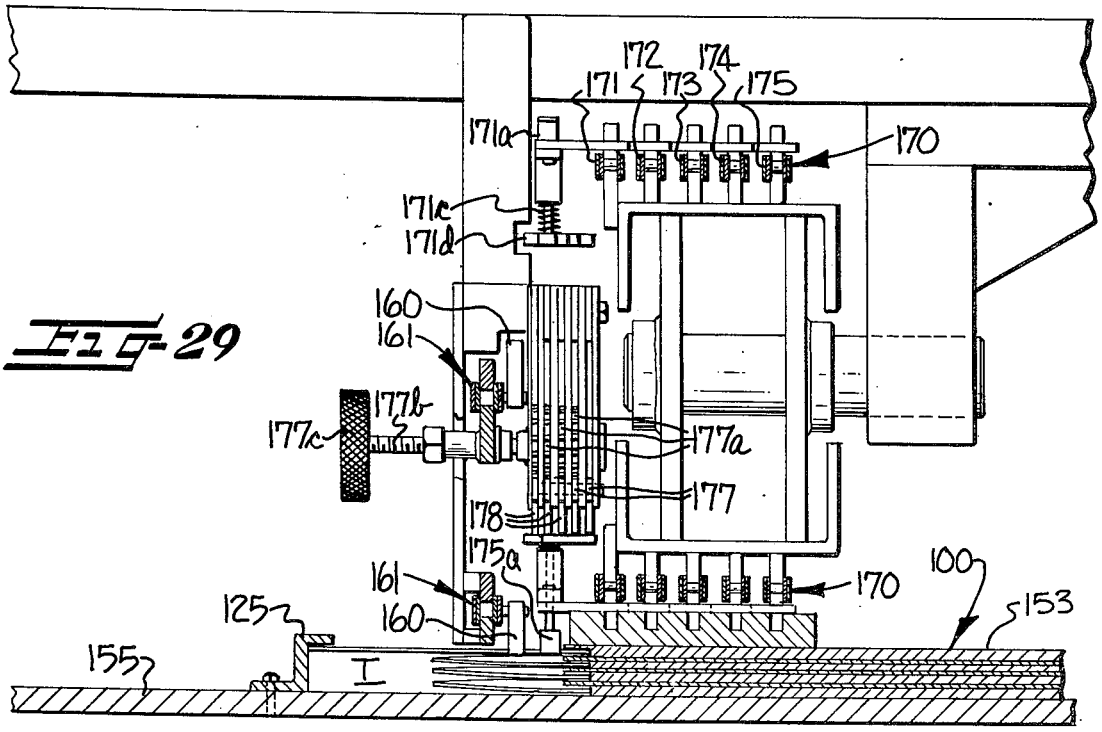
FIG. 29 is a transverse vertical sectional view taken substantially along line 29—29 in FIG. 28.

It will be observed in FIG. 28 that each strip-propelling finger 171*a*–175*a* is normally held in a retracted or withdrawn position by a respective spring 171*c*. The shank of each strip-propelling finger 171*a*–175*a* has a suitable follower 171*d* thereon for engaging a cam means, as the corresponding run of each respective conveyor chain 171–175 moves forwardly in close proximity to the forward path of the transverse partition strips T, to move the corresponding strip-propelling fingers outwardly during such forward movement thereof for engaging, and moving the respective transverse partition strips T forwardly at a faster rate than that at which the transverse partition strips T are propelled forwardly by the strip-propelling fingers 160 of the strip-staggering conveyor means 161.

The cam means for actuating the strip-propelling fingers 171*a*–175*a* of the gathering conveyor means 170 comprises a plurality of cam tracks corresponding in number to the number of propelling fingers 171*a*–175*a* in each group. Thus, as best shown in FIGS. 27, 27*a*, 28 and 29, a separate elongate, forwardly and rearwardly extending and longitudinally adjustable cam track 177, having an inclined rear cam surface 178 thereon, is provided for engagement by the follower 171*d* of each respective strip-propelling finger 171*a*–175*a*. It should be noted that the cam surfaces 178 of the cam tracks 177 are progressively spaced forwardly with respect to the path of movement of the active or lower run of the conveyor means 170 (see FIG. 27*a*) so that, as the transverse partition strips T are being propelled forwardly by the fingers 160 of the partition-staggering conveyor means 161, owing to the fact that the linear speed of the gathering conveyor means 170 is faster than that of the staggering conveyor means 161, each group of strip-propelling fingers 171*a*–175*a* will engage and advance a corresponding number of the transverse partition strips T at a faster rate than that at which the strips rearwardly thereof are being advanced by the strip-propelling fingers 160 of the staggering conveyor means 161.

It is apparent, by referring to FIGS. 9 and 9A, that the strip-propelling fingers 171*a*–175*a* of the gathering conveyor means 170 initially engage and advance the respective transverse partition strips T in the respective group in the reverse order. In other words, the rearmost or right-hand strip T, of any given group of five such strips in this instance, is first engaged and propelled forwardly by the trailing strip-propelling finger 175*a* in FIG. 9 relative to the next adjacent transverse partition strip T therebeneath. Thereafter, the preceding strip-propelling finger 174*a* catches up with the trailing edge of the next succeeding transverse partition strip T to start propelling the same forwardly at the same speed as the strip therebeneath is being propelled forwardly, but at a faster speed than that at which the subsequent strips are being advanced forwardly by the propelling fingers 160 of the staggering conveyor means 161.

This progression continues until the corresponding five transverse partition strips T are formed into a separate group spaced forwardly of the succeeding transverse partition strips T still being advanced by the partition strip staggering conveyor means 161 only as illustrated in the progressive steps of operation observed from right to left in FIG. 9 and then in FIG. 9A. In each such group of transverse partition strips, the rear end edge of each strip T (except the rearmost strip) in substantially aligned with the rear slot N in the next succeeding transverse strip therebeneath.

Figure 7A:
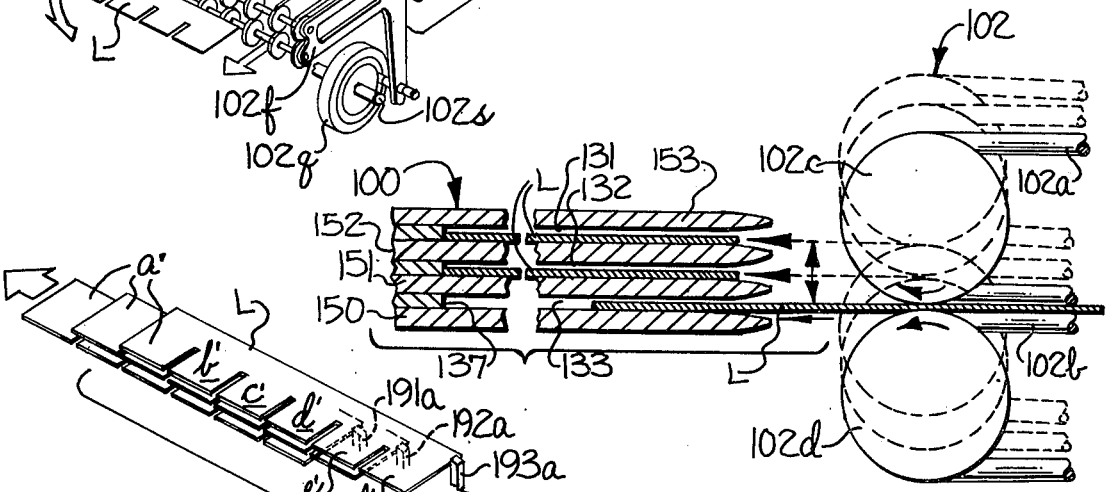
FIG. 7A is an enlarged, fragmentary, schematic view looking forwardly of the partition strip assembler and particularly showing how the longitudinal partition strips may be successively introduced into the corresponding grooved trackways.
Figure 8:
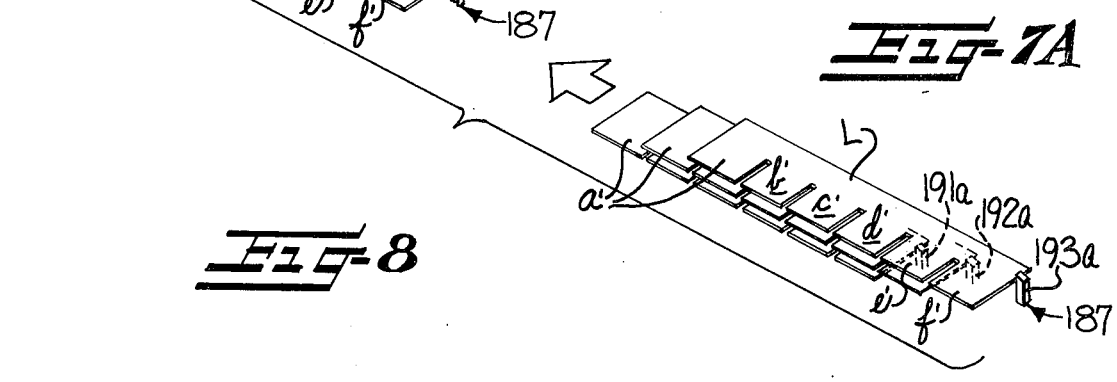
FIG. 8 is a view similar to FIG. 6, but showing how upper longitudinal partition strips at the other side of the apparatus are staggered and separated into respective groups.

IV. Means For Positioning Longitudinal Partition Strips In The Guide Means Of The Partition Assembling Stations:

As mentioned earlier herein, the delivery and positioning means 102, 102' are provided for delivering or transferring the longitudinal partition strips L, L' from the respective longitudinal partition strip fabricating stations B, B' into the sets of longitudinally extending grooved trackways 131–133 of the respective primary and secondary partition strip assemblers or assembling stations 100A, 100B. With particular reference to the primary production line, it will be observed in FIG. 7A that the delivery means 102 there partially shown serves to successively and repeatedly feed longitudinal partition strips L, one at a time, into the three grooved trackways or slots 131–133.

Therefore, the discharge end of the delivery and positioning means 102 is oscillated vertically relative to trackways 131–133 to successively and repeatedly substantially align the nip at the discharge end portions of belts 102*a*, 102*b* of delivery and positioning means 102 with the slots in the three trackways 131–133. In so doing, sets of three longitudinal partition strips L are positioned in the trackways 131–133 for being successively advanced forwardly along the respective trackways by means to be later described. The two positions occupied by the discharge end of delivery and positioning means 102 when feeding strips L into the upper and intermediate trackways 131, 132 are shown in broken lines in FIG. 7A, and the position occupied by the delivery and positioning means 102 when feeding a strip L into the lower trackway 133 is shown in solid lines in FIG. 7A. It should be noted that means are provided for adjusting the vertical range of operation of delivery and positioning means 102 so that, when desired, it may be operated to move only into operative relation with the upper and intermediate trackways 132, 133 (FIG. 7A) when the operator desires to produce partition strip assemblies having only two longitudinal partition strips L therein as opposed to the three partition strips L shown in FIG. 2 etc.

In this regard, during production of 12-cell partition strip assemblies, four-flap longitudinal partition strips may be inserted into the two upper trackways 131, 132 (FIGS. 7A, 13, 35 and 36) in alternation and in timed relation to the successive feeding of sets of three three-flap transverse partition strips to the trackways on the other side of guide means 100. Since the transverse-strip-receiving side of each guide means 100 has four trackways 120–123 therein (FIGS. 4, 10, 13, 28 and 46), it is preferred that the flaps of the three-flap transverse partition strips be inserted into the openings of the three upper grooved trackways 121–123 only of each guide means 100. In this case, the three flaps of each successive transverse partition strip would engage the properly positioned respective deflecting surfaces 111, 112, 113 (FIG. 4) and be directed into the respective trackways 121–123.

Details of the delivery and positioning means 102, 102' for the two longitudinal partition strip fabricating stations B, B' are best shown in FIGS. 7, 7*a* and 30–34, and they are quite similar to each other. Therefore, where practicable, the same description and reference characters will apply to both delivery means 102, 102' with particular emphasis on the details of the delivery means 102 of the primary longitudinal partition fabricating station B. However, pertinent differences in the two delivery means 102, 102' will be pointed out later herein.

To aid in preventing the successive longitudinal partition strips L from becoming askew as they are being fed into the slots of the three trackways 131, 132, 133 of the guide means 100 of the partition assembling stations 100A, 100B repeatedly and in succession, it will be observed in FIGS. 7, 7*a* and 30–34 that each delivery and positioning conveyor means 102, 102' is in the form of an endless conveyor and comprises a plurality of the side-by-side aprons or endless conveyor belts 102*a*, 102*b* entrained over sets of upper and lower rollers 102*c*, 102*d*, there being an inner set of the rollers 102*c*, 102*d* adjacent the trackways 131–133 (FIG. 13), and there being a pair of outer upper and lower sets of the rollers 102*c*, 102*d* spaced outwardly from the trackways 131–133 in a direction toward the corresponding slot cutting station 80 of the respective longitudinal partition strip fabricating station. The distance from the adjacent nip or bight of the belts 102*a*, 102*b* to the cam surface 135–137 (FIGS. 13 and 46) should be somewhat greater than the widths of the longitudinal partition strips L.

The sets of upper and lower, inner and outer, rollers 102*c*, 102*d* are journaled in a pivotal or cantilever carriage means 102*f* (FIGS. 31–34) with the outermost lower shaft 102*g* for one of the lower rows of rollers 102*d* being pivotally supported in the frame of the apparatus for pivotal movement about a substantially horizontal axis extending substantially parallel to the cam surfaces 135–137 of the partition-converging cam means heretofore described. The shaft 102*g* also serves to pivotaly support the cantilever carriage means as well as serving as a means for driving the endless belts 102*a*, 102*b* through the medium of the rollers 102*d* mounted on the shaft 102*g*. The shaft 102*b* is connected, by belt and pulley connections 102*k*, to the output side of a gear box 102*m*, common to both of the delivery means 102, 102' (FIG. 33) for the two longitudinal partition strip fabricating stations B, B'. The means for driving the input of the gear box 102*m* will be later described.

The cantilever carriage means 102*f* is provided with one or more substantially perpendicular arms 102*n* thereon, each of which is provided with a pair of axially spaced follower elements 102*p* thereon. The two follower elements 102*p* are adapted to be alternatively engaged by respective closed face cam members 102*q*, 102*r*, depending upon the size of the partition assembly being produced, i.e., depending upon the number of longitudinal partition strips L to be present in each partition strip assembly. In the particular illustrated embodiment, it will be noted that the follower elements 102*p* may engage the closed face cams 102*q* during production of partition assemblies having 24 cells, and the other cam follower elements 102*p* may be engaged by the closed face cams 102*r* during the production of partition assemblies having 12 cells therein. Accordingly, each of the pairs of closed face cams 102*q*, 102*r* is axially adjustable on the supporting cam shaft 102*s* therefor, as by means of a removable key pin 102*t* carried by the common hub of each pair of closed face cams 102*q*, 102*r* and adapted to be selectively positioned in various holes 102*u* in shaft 102*s*. The cam shaft 102*s* is common to both of the strip delivery means 102, 102' and is suitably journaled on the frame of the apparatus.

The shaft 102*s* is driven in timed relation to the speed of the endless belts 102*a*, 102*b* of the delivery means 102, 102' as effected by the gear box 102*m*, so as to impart vertical reciprocation to the inner end portions of the belts 102*a*, 102*b* which will result in one of the longitudinal partition strips L being discharged into each of the respective trackways 131, 132, 133 (FIGS. 7A, 13 and 46) during each reciprocation of the respective cantilever carriage means 102*f* occurring during production of 24-cell partition assemblies such as that shown in FIG. 2. As in the case with respect to gear box 102*m*, the means for driving the cam shaft 102*s* will be later described (see FIGS. 25 and 30).

As herefore indicated, with particular reference to the primary production line, longitudinal partition strips L are delivered by the corresponding delivery means 102 in rapid succession at a uniform rate throughout the operation of the apparatus, and the delivery means 102 operates in timed relation to feed each successive group of three successive longitudinal partition strips L into the longitudinal trackway slots 131–133 of the guide means 100 of the partition assembling station and against the respective cam surfaces 135, 136, 137 (FIGS. 9, 13, 44 and 46). It is apparent that delivery of the longitudinal partition strips L into the trackways 131–133 is effected in precisely timed relationship to the delivery of the transverse partition strips T to the longitudinal trackways or grooves 120–123, with the tabs or flaps a–d positioned in the respective trackway grooves 120–123 and having their inner edges positioned against the inner extremities of the trackway grooves. It follows, therefore, that three of the relatively longer six-flapped longitudinal partition strips L are partitioned in the trackway slots 131–133 and in engagement with the converging cam means as five of the four-flapped transverse partitions T are being positioned in the trackway grooves 120–123 to assemble a 24-cell partition, as shown in FIG. 2.

V. Means For Longitudinally Displacing And Grouping Longitudinal Partition Strips of Partition Assembling Stations:

Staggering and grouping of the three longitudinal partition strips L may be effected somewhat differently from that of the groups of transverse partition strips T. It will be observed in FIG. 35 that each successive longitudinal partition strip L delivered into the upper trackway 131 by the corresponding delivery means 102 may be relatively quickly advanced forwardly. The reason for the relatively fast advancement of the upper longitudinal partition strip L in each successive group is to insure that each such strip is disposed forwardly of and out of the way of the corresponding strip delivery means 102 upon the next succeeding longitudinal strip L being inserted in the uppermost trackway 131.

Figures 35, 36:
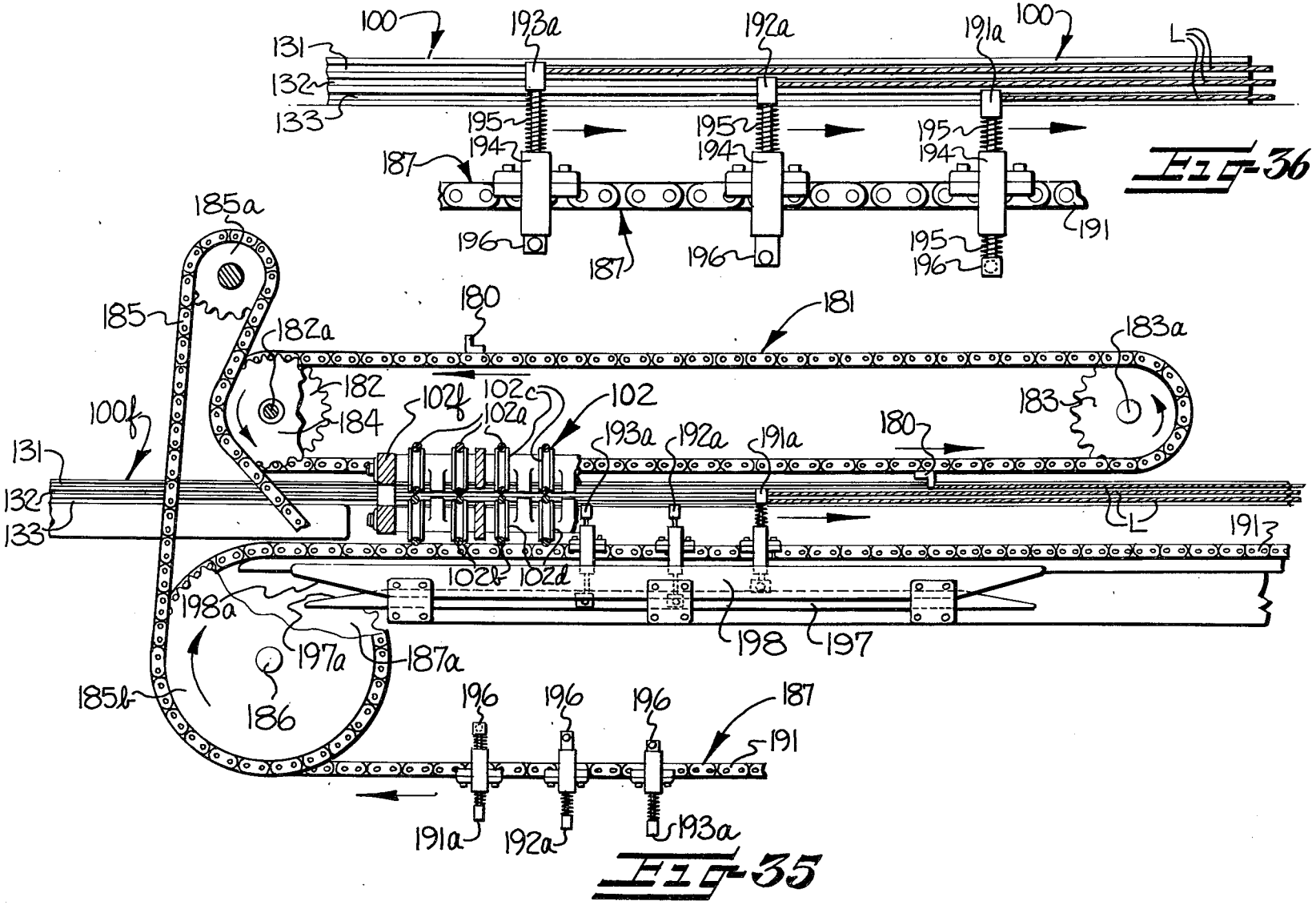
FIG. 35 is a vertical sectional view, partially in elevation, taken substantially along line 35—35 in FIG. 31, and showing means for advancing and staggering longitudinal partition strips emerging from the primary longitudinal partition fabricating station B of FIG. 1.
FIG. 36 is an enlarged detail of some of the strip-propelling devices for the longitudinal partitions similarly illustrated on a smaller scale in FIG. 35.

In order to advance each successive upper longitudinal partition strip L of each successive group forwardly at a relatively fast rate, as heretofore indicated, each successive upper longitudinal partition strip L received in trackway 131 is engaged by a strip propelling finger 180, two of which are shown in FIG. 35 being carried by an endless conveyor element 181 constituting a preliminary longitudinal strip-advancing means. The preliminary advancing means 181 is shown in the form of a sprocket chain, and it will be observed in FIG. 35 that the sprocket chain 181 is mounted on a pair of sprocket wheels 182, 183 mounted on shafts 182*a*, 183*a* supported by the frame of the apparatus. Fixed in axial relation to sprocket wheel 182 is a sprocket wheel 184 engaged by an endless sprocket chain 185 entrained on sprocket wheels 185*a*, 185*b*. Sprocket wheel 185*b* is mounted on a shaft 186 on which rear sprocket wheels 187*a* of a longitudinal-strip-grouping conveyor means 187 are mounted. Sprocket wheel 185*b* is arranged to be driven by sprocket wheels 187*a* for driving the preliminary longitudinal-strip-advancing conveyor means 181.

The longitudinal-strip-grouping conveyor means 187 is quite similar to the grouping conveyor means 170 for the transverse partition strips T (see FIGS. 25 and 27), with the exception that the grouping conveyor means 187 for the longitudinal partition strips L comprises three forwardly and rearwardly extending endless conveyor elements or sprocket chains 191, 192, 193 instead of five sprocket chains as is the case with respect to the conveyor means 170 of FIG. 27, for example.

It is apparent that only three sprocket chains or endless pliable elements may be required at the right-hand side of the apparatus as observed in FIG. 1 because no more than three longitudinal partition strips L are usually assembled with corresponding transverse partition strips T. Of course, only two longitudinal partition strips L may be assembled with transverse partition strips T when a partition assembly having a lesser number of cells than that shown in FIG. 2 is being produced, as heretofore explained.

Figure 31:
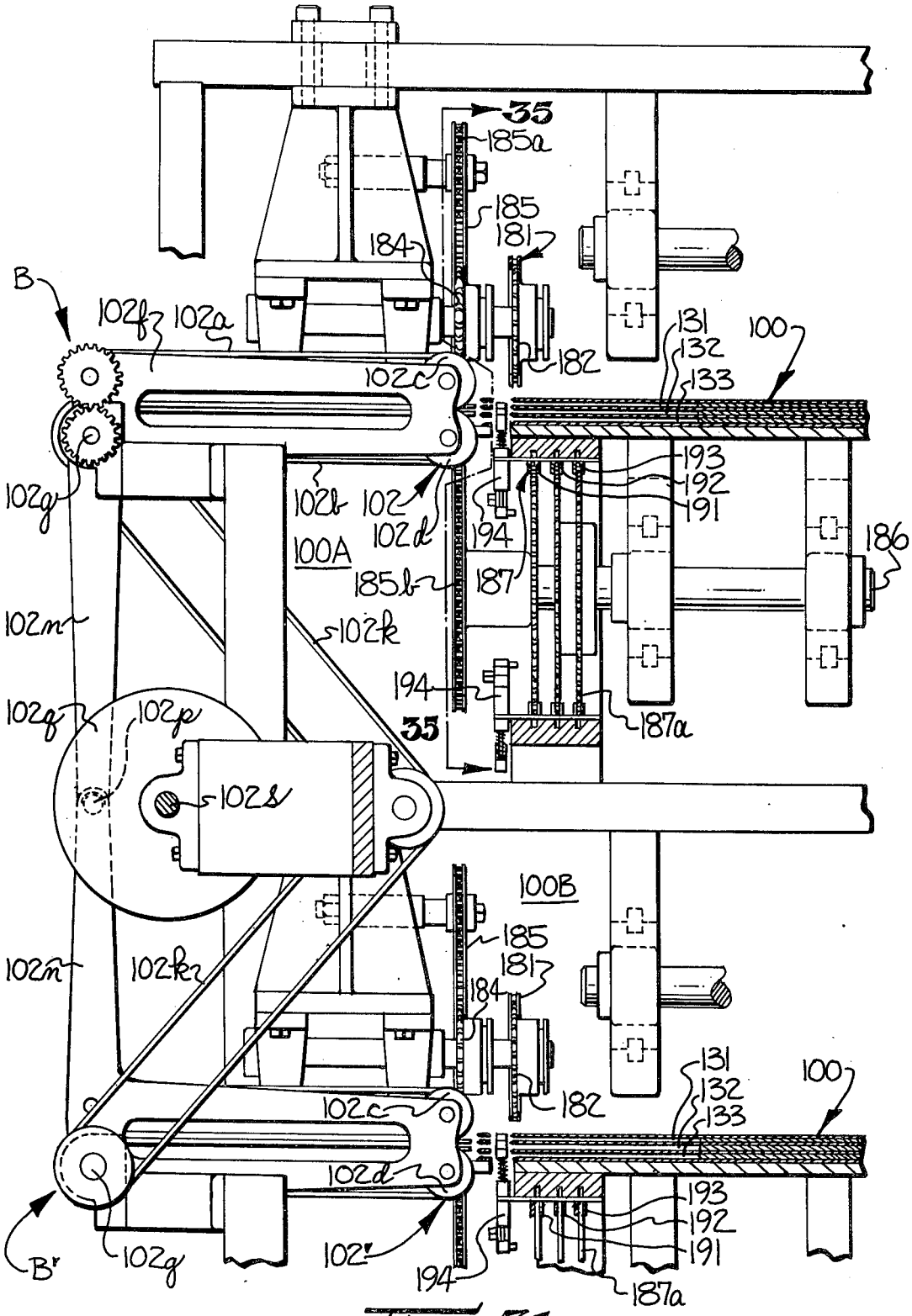
FIG. 31 is a fragmentary elevation, partially in section, taken substantially along line 31—31 in FIG. 30.
Figure 34:
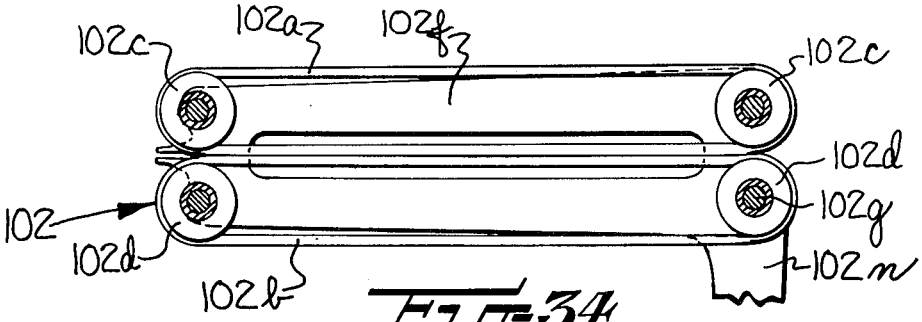
FIG. 34 is an enlarged fragmentary view partially in section taken substantially along line 34—34 in FIG. 32.
Figures 32, 33:
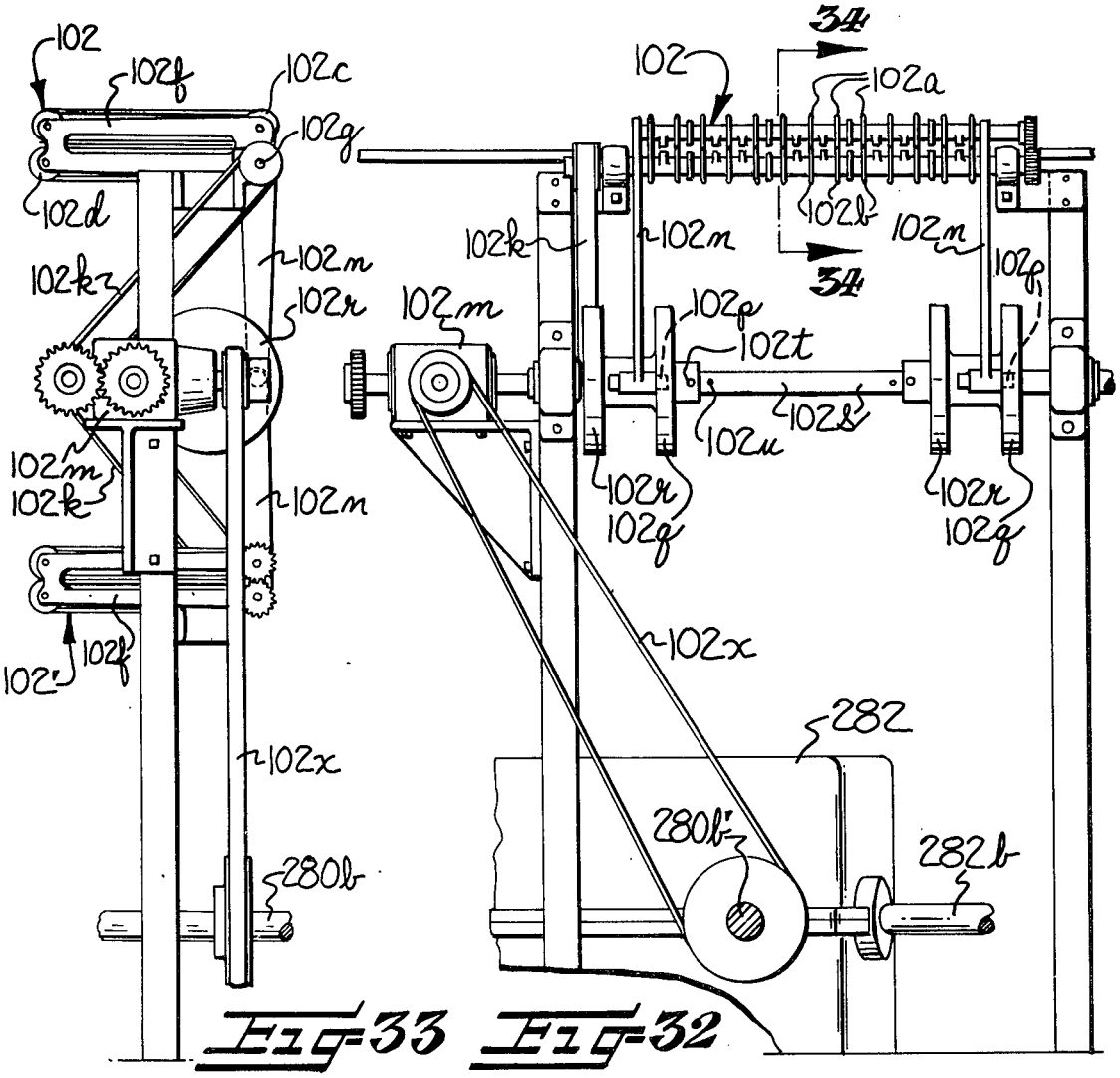
FIG. 32 is an enlarged fragmentary elevation looking generally in the direction of arrow 32 in FIG. 30.
FIG. 33 is a fragmentary view looking at the left-hand side of FIG. 32.
Figure 38:
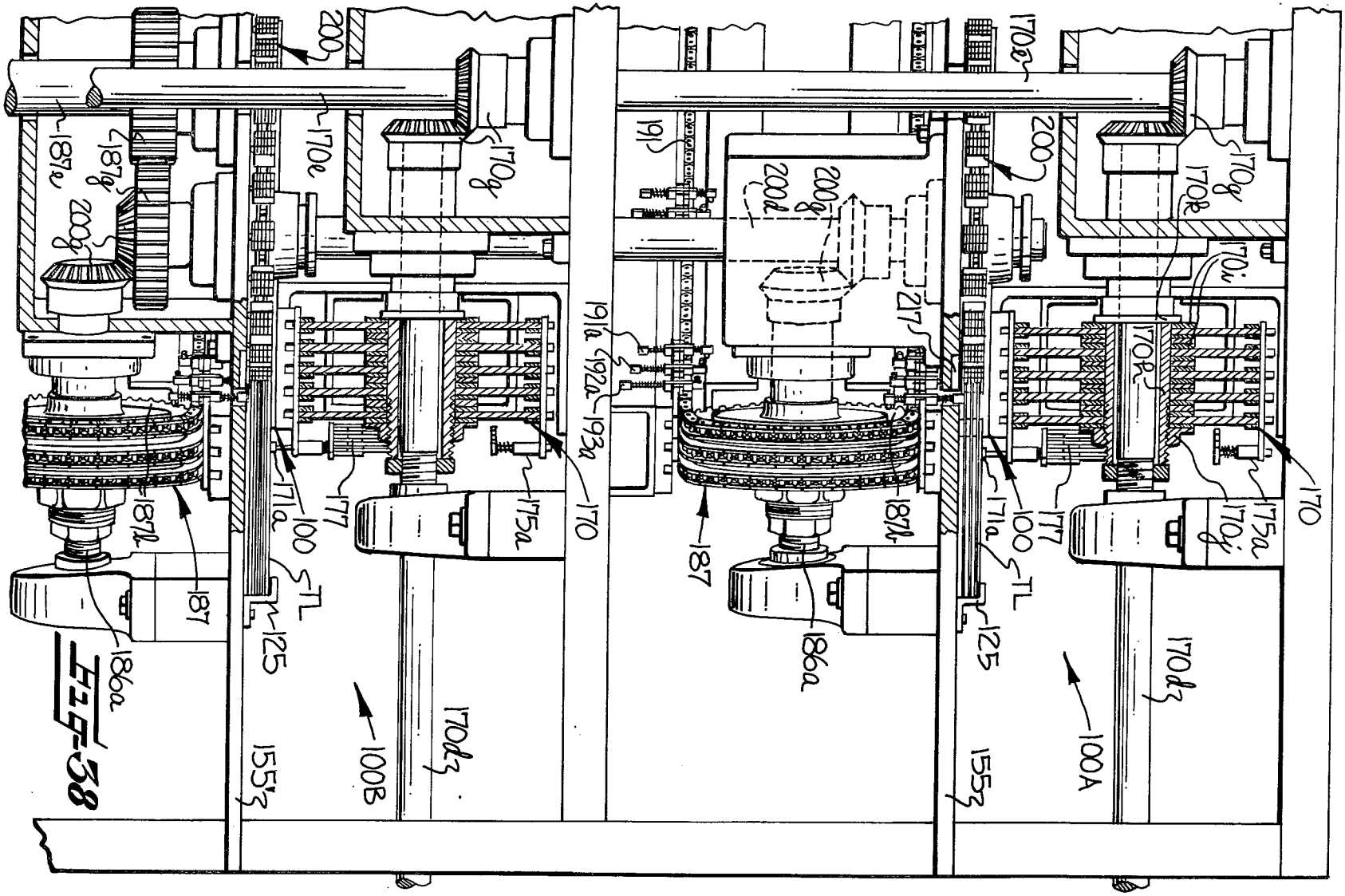
FIG. 38 is an enlarged vertical sectional view taken substantially along line 38—38 in FIG. 37.

As shown in FIGS. 31, 35 and 38, the three endless sprocket chains 191–193 of the longitudinal-strip-grouping conveyor means 187 are positioned below the level of the corresponding longitudinal slots of the trackways 131–133 and cam means 141–143, as opposed to the conveyor chains 171–175 (FIG. 27) which are positioned above the openings in the grooved trackways 121–123. This is desirable because each successive transverse partition strip T is staggered forwardly of the next succeeding transverse partition strip T therebeneath while, on the other hand, at least by the time that the successive groups of transverse and longitudinal partition strips T, L are being assembled as in FIGS. 9A and 12, each successive leading longitudinal partition strip L is positioned beneath and staggered forwardly of the next succeeding longitudinal partition strip L, as best illustrated in FIGS. 11 and 12.

Each sprocket chain 191–193 is mounted on a respective pair of rear and front sprocket wheels 187*a*, 187*b* adjustably mounted (for adjustment about their axes) on respective shafts 186, 186*a* (FIGS. 35 and 38) to permit relative longitudinal adjustment of chains 191–193. Shafts 186, 186*a* are suitably rotatably supported by platform 155. The drive for conveyor means 187 will be later described.

Spaced longitudinally along the longitudinal-strip-grouping conveyor means 187 are a plurality of substantially equally spaced groups or sets of three longitudinal-strip-propelling fingers 191*a*, 192*a*, 193*a* which are best shown in FIG. 35 in the form of outwardly projecting, spring-loaded, plungers positioned on a corresponding side of the conveyor means 187 and being carried by the respective sprocket chains 191–193 through the medium of respective brackets 194.

It should be noted that, while all three of the strip-propelling fingers 191*a*, 192*a*, 193*a* of each group may be carried by a common endless pliable element or chain, it is preferred that they are carried by separate chains or pliable elements so that they may be longitudinally adjusted along the conveyor means 187 with respect to each other to accommodate differing sizes and types of longitudinal partition strips L, similar to the arrangement of the strip-propelling fingers 171*a*–175*a* of FIG. 27. In any event, it is preferred that the three strip-propelling fingers 191*a*–193*a* of each group are equally spaced from each other in accordance with the width of the individual tabs or flaps on the longitudinal partition strips L, such flaps or tabs being indicated at a'–f' in FIG. 11, for example.

Respective springs 195 (FIGS. 35 and 36) normally yieldably maintain the longitudinal-strip-propelling fingers 191*a*–193*a* in the predetermined relative positions shown in the lower portion of FIG. 35, which is the position of rest thereof upon the staggering and grouping of each successive group of longitudinal partition strips L being effected in a manner to be presently described. In this regard, it will be observed in FIG. 36 (above FIG. 35) that upon completion of the staggering and grouping of each successive group of three longitudinal partition strips L, the three fingers 191*a*–193*a* occupy the same relative positions with respect to the upper flight of the conveyor means 187 as is the case during travel thereof along the lower flight of the conveyor means 187 as shown in the lower portion of FIG. 35. However, in order to effect the desired staggered and grouped relationship between the longitudinal partitions L of each successive group, it will be observed in FIG. 35 that the inner portion of the shank or stem of each strip-propelling finger 191*a*–193*a* is provided with a follower 196 thereon, and that follower 196 on the shank of the leading strip-propelling finger 191*a* of each successive group is adapted to engage a longitudinal cam track 197, and the other two followers 196 (carried by the shanks of the strip-propelling fingers 192*a*, 193*a*) are adapted to engage a common cam track 198. In this instance, the cam track 197 faces upwardly while the cam track 198 faces downwardly.

Both cam tracks 197, 198 are provided with inclined end surfaces 197*a*, 198*a*, respectively, at the rear and front ends thereof, and the cam tracks 197, 198 are so positioned as to effect the desired operation of the longitudinal-strip-propelling fingers 191*a*–193*a* in advancing and positioning each respective group of three longitudinal partition strips L in the desired uniformly staggered relationship with their slots N positioned directly opposite from slots N in the respective group of five transverse partition strips T (see FIGS. 9–12).

Accordingly, after a corresponding strip-propelling finger 180 on the conveyor means 181 (FIG. 35) has advanced the uppermost longitudinal partition strip L last received in the corresponding grooved trackway 131 a substantial distance beyond the front portion of the respective delivery means 102 (FIG. 7A), and while the next succeeding group of strip-propelling fingers 191*a*–193*a* is closely approaching the trailing or rear portion of the respective delivery means 102, the intermediate and lowermost longitudinal partition strips L are successively positioned in the intermediate and lowermost trackways 132, 133. Thereupon, cam track 197 raises the leading strip-propelling finger 191*a* so that it engages the latter two lower partition strips L in the aforementioned group and advances the same forwardly along the respective trackways 132, 133 and in this manner the strip-propelling finger 191*a* initially performs the same function with the intermediate and lowermost strips L as does the strip-propelling finger 180 with the uppermost strip L. By referring to FIGS. 9, 9A, 10 and 38, it is apparent that platform 155 is suitably slotted as at 155*a*, substantially parallel to the forwardly angled cam surfaces 135–137 to permit fingers 191a–193a to pass upwardly through platform 155 for engaging the trailing ends of longitudinal partition strips L in trackways 131–133.

If desired, portions of track guide plates 150–153 (FIG. 13) adjacent delivery means 102 and defining the trackways 131–133 may extend outwardly beyond the vertical planes of fingers 191a–193a (FIGS. 35 and 36) to provide additional support for the longitudinal partition strips as they are being received in the trackways 131–133 against the forwardly angled cam surfaces 135–137 (FIGS. 9, 9A, 10 and 13). Accordingly, the outer portions of plates 150–153 then may be suitably slotted above slot 155a, adjacent the longitudinal-partition-strip delivery means 102; e.g., as in FIG. 31, to accommodate fingers 191a–193a. These latter slots are purposefully omitted in the schematic showing the FIG. 7A and in some other views, for purposes of clarity.

As the two strip-propelling fingers 192a, 193a approach the oscillating delivery means 102, their followers 196 engage the cam track 198 (FIG. 35) and are thus forced downwardly so that the upper ends of fingers 192a, 193a are positioned below the level of the slot in the bottom trackway 133 and so that they will not interfere with the subsequent operation of the delivery means 102 so as it is inserting a succeeding group of three longitudinal partition strips L in the respective grooved trackways 131, 132, 133. Referring now to the group of three strip-propelling fingers 191a, 192a, 193a shown in the central portion of FIG. 35, for example, it will be observed that the latter fingers occupy positions wherein the leading finger 191a is engaging and moving the two lower partition strips L forwardly along the trackways 132, 133 as the uppermost longitudinal partition strip L is being advanced forwardly by the corresponding flight bar 180 and also during which the two trailing strip-propelling fingers 192a, 193a are moving along beside but on a lower level than the slot in the lowermost trackway 133.

This condition exists until the follower 196 of finger 191a moves out of engagement with the front end of cam track 197 and until the followers 196 of the fingers 192a, 193a move out of engagement with the cam track 198. Thereupon, the finger 191a is moved downwardly by its spring 195 to pass beneath the intermediate longitudinal partition strip L in the corresponding group while continuing to advance the lowermost partition strip L forwardly relative to the intermediate partition strip L. Since the followers 196 of the fingers 192a, 193a have now moved out of engagement with cam track 198, the finger 192a is released to be moved upwardly by its spring 195 to engage only the intermediate longitudinal partition strip L in the corresponding group for advancing the same in unison with the advancement of the lowermost partition strip L but relative to and past the uppermost partition strip L in the corresponding group after the corresponding strip-propelling finger 180 therabove moves out of engagment with the latter partition strip L.

The rearmost finger 193a in the corresponding group is then projecting above the level of both of the preceding fingers 191a, 192a and moves into engagement with the trailing edge of the uppermost longitudinal partition strip L in the corresponding group. Thus all, three of the partition strips L in the corresponding group are advanced in uniformly spaced or staggered relationship along the corresponding trackways slots 131, 132, 133 as shown in FIG. 36 by the corresponding group of three fingers 191a, 192a, 193a on the conveyor means 187 extending therebeneath. It is apparent that the rate of speed of the longitudinal-strip-conveyor means 187 should be the same as that of the transverse-strip-conveyor means 170 (FIGS. 27 and 28).

Referring now to the plan view of the forwardly converging cam means and assembler track means in FIGS. 9 and 9A, it will be noted that many details of the apparatus are omitted from these views for purposes of clarity. With this in mind, it is to be noted that the conveyor means 187 is largely omitted in FIGS. 9 and 9A with the exception of groups of the longitudinal-strip-propelling fingers 191a–193a thereof. However, by comparing the forwardmost strip-propelling finger 193a shown in the central portion of FIG. 9A with the forward end of the cam plate 141 there shown, it is apparent that the forward portion of the longitudinal-strip-grouping conveyor means 187 is spaced a substantial distance forwardly from the substantially pointed front end of the converging conveyor means as exemplified by the front portion of cam plate 141.

At this point in the description, it is deemed advisable to point out that, although both the transverse and longitudinal partition strips T, L are of about the same width for making cell partition assemblies of a given height when in use, it is apparent that various heights and sizes as well as types of cell partition assemblies are required in the market. Accordingly, as will be more specifically described later in this context, the cam means embodied in the cam plates 141–143 of FIGS. 9, 9A, 13 and 46 is longitudinally adjustable relative to the grooved trackways 120–123. Thus, for example, assuming that the width of the transverse and longitudinal partition strips T, L of FIGS. 9 and 9A may be about three or four inches, it becomes apparent that the cam plate 141, for example, as well as the cam plates 142, 143 therebeneath (FIG. 44), must be adjusted rearwardly or to the right in FIGS. 9 and 9A for a substantial distance in order to accommodate partition strips L which may be up to three or four times as wide as those shown in FIGS. 9 and 9A.

VI. Gripper Means For Guiding Partition Strips Along Guide Means of Partition Assembling Stations:

To insure that the successive groups of transverse partition strips T are properly assembled with the corresponding group of longitudinal partition strips L, particularly as the groups of partition strips advance beyond the forwardmost ends of the cam plates 141–143, means are provided for gripping and maintaining the longitudinal partition strips in the desired position substantially parallel to the forwardly angled cam surfaces 135–137 on the cam plates 141–143, once their path has been established, even though the slotted edges of the longitudinal partitions L traveling along the slots of grooved trackways 131–133 (FIG. 13) must move forwardly beyond the forward extremity of the cam means; i.e., forwardly beyond the forwardmost ends of the cam plates 141–143. This aids in insuring that the longitudinal strips L are subsequently moved into the proper nesting relationship with the corresponding group of transverse partition strips T to complete the formation of each successive collapsed partition assembly as shown in the left-hand portion of FIG. 9A and in FIG. 12.

Accordingly, following the formation of the longitudinal partition strips L of each successive group into the proper grouped relationship by the means shown in FIGS. 35 and 36 as heretofore described, and downstream of the conveyor means 181, all three of the longitudinal partition strips L in each successive group are clampingly or grippingly engaged and advanced in predetermined fixed relationship along the slots of the grooved trackways 131–133 by a gripping and advancing conveyor means, broadly designated at 200 and best illustrated in FIGS. 1, 9, 9A, 25 and 37–43. The gripping and advancing conveyor means 200 comprises an endless pliable conveyor element or sprocket chain 201 having a plurality of closely spaced gripper units 202 thereon. Rear and front portions of chain 201 are mounted on respective sprocket wheels 200*a*, 200*b* (FIGS. 9, 9A and 38) fixed on respective substantially vertical shafts 200*c*, 200*d* journaled in the upper and intermediate platforms 155, 155' (see FIGS. 1 and 38).

Each gripper unit is shown in FIGS. 39–42 in the form of a notched block or body having three vertically spaced and outwardly facing lower jaws H, I, J defining respective notches thereabove in the outer face of the base and which are so positioned as to be substantially aligned with the bottoms of the slots in trackways 131–133, respectively, as the gripper units 202 move with the inner run of the endless sprocket chain 201. The body of each gripper unit 202 has a vertically movable clamping or gripper member 204 mounted therein for vertical movement relative to the respective gripper block. As best shown in FIG. 43, the clamping member 204 of each gripper unit 202 is provided with three vertically spaced outwardly projecting movable gripper jaws H', I', J' integral therewith and which are normally biased downwardly, by a spring 205, generally toward the respective lower jaws H, I, J to the extent permitted by the gripper member 204 either being in engagement with the lower wall or jaw J of the gripper body or by the gripper jaws H', I', J' being in gripping or clamping engagement with the upper surfaces of the outer edge portions of a corresponding group of three longitudinal partition strips L and clampingly securing the same against the lower jaws H, I, J on which said outer edge portions of the corresponding longitudinal partition strips L are then positioned.

Figures 39, 40, 41, 42, 43:
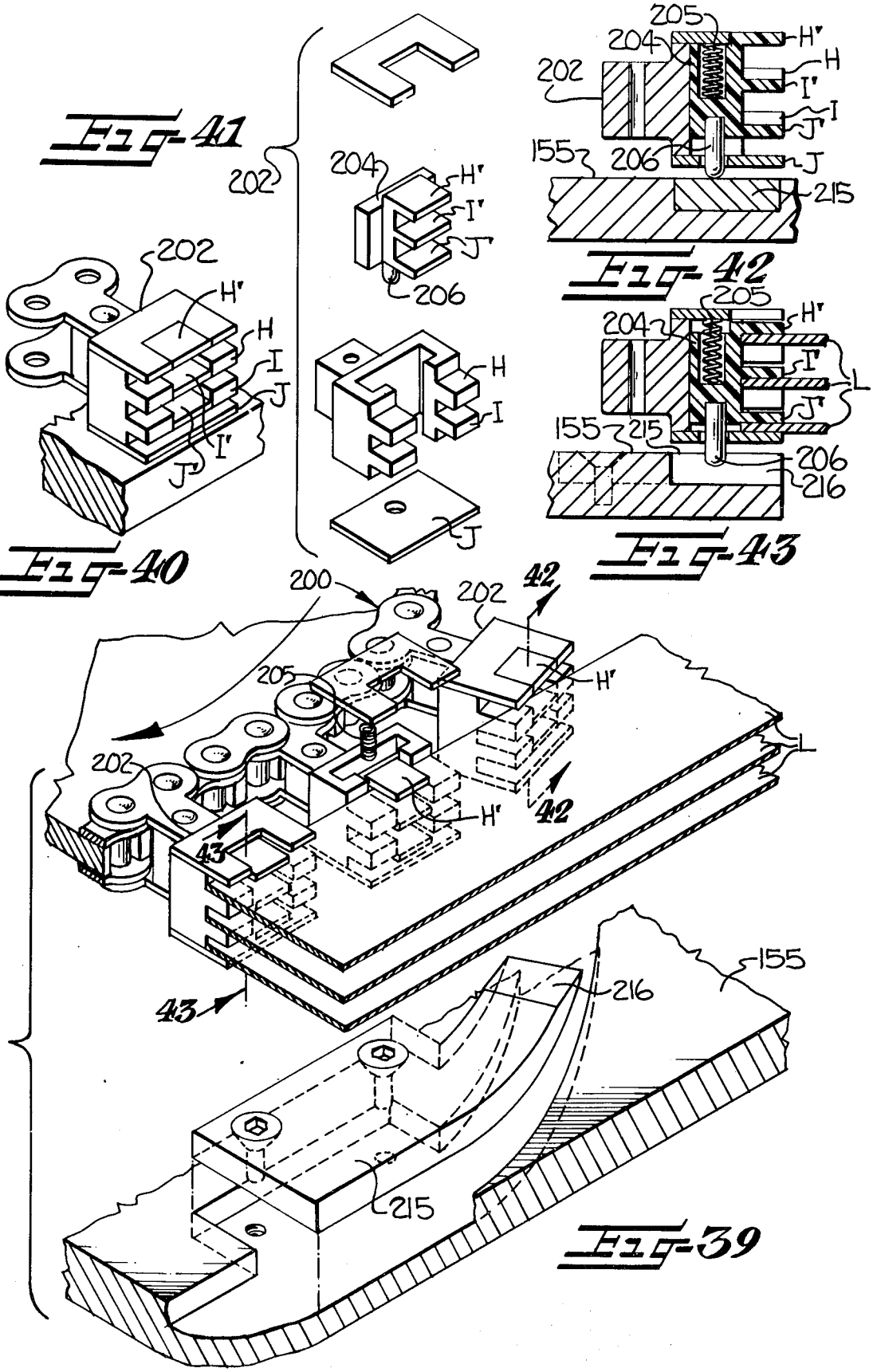
FIG. 39 is an enlarged partially exploded fragmentary view taken looking in the general direction of the arrow 39 in FIG. 9 and particularly illustrating the longitudinal partition gripping and advancing conveyor means for aiding in moving the longitudinal partition strips forwardly along the converging cam means and the partition strip grooved trackways.
FIG. 40 is a fragmentary view of one of the gripper units shown in FIG. 39, and wherein the grippers are shown in open or strip-releasing position.
FIG. 41 is an exploded perspective view of the various components of one of the gripper units.
FIG. 42 is a fragmentary vertical sectional view taken substantially along line 42—42 in FIG. 39, and showing the corresponding gripper unit in open position.
FIG. 43 is a fragmentary vertical sectional view taken substantially along line 43—43 in FIG. 39, being similar to FIG. 42, but showing the gripper unit closed in gripping or partition-clamping position.

As best shown in FIGS. 42 and 43, each movable gripper member 204 is provided with a follower element 206 projecting downwardly therefrom through the bottom wall or jaw J of the corresponding gripper body. The position of chain 201 above platform 155 is such that the followers 206 may be free of or may barely touch the platform 155 throughout the major portion of their travel; i.e., except when the jaws H', I', J', must be opened for receiving or releasing longitudinal strips L in gripper units 202. In this regard, it should be noted that, if desired, the jaws H', I', J' of each successive gripper unit 202 may occupy either the raised position of FIG. 42 or the lowered position of FIG. 43 whenever any of the gripper units is not moving along the inner run of the endless sprocket chain 201.

For the purpose of this disclosure, it will be assumed that the jaws H', I', J' occupy the lowered or clamping position of FIG. 43 as they move along with the outer run of chain 201. Accordingly, in order to open or raise the jaws H', I', J' of each successive gripper unit 202 as it approaches the inner flight or run of the sprocket chain 201 at the rear portion of the gripping and advancing conveyor means 200 shown in the central portion of FIG. 9, for example, a medial portion of the platform 155 adjacent the path of travel of the longitudinal partition strips L is provided with a cam member 215 (FIG. 39) therein which is provided with an upwardly projecting cam surface 216 thereon adjacent slot 155*a* and over which each successive follower 206 moves as the respective gripper units 202 move into the inner flight or run of the endless sprocket chain 201.

This cam surface 216 is so arranged as to be engaged by and thereby raise each successive follower 206 so that the slots above the respective jaws H, I, J are sufficiently opened to freely receive therein outer edge portions of successive groups of longitudinal partition strips L. Thereupon, each successive follower 206 passes forwardly beyond cam surface 216 (FIGS. 39 and 43), thus permitting the respective gripper units 202 to successively close in engagement with the successive groups of three longitudinal partition strips L as they advance beyond the corresponding delivery means 102 (see FIG. 9). It will be noted that the inner run of the endless sprocket chain 201 extends substantially parallel with the outer surfaces of guide plates 150–153 (FIGS. 13 and 46) so that the gripper units 202 on sprocket chain 201 hold the successive groups of longitudinal partition strips L in the grooved trackways 131–133 while advancing the longitudinal partition strips L along the corresponding partition assembling station.

It is apparent that a cam member similar to the cam member 215 of FIG. 39 is also positioned at the downstream end of the inner run of endless conveyor chain 201 (FIG. 9A) so as to be momentarily engaged by the successive followers 206 for momentarily returning the successive movable gripper members 204 to the open or raised position of FIG. 42 for releasing the corresponding longitudinal partition strips L therefrom. By this time, the corresponding set of transverse and longitudinal partition strips T, L is substantially fully assembled in collapsed condition, whereupon the outer edges of the longitudinal partition strips move into engagement with a guide rail 220 adjustable on platform 155 and spaced from the other guide rail 125 (FIG. 9A) sufficiently to permit the assembled collapsed cell partition assembly to pass therethrough while being confined therebetween so as to properly intermesh the corresponding transverse and longitudinal partition strips T, L as shown in the left-hand portion of FIG. 9A.

It should be noted that, as the longitudinal partition strips L moving along the track or guide member of the partition assembling station are released by the gripper units 202 at the forward portion of the gripping and advancing conveyor means 200 in FIG. 9A, they no longer need to rely upon the corresponding gripper units 202 or the longitudinal-partition-strip-propelling fingers 191*a*–193*a* of the conveyor means 187 for advancing the longitudinal partition strips L forwardly, since the corresponding group of transverse partition strips T then in engagement therewith are being advanced forwardly by the corresponding group of transverse-strip-propelling fingers 171*a*–175*a* (FIGS. 27, 27A and 28) of the transverse-strip conveyor means 170.

Figure 37:
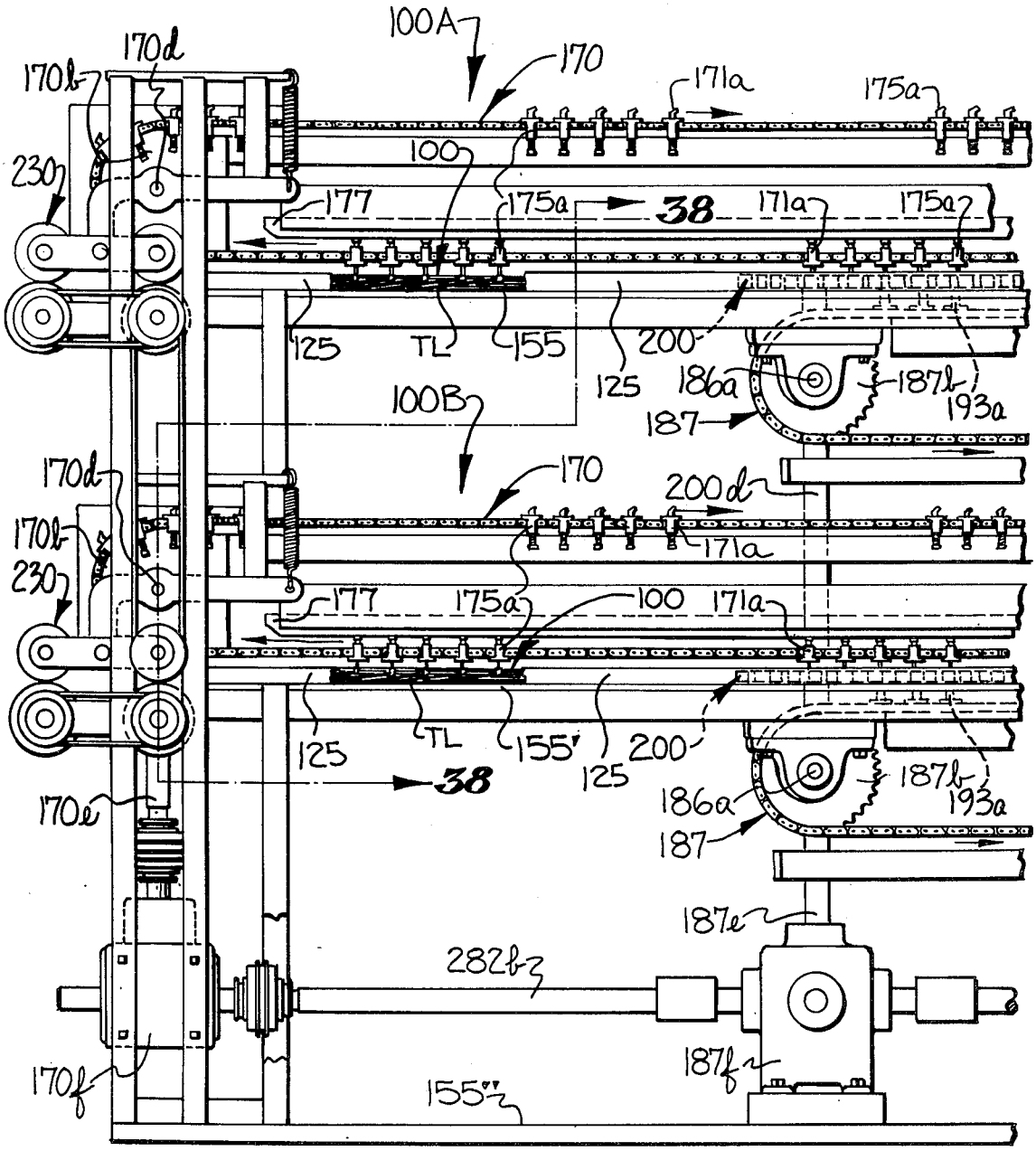
FIG. 37 is an enlarged fragmentary view of the egress end of the apparatus looking generally in the direction of the arrow 37 in the upper left-hand portion of FIG. 25.

As the thus assembled and collapsed groups of transverse and longitudinal partition strips T, L advance toward the forward-most portion of the transverse strip conveyor means 170, it will be observed in FIG. 37 that each successive partition strip assembly may be engaged and discharged from the apparatus by a suitable discharge conveyor means generally designated at 230 in FIG. 37. It is contemplated that the successive partition strip assemblies may be transferred by discharge conveyor means 230 onto a suitable receiving table, or onto a stacking device, or to a suitable packaging apparatus, not shown.

From the foregoing description, it is apparent that assembled, collapsed partition assemblies are formed from the transverse and longitudinal partition strips T', L' along the secondary assembler 100B in the lower production line at the same time as those assembled collapsed cell partition assemblies are being formed of the transverse and longitudinal partition strips T, L along the primary assembler 100A in the upper production line and by the same type of mechanisms as heretofore described, which mechanisms are mounted on the lower platform 155'. Accordingly, the elements involved in the production of the collapsed cell partition assemblies of the secondary transverse and longitudinal partition strips T', L' will not be further described, but will bear the same reference characters as those of the primary production line heretofore described, where applicable, in order to avoid repetitive description.

DETAILED DESCRIPTIONS

Those details necessary to a clear understanding of the various mechanisms heretofore generally described and forming parts of the transverse partition strip fabricating station A, parts of the longitudinal partition strip fabricating station B, and parts of the primary partition assembling station 100A carried by the upper platform 155 will now be described, followed by a more detailed description of the drive mechanisms and adjustable features of the apparatus.

Since the curl and feed control stations 60 (FIG. 1) for the transverse and longitudinal partition strip fabricating stations A, A', B, B' may be of conventional and well-known construction and may be controlled by the photoelectric means 64 in a manner well known in the art, a further description thereof is deemed unnecessary.

I. Partition Strip Cutting Stations Of The Strip Fabricating Stations:

Since the strip cutting stations 70 for the two transverse partition fabricating stations A, A' are of somewhat unitary construction, both of them will be described with particular reference to FIGS. 14–22, 24 and 25, it being understood that the strip cutting stations 70 of the two longitudinal partition fabricating stations B, B' may be constructed in substantially the same manner as the strip cutting stations 70 of the transverse partition fabricating stations A, A'.

Broadly stated, the strip cutting stations 70 each comprise a rotary cutter head comprising a plurality of radially adjustable circularly spaced cutting blades (FIGS. 18A and 18B) which cooperate with a cushion or anvil roll (FIG. 16) for cutting the corresponding paper or fiberboard sheet passing thereover into individual partition strips of desired height. The cutter blades are radially adjustable in unison and in equal amounts so that the distance between the cutting edges thereof may be varied and whereby different heights of partition strips may be cut from the corresponding sheet, it being apparent that relatively short height partition strips will be cut from the sheet when the cutting blades are positioned relatively close to the rotational axis thereof. On the other hand, the further radially outwardly the cutting blades are positioned, the greater the height of partition strips formed by successive engagement of the cutting blades with the anvil roll.

Figure 14:
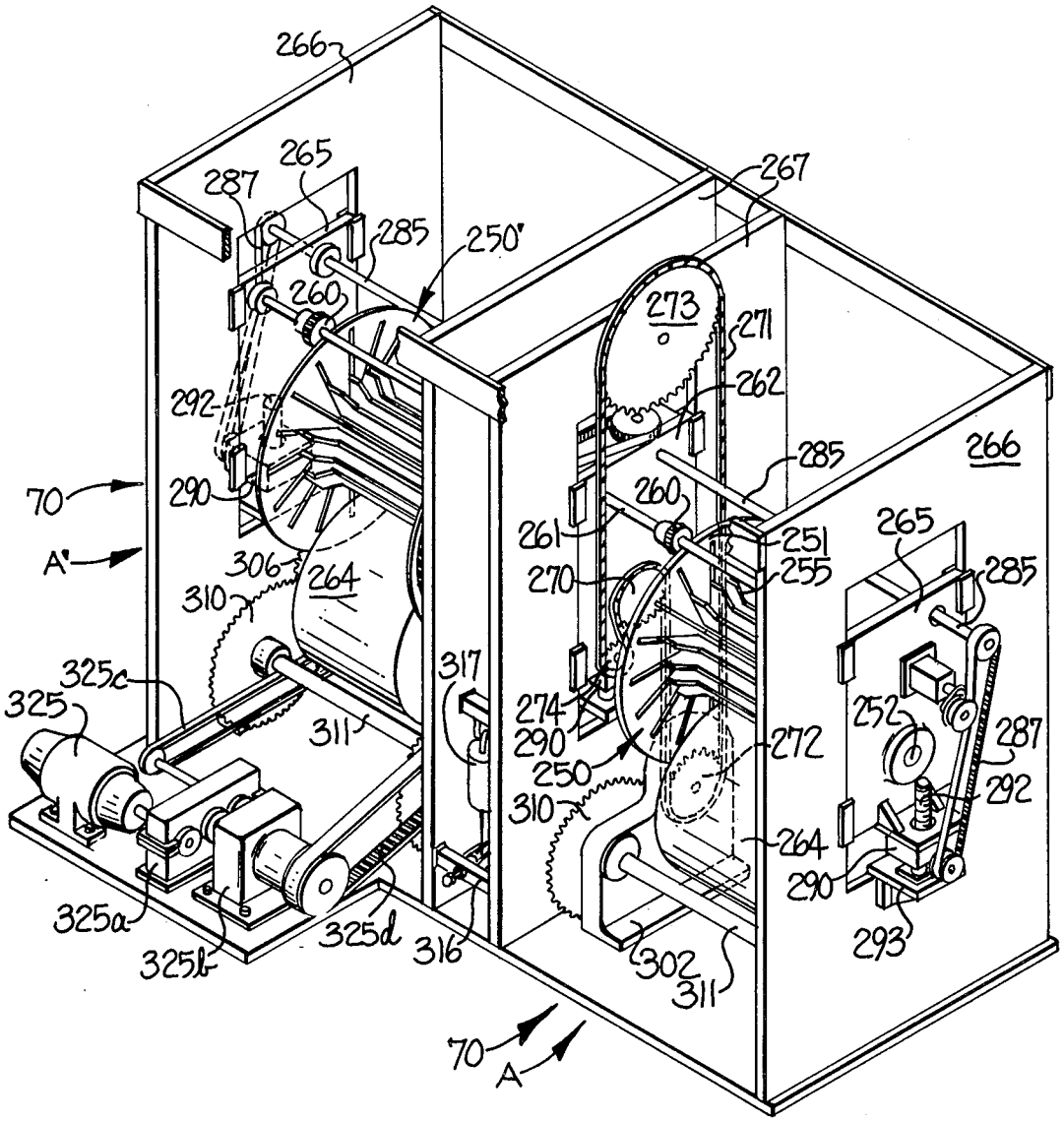
FIG. 14 is an enlarged view of the two partition-strip-cutting stations for cutting the transverse partition strips from sheet material and being shown in the left-hand lower portion of FIG. 1.
Figure 15:
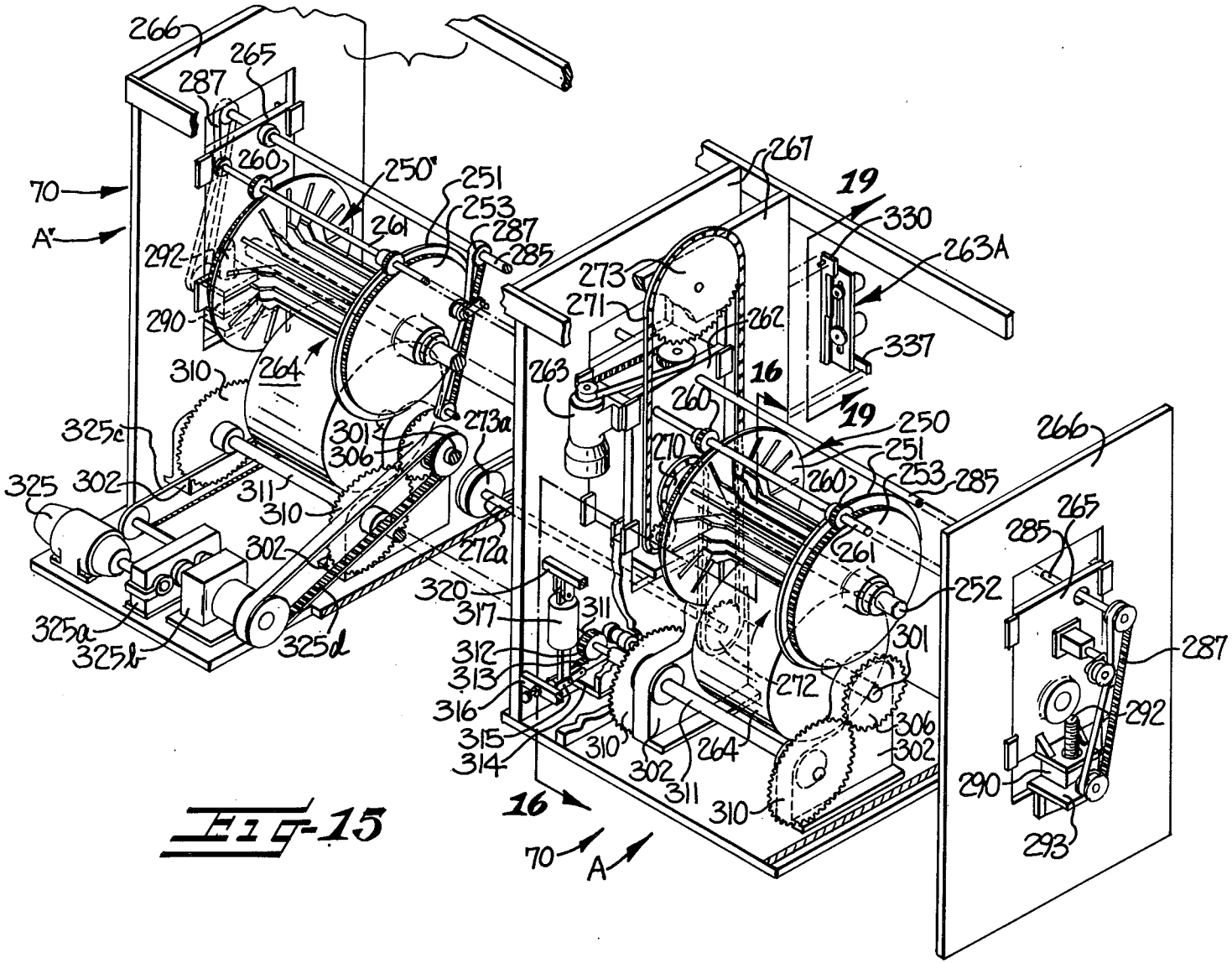
FIG. 15 is a perspective view similar to FIG. 14, but wherein various components are shown in exploded relationship for purposes of clarity.

A more detailed description of the strip cutting stations or means 70 will now be described. Referring now to FIGS. 14 and 15, it will be observed that the rotary cutter heads of the two strip cutting stations 70 there shown are respectively designated at 250, 250', the cutter head 250 being a component of the primary transverse partition strip fabricating station A and the cutter head 250' being a component of the secondary transverse partition strip fabricating station A' (FIG. 1). Referring to FIGS. 14, 15, 16, 18A and 18B, it will be observed that each cutter head 250, 250' comprises a pair of axially spaced rotary end flanges 251 keyed or otherwise suitably secured on a cutter head support shaft 252 common to all four flanges 251 of the two cutter heads 250, 250'. Rotatably mounted on shaft 252, axially outwardly of and in juxtaposed relation to each of the four end flanges 251 is a respective blade adjusting rotor 253 which normally rotates in fixed relation with the end flanges 251 through interconnecting transmission means to be later described.

Each rotary end flange 251 of each cutter head 250, 250' is provided with a plurality of substantially equally circularly spaced radial adjustment slots **251*a* therethrough which facilitate radial adjustment of a plurality of circularly spaced cutting blades 254 extending between the flanges 251 of each cutter head 250, 250'. To this end, each blade 254 is of elongate form and is detachably secured to the outer edge portion of a respective radially adjustable cutter blade carrier 255 having a pair of radial slot followers 255*a* on each end thereof engaging a respective one of the radial slots 251*a* in the respective flange 251. As heretofore indicated, each cutter blade 254 may have a plurality of indentations or notches in its cutting edge so as to form the spurs s at the junctures of successive partition strips, as heretofore described with reference to FIGS. 3 and 7**.

Preferably, there is one of the radially adjustable blade carriers 255 provided for each radial slot **251*a* in the corresponding pair of end flanges 251 of each cutter head 250, 250', although it is to be understood that there may be instances in which it is desirable to omit or remove certain or alternate ones of the cutter blades 254 carried by carriers 255 to facilitate the cutting of unusually high cell partition strips from the corresponding sheet 51. For purposes of clarity in FIGS. 16 and 18B some blade carriers 255 are omitted or removed so that pairs of radial slot followers 255*a* on each end of each carrier 255, as well as respective pairs of toroidal groove followers 255*b***, may be clearly illustrated.

Figures 16, 17, 18:
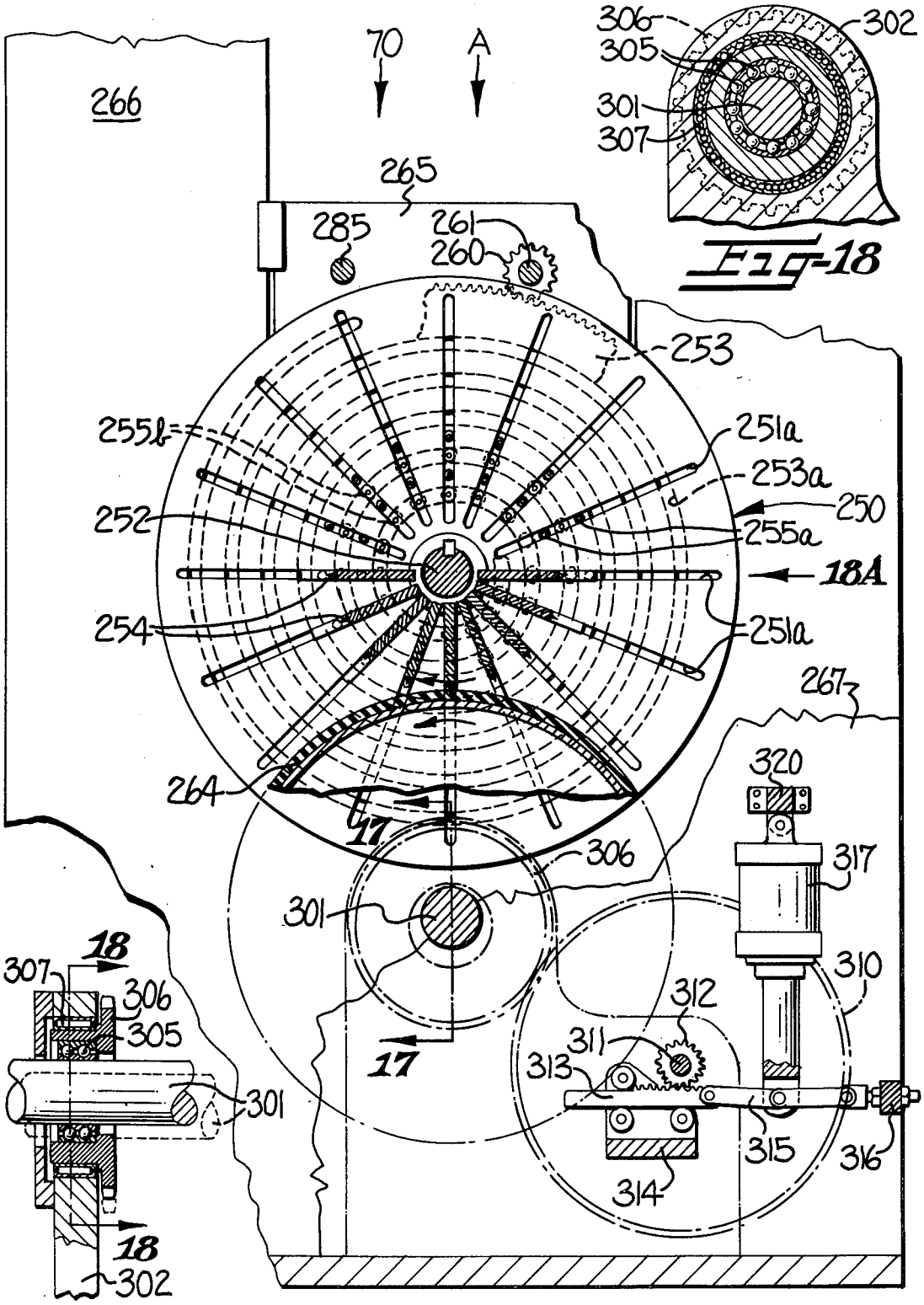
FIG. 16 is an enlarged fragmentary vertical sectional view taken substantially along line 16—16 in FIG. 15 and showing means for radially adjusting the strip cutting blades for forming strips of different widths.
FIG. 17 is a fragmentary sectional view taken substantially along line 17—17 in FIG. 16.
FIG. 18 is a fragmentary vertical sectional view taken substantially along line 18—18 in FIG. 17.

It is apparent that there are two of the toroidal groove followers **255*b* secured to, or otherwise suitably mounted on, each end of each blade carrier 255. As shown in FIGS. 16 and 18B, the face of each blade adjusting rotor 253 proximal to the respective cutter head end flange 251 has a convolute, uniform, toroidal cam groove 253*a* formed therein and generated about the axis thereof. The two followers 255*b* on the corresponding end of each respective blade carrier 255 engage two adjacent convolutions of the toroidal cam groove 253*a* so that, upon rotating the blade adjusting rotors 253 relative to the end flanges 251, it can be appreciated that all of the blade carriers 255 of the two cutter heads 250, 250' are uniformly and unitarily radially adjusted relative to the common support shaft 252 and the cutter head end flanges 251**.

Figure 18A:
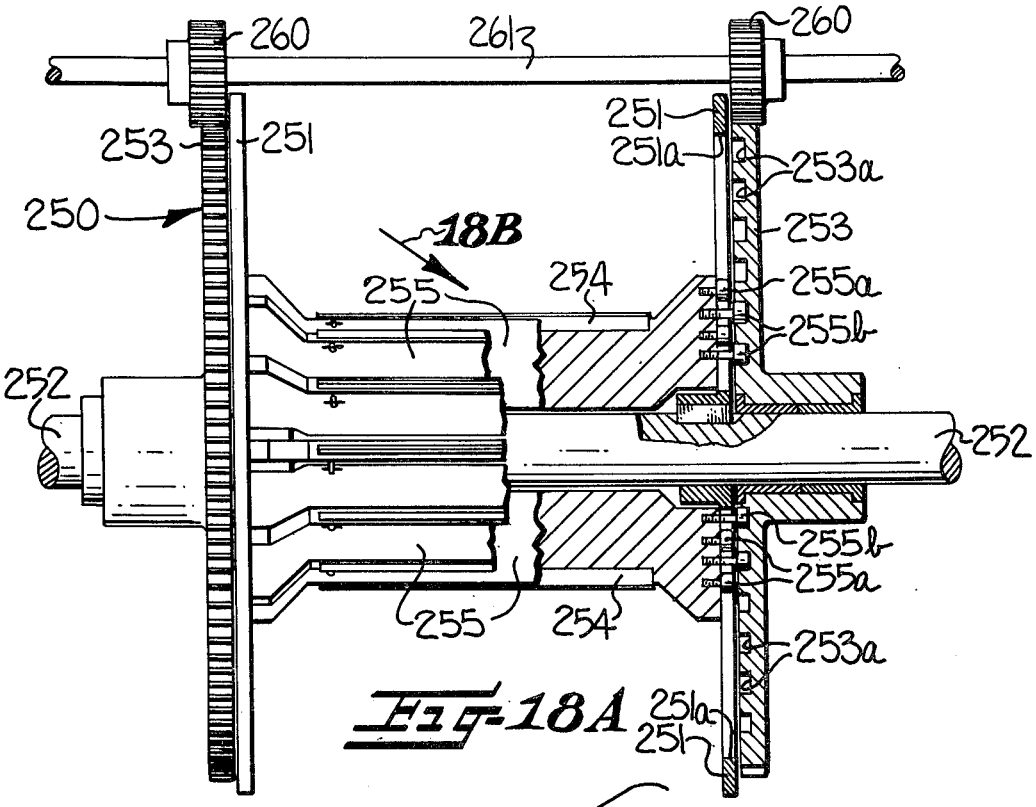
FIG. 18A is a view of the cutter head of one of the two strip cutting stations 70 looking generally in the direction of the arrow 18A in FIG. 16, but showing a portion of the cutter head in elevation and showing another portion of the cutter head cut away along the axis thereof.
Figure 18B:
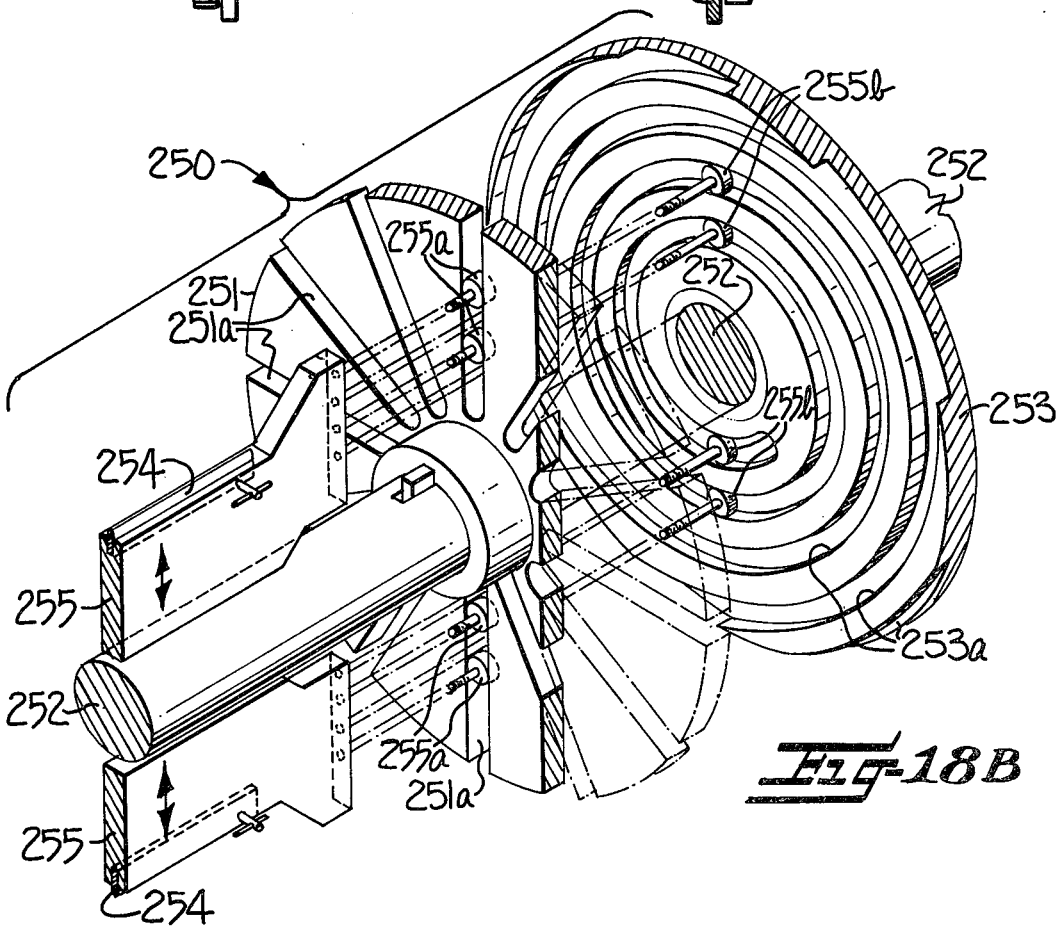
FIG. 18B is a partially exploded perspective view taken looking generally in the direction of the arrow 18B in FIG. 18A and particularly illustrating means for radially adjusting the cutting blades relative to the rotational axis thereof for forming different widths of partition strips.

To further facilitate radial adjustment of blades 254 and blade carriers 255, it will be observed in FIGS. 15, 16 and 18A that at least the peripheral portion of each blade adjusting rotor takes the form of a spur gear engaged by a respective pinion 260; all four of the pinions 260 being mounted on a common rotor-driving or blade-adjusting shaft 261. The blade adjusting shaft 261 also is common to both cutter heads 250, 250′ (FIGS. 14 and 15), and the medial portion of shaft 261 extends through a vertically adjustable gear box 262 and is driven by suitable differential gearing, not shown, within gear box 262. Such gearing is, at times, driven by a manually controlled reversible electric motor 263 mounted on one side of gear box 262.

As will be later explained more in detail, not only does the electric motor 263 drive the shaft 261 to effect radial adjustment of blades 254 and their carriers 255, it also effects simultaneous proportional substantially vertical adjustment to the cutter heads 250, 250′ relative to respective cooperating cushion or anvil rolls 264 therebeneath and over which the respective sheets 51 are moved during operation of the apparatus. Additionally, operation of the manually controlled electric motor 263 controls a programming sensor generally designated at 263A (FIGS. 15 and 19–21), which is instrumental in effecting adjustment of various other mechanisms of the apparatus so as to accommodate the change being effected in the height of the partition strips T, T′, L, L′ as effected by the extent of operation of motor 263 by the operator.

Adjustment of such various other mechanisms includes displacement adjustment of the discharge ends of the transverse partition strip delivery means 101 (FIGS. 22, 24 and 26) relative to the respective sets of grooved trackways 121–123 (FIG. 4) of the partition strip assembling stations 100A, 100B, adjusting the surface speed of the platen or anvil rolls of the strip cutting stations, and adjusting the cam plates 141–143 (FIGS. 9, 9A, 10, 13, 44, 45 and 46) longitudinally relative to the trackway guide plates 150–153 and the adjacent partition strip conveyor means, for example. In this regard, it should be noted that longitudinal adjustment of the cam plates 141–143 does not effect any change in the respective distances from the transverse partition strip-propelling fingers 161, 171*a*, 172*a*, 173*a*, 174*a*, 175*a* (FIGS. 9, 9A and 27) to the inner extremities of the transverse partition trackways 120–123 (FIG. 13). However, such longitudinal adjustment of the cam plates 141–143 correctively changes the distance from the discharge ends of the longitudinal partition strip delivery means 102, 102′, to the adjacent cam surfaces 135–137 as well as effecting a corresponding corrective adjustment of the distances from the paths of travel of the grippers 202 of the advancing conveyor means 200 (FIGS. 9, 9A and 39) to the converging cam surfaces 135–137.

Returning now to the detailed description of the strip cutting stations 70, it will be observed in FIGS. 14 and 15 that, not only are the medial portions of cutter head support shaft 252 and blade adjusting shaft 261 journaled or rotatably mounted in gear box 262, but they are also journaled in outboard support members 265 mounted for vertical movement in outboard distal end frame members 266 spaced outwardly from respective inner or inboard frame members 267 in which gear box 262 is guided for substantially vertical movement. The inner frame members 267 are spaced laterally apart from each other to accommodate therebetween electric motor 263 and the programming sensor 263A to be later described.

In order to rotate cutter head support shaft 252 for rotating cutter heads 250, 250′, and to also permit vertical movement of cutter heads 250, 250′ with support shaft 252 whenever the blades 254 and their carriers 255 are to be radially adjusted to increase or decrease the height of the partition strips to be formed by the rotary cutter heads 250, 250′, a sprocket wheel 270, fixed on a medial portion of cutter head support shaft 252, is engaged by an endless sprocket chain 271 (FIGS. 14, 15 and 25) which extends partially around sprocket wheel 270.

Sprocket chain 271 extends downwardly from the downstream or forward side portion of sprocket wheel 270 and then passes beneath and about halfway around a driving sprocket wheel 272. From sprocket wheel 272, the downstream run of sprocket chain 271 extends upwardly and then over and about halfway around a relatively large idler sprocket wheel 273 rotatably mounted on that inner frame member 267 adjacent cutter head 250. The upstream substantially vertical run of sprocket chain 271 extends downwardly from idler sprocket wheel 273 and then passes beneath and about halfway around a relatively small idler sprocket wheel 274 suitably rotatably mounted on a lower portion of gear box 262. It is thus seen that the arrangement of the sprocket wheels 270 and 272–274 insures that the desired tension may be maintained in sprocket chain 271 during any vertical movement of gear box 262 with the cutter heads 250, 250′ and the outboard vertically movable support members 265 relative to frame members 266, 267.

Figure 48:
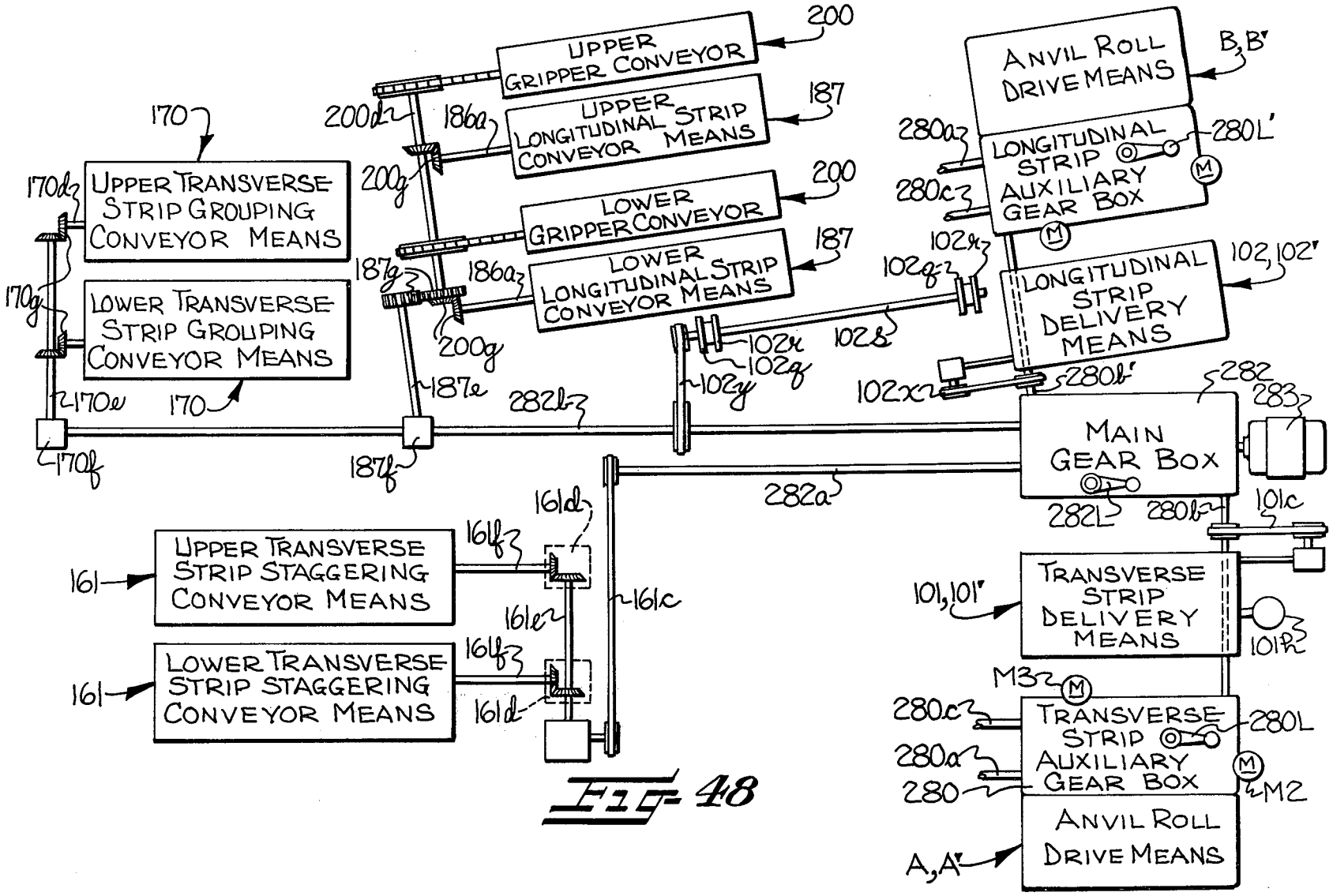
FIG. 48 is a schematic diagram of the drive mechanisms for the partition strip assembling stations.
Figure 49:
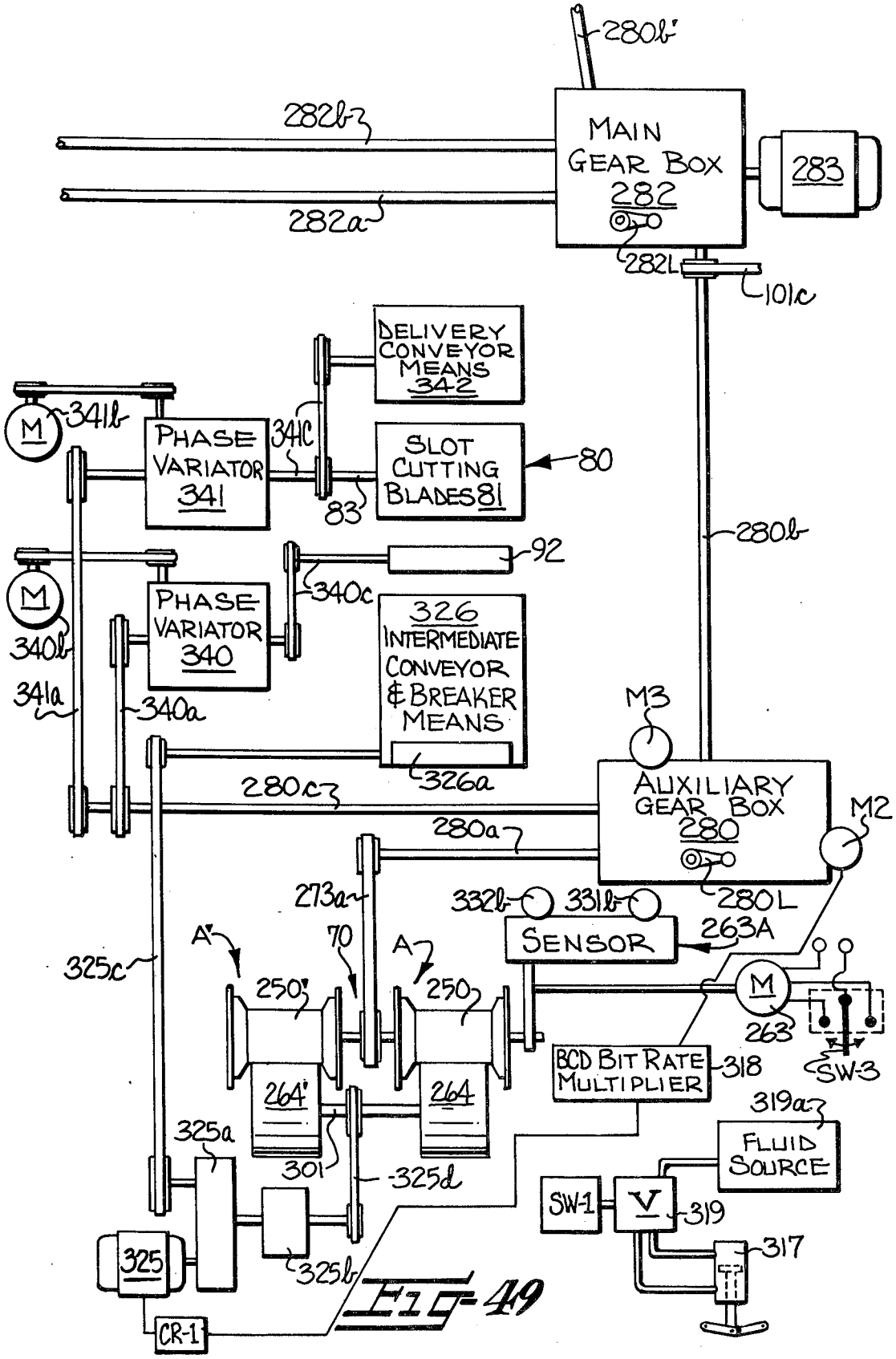
FIG. 49 is a schematic diagram showing particular elements of the drive mechanisms for the partition strip fabricating stations at one side of the apparatus.

It should be noted that the lower sprocket wheel 272 is fixed on a shaft 272*a* (FIGS. 15 and 25) which extends through and is journaled in the two inner upright frame members 267. Suitable belt and pulley connections 273*a* serve for drivingly connecting an output shaft 280*a* (FIGS. 25 and 49) of a variable speed auxiliary gear box 280 to the shaft 272*a*. The variable speed gear box 280 has an input shaft 280*b* driven by suitable connections with a main gear box 282 whose input is driven by any suitable motive means such as a main electric motor 283 (FIGS. 25, 48 and 49). A similar variable speed auxiliary gear box 280′ is provided for driving the strip cutting stations 70 of the longitudinal partition fabricating stations B, B′. A shaft 280*b*′ connects one output portion of main gear box 282 to the input portion of auxiliary gear box 280′.

As heretofore stated, the cutter heads 250, 250′ of FIGS. 14 and 15 are raised and lowered in accordance with the radial adjustment of the blade carriers 255 (FIGS. 16, 18A and 18B), as effected for cutting various widths of cell partition strips. The means for effecting such vertical movement comprises a substantially horizontally disposed elevator shaft or jack shaft 285 (FIGS. 14 and 15) common to both cutter heads 250, 250′ of FIG. 15 and also journaled in gear box 262 and the outboard vertically movable members 265. The shaft 285 is driven by suitable connections within gear housing 262 connecting the same to electric motor 263 (FIG. 15).

Opposite end portions and a medial portion of shaft 285 are each drivingly connected, by suitable respective belt and pulley connections 287 (FIG. 15), to the input portions of respective elevator jacks 290 which may be of conventional or other construction and may contain suitable internally threaded means, not shown, for engagement with respective threaded posts or jack screws 292. The housings of the elevator jacks 290 are suitably secured to the lower portions of the gear box 262, on the one hand, and the vertically movable outboard support plates 265 on the other hand.

The lower ends of the threaded posts 292 are supported upon suitable brackets 293 fixed to the respective upright frame members or plates 266, 267. It is thus seen that, upon motor 263 (FIG. 15) being energized, both shafts 261 and 285 are driven so that, as the blade carriers 255 are being radially adjusted in the manner heretofore described, the elevator jacks 290 are also driven to raise or lower gear box 262, outboard support members 265, shaft 252 and both cutter heads 250, 250' proportionally in accordance with the direction in which the blade carriers 255 of FIGS. 16 and 18B are being adjusted along the radial slots 251*a* in the respective flanges 251.

The removable longitudinally extending blades 254 on the radially outer edge portions of the blade carriers 255 cooperate with cushion or anvil roll 264, which may be rubber-covered and is positioned below each respective cutter head 250, 250'. The two cushion or anvil rolls 264, which may also be termed as platen rolls (FIGS. 14, 15 and 16), are fixedly mounted on a common shaft 301 which loosely extends through the intermediate frame members 267 and is mounted in a plurality of special bearings (FIGS. 16–18) carried by respective bearing stands 302, there being one of the bearing stands adjacent each side of each cushion roll 264 in FIGS. 14 and 15.

The aforementioned special bearings for rotatably supporting the shaft 301 in each of the bearing stands 302 may be identical to each other, one of them being shown in FIGS. 17 and 18, wherein it will be observed than an anti-friction bearing 305 has the corresponding portion of shaft 301 mounted therein. The anti-friction bearing 305 is eccentrically mounted in an eccentric bore in the hub of a gear 306 rotatably mounted in an outer bearing 307 mounted in the corresponding bearing stand 302.

From the foregoing description, it is apparent that there are four of the gears 306 spaced axially along shaft 301. Each such gear 306 is engaged by a gear 310, and all four of the gears 310 are fixed on a common shaft 311 rotatably mounted in the bearing stands 302. It will be observed in FIGS. 15 and 16 that a medial portion of shaft 311, between frame members 267, has a pinion 312 fixed thereon which is engaged by a rack 313 suitably guided for substantially horizontal movement transversely of shaft 311, as by a guide means 314.

One end of rack 313 (FIG. 16) is connected by a toggle linkage 315, to a fixed frame member 316 secured to and bridging upright inboard frame members 267. A medial portion of toggle linkage 315 is pivotally connected to the movable element of a fluid operated ram 317 whose fixed element is attached to another frame member 320 secured to and extending between frame members 267.

Upon occurrence of any situation requiring that the apparatus be quickly shut down, an emergency button, not shown, may be depressed momentarily to operate the ram 317 to cause the toggle linkage 315 to occupy a broken or articulated position. It is apparent, with reference to FIGS. 16–18, that downward movement of the movable element of ram 317 in FIG. 16 and concurrent articulation of toggle linkage 315, causes rack 313 to move from left to right and thereby impart angular movement to gear 306 about its axis, thereby moving its eccentric hub about shaft 301 and lowering the cushion rolls 264 out of the path of travel of the cutting edges of the blades 254 of the cutter heads 250, 250'. This insures that the blades 254 will not damage the relatively soft or yieldable surfaces of anvil rolls 264 in an emergency situation. After an emergency stop the anvil rolls 264 remain disengaged from blades 254 and the machine cannot be restarted until the anvil rolls 264 are returned to their normal operating position by returning the toggle linkage 315, via ram 317, to the "inline" position illustrated in FIG. 16. As shown in FIG. 49, the flow of fluid pressure from a source 319A into either end of ram 317 may be controlled by an electromagnetic valve means 319 operated by a switch SW-1. In this regard, it is apparent that the return of the toggle linkage 315 to the "inline" position returns the sprocket wheels 306 (FIG. 17), and thus the shaft 301, to the position shown in FIGS. 16, 17 and 18, thus moving the cushion rolls 264 upwardly to the normal operating position thereof for cooperating with the circularly arranged blades 254 of the cutter heads 250, 250' in the manner heretofore described.

As heretofore indicated, the cutter heads 250, 250' are driven through connections with the main motor 283 (FIG. 25). However, to further insure that the blades 254 of the cutter heads 250, 250' will not mutilate the relatively soft or yieldable peripheral surfaces of the cushion rolls 264, a separate motive means, which may take the form of a D.C. electric motor 325 (FIGS. 14, 15, 25 and 49), is provided for driving the two cushion rolls 264 so that the surface speed of the cushion rolls matches that of the cutter heads 250, 250' throughout operation of the machine.

As shown in FIGS. 14, 15, 22, 25 and 49, D.C. motor 325 is drivingly connected to the corresponding pair of cushion rolls 264 by suitable means comprising a gear box 325*a*, to the input of which electric motor 325 is drivingly connected. Gear box 325*a* is provided with a pair of output portions, one of which is drivingly connected to the input of an additional gear box 325*b* and the other of which is drivingly connected, by driving connections 325*c*, to intermediate conveyor means 326 (FIGS. 22, 24 and 49) interposed between each strip cutting station 70 and the respective slot cutting station 80. Suitable belt and pulley connections 325*d* may serve to drivingly connect the output of gear box 325*b* to the shaft 301 on which the cushion rolls 264 are fixedly mounted.

II. Apparatus for Adjustment of Sensor:

As heretofore indicated, radial adjustment of cutter blades 254 of the two cutter heads 250, 250' and corresponding changes in the level of the shaft 252 and the cutter heads 250, 250' relative to the cushion rolls 264 are effected by manual control of reversible electric motor 263 (FIG. 15). It has already been stated that the elevator means or jacks 290 are driven by the electric motor 263 to raise or lower gear box 262 and outboard members 265, as the case may be. It has also been indicated heretofore that the sensor 263A functions in response to the operation of electric motor 263 to effect adjustment of various other mechanisms of the apparatus. Accordingly, certain movable components of the sensor 263A are carried by and are movable with the vertically movable gear box 262 relative to certain other components of the sensor 263A which are carried by the upstanding frame members 267.

Figure 20:
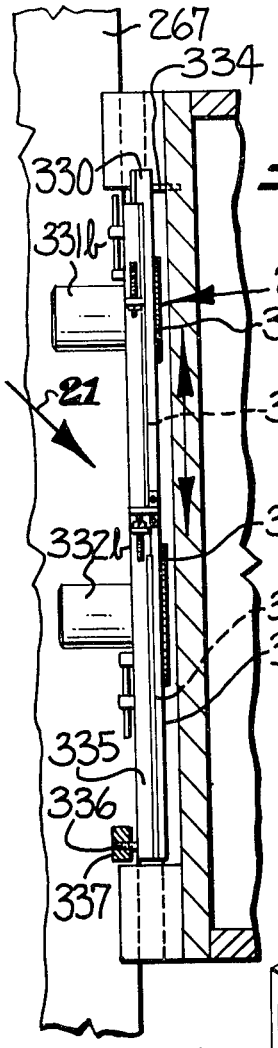
FIG. 20 is a fragmentary vertical sectional view taken substantially along line 20—20 in FIG. 19.
Figure 19:
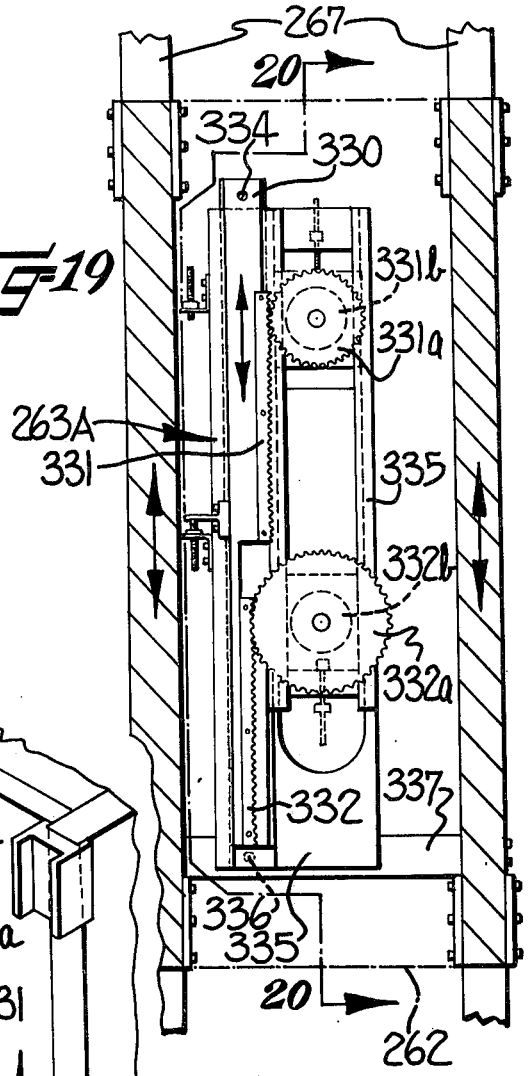
FIG. 19 is an enlarged fragmentary elevation, partially in section, taken substantially along line 19—19 in FIG. 15 and showing a sensing means or servomechanism for synchronizing adjustment of various components of the apparatus during change-over from production of one size or type partition assembly to another.
Figure 21:
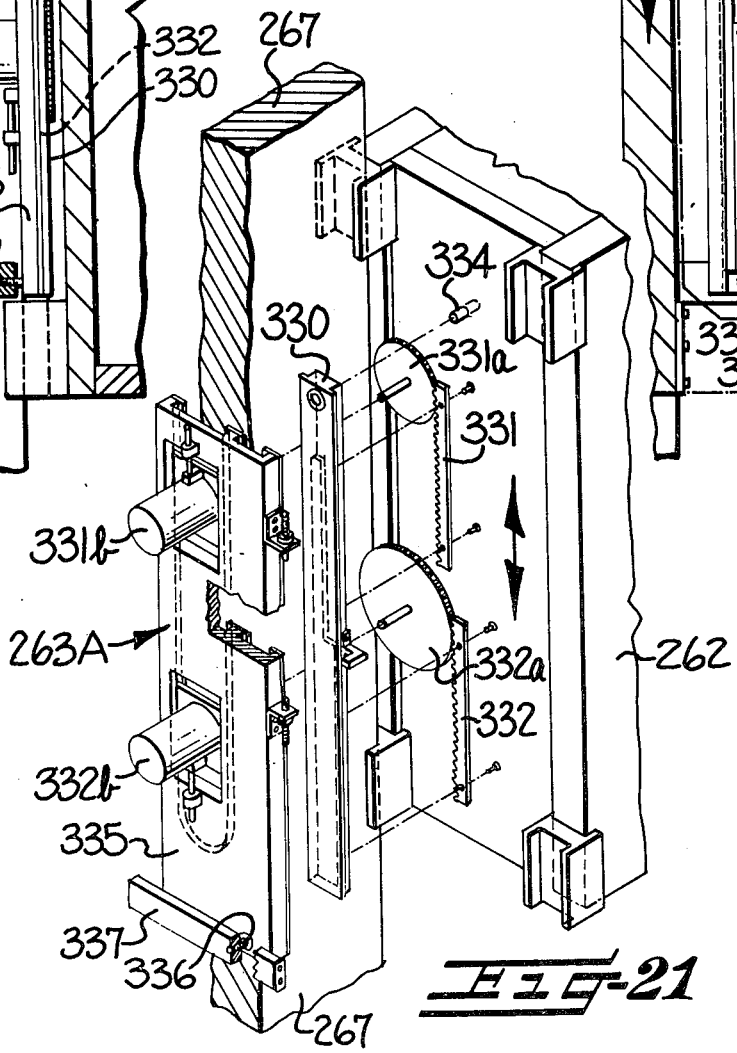
FIG. 21 is a partially exploded schematic perspective view taken looking generally in the direction of the arrow 21 of FIG. 20.
Figure 22:
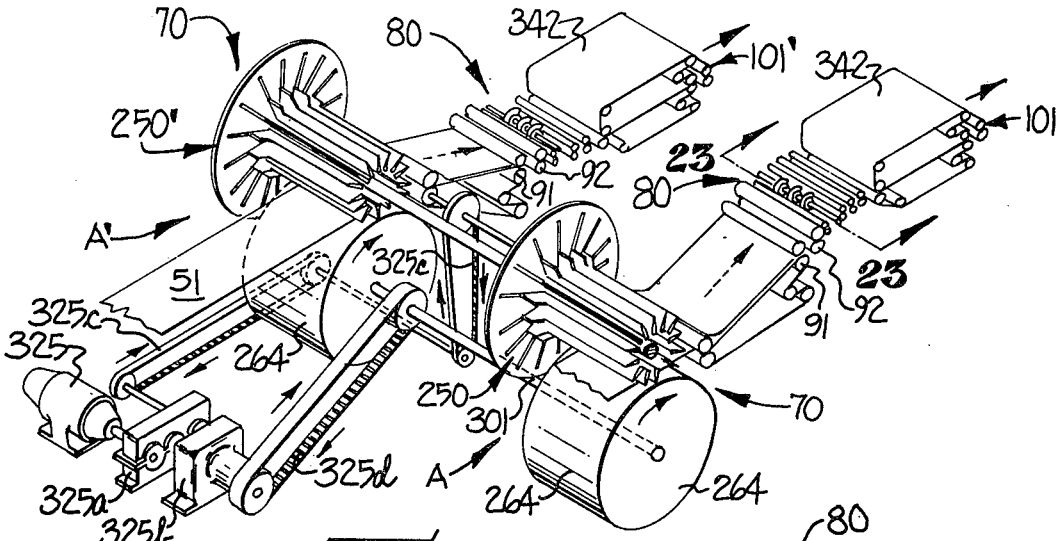
FIG. 22 is an enlarged fragmentary view of the two transverse partition fabricating stations shown in the left-hand portion of FIG. 1, but showing various parts thereof more in detail.

It will be observed in FIGS. 19, 20 and 21 that the sensor 263A comprises a vertically movable elongate slide member 330 having a pair of vertically arranged racks 331, 332 thereon and which is suspended at its upper portion, as at 334, on one side wall of the housing of gear box 262. The vertically movable slide member 330 is guided for vertical sliding movement in an upstanding frame member 335 whose lower portion is pivotally connected, as at 336, to a stationary frame member 337 extending between and being suitably secured to the middle upright frame members 267 between the two cutter heads 250, 250'.

The racks 331, 332 engage respective pinions or gears **331*a*, 332*a* whose diameters differ with respect to each other so that the gears 331*a*, 332*a* are rotated through different relative angular distances during any given vertical movement of gear box 262, slide member 330 and racks 331, 332. As shown in FIGS. 19, 20 and 21, the gears 331*a*, 332*a* are mounted on the shafts of respective absolute position encoders 331*b*, 332*b* mounted for relative vertical adjustment (and for adjustment relative to the respective racks 331, 332) in the upright frame member 335. It is apparent that rotation of the gears 331*a*, 332*a* by racks 331, 332 changes the angular positions of the rotors of encoders 331*b*, 332*b*** relative to the stators thereof.

It is to be noted that the absolute position encoder **331*b* may be used only for displaying, at a suitable location, the height or width of the partition strip being cut by the cutterheads 250, 250'. The position encoder 331*b* may have a ten-bit binary coded output, for example. The sensor master position encoder 332*b* may be of a type having a three-digit binary coded decimal (twelve data lines total) output, and may be capable of representing numbers from 000 (Base 10) to 999 (Base 10). The output of this sensor master position encoder 332*b* is utilized in conjunction with other devices to match the surface speed of the anvil rolls 264 to the circumferential velocity of the cutter blades 254 of the cutterheads 250, 250'. The output of the encoder 332*b* is transmitted in the form of digital signals to a suitable control unit CR-1 (FIG. 49) which may take the form of a "D.C. drive unit" operatively associated with D.C. motor 325, as will be later described further herein, to cause the surface speed of the anvil rolls 264 to precisely equal the circumferential velocity of the partition cutter blades 254. The D.C. drive unit may be housed in the same cabinet as an "operational multiplier" 318 (FIG. 49**) whose function will be later described. The operational multiplier is known generally as a "BCD bit rate multiplier".

Since the structural details of the various operating mechanisms downstream of the cutting stations 70 of the partition strip fabricating stations A, A', B, B' are quite closely inter-related with the drive mechanisms, a description of the drive mechanisms will now be given along with such structural details as are deemed necessary to a clear understanding of the apparatus.

III. Apparatus Drive And Adjustment Mechanisms:

The strip cutter heads 250, 250' (FIGS. 14–18, 18A and 18B) are driven at selected speeds determined by manually adjusting a control lever 282L on the main drive gear box 282 and/or manually adjusting control levers 280L, 280L' on the respective auxiliary gear boxes 280, 280' (FIGS. 25 and 48) at opposite sides of the apparatus.

As heretofore indicated, the cushion or anvil rolls 264 (FIGS. 14–16) associated with the strip cutter heads 250, 250' at each side of the machine are driven by respective variable speed D.C. motors 325, which variable speed motors are also drivingly connected to the intermediate conveyor and breaker means 326 (FIGS. 1, 22, 24 and 49) which serve to draw the interconnected partition strips from the corresponding cutter heads 250, 250' and to deliver such interconnected partition strips through the nips of the respective rear detaching rolls 91 to the respective pairs of front detaching rolls 92.

In addition to the output shaft **280*a*, each auxiliary gear box 280, 280' has an output shaft 280*c* extending therefrom (FIGS. 25, 30, 48 and 49). The speeds of the output shafts 280*a*, 280*c* are selectively controlled by manually operable control levers 280L, 280L'. A pulse generator M2 is electrically connected to the sensor 263A, and whose armature is rotated in accordance with variations in the positions of the racks 331, 332 relative to the encoders 331*b*, 332*b* for effecting corresponding changes in the the motor 325 for varying the surface speed of the anvil rolls 264. It is to be noted that the pulse generator has an output frequency which is proportional to the velocity or rpm of shaft 252 (FIGS. 18*a* and 25) on which the cutterheads 250, 250' are mounted, and which shaft 252 is driven by the output shaft 280*a* of the respective auxiliary gear box 280. Gear boxes 280, 280' have a differential to which motor M3 is connected. When it is energized it causes a phase shift between the input and output shafts 280*a*, 280*c* of gear boxes 280**. This allows shifting of the phase of the partition strips being fabricated with relationship to the assembler grooves and slots.

A speed ratio is obtained from the absolute position encoder **332*b* (FIGS. 19–21) whose output is dependent on the ratio of the knife roll diameter, effected by the position of the radially adjustable blades 254, and the outside diameter of the anvil rolls 264. The master speed reference and the speed ratio are fed to the "BCD bit rate multiplier" 318 (FIG. 49), and the output of the multiplier 318 is coupled to the input of the D.C. drive CR-1 (FIG. 49) which then controls the speed of the D.C. motor 325 sufficiently to cause the surface speed of the corresponding anvil rolls 264 to match or equal the circumferential velocity of the cutter blades 254**.

Figure 24:
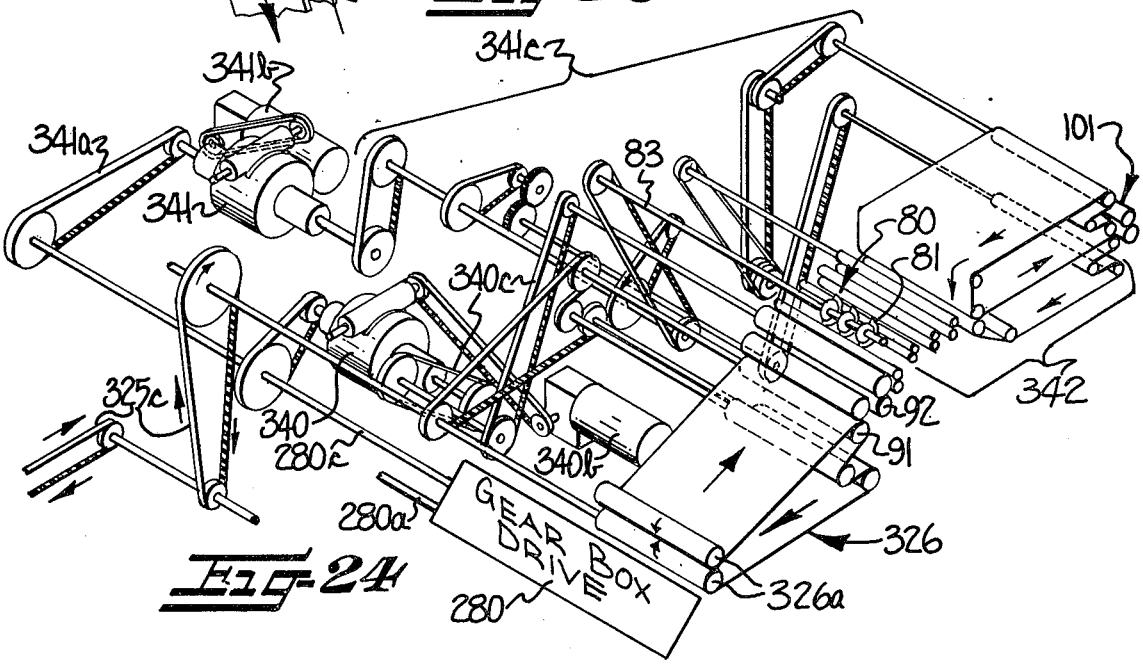
FIG. 24 is a schematic perspective view particularly illustrating suitable drive mechanism for advancing the substantially cut transverse partition strips from a primary strip-cutting station through the respective slot cutting station and then to the flap-offsetting means of FIGS. 3, 4 and 5, for example.

As best shown in FIGS. 24 and 49, the second output shaft **280*c* of each auxiliary gear box 280, 280' has driving connections 340*a*, 341*a* drivingly connecting the output shaft 280*c* to respective phase shift variators 340, 341 (planetary or differential units) whose angular positions or phase positions are controlled by respective electric motors 340*b*, 341*b* electrically connected in parallel circuit to the sensor 263A (FIGS. 19–21). The output of phase shift variators 340, 341 comprise driving connections 340*c*, 341*c*. The driving connections 340*c* serve to drivingly connect the output side of phase shift variator 340 to the front detaching rolls 92 heretofore described, and the driving connections 341*c* serve to drivingly connect the output side of the phase shift variator 341 to the shaft 83*b* (FIGS. 23, 24 and 49) coupled to the shaft 83 on which the segmental cutters 81 of the respective slot cutting stations 80 are adjustably secured. By referring to FIG. 23, it will be observed that the cutter driving shaft 83*b* there shown is geared to the shaft 84*a* coupled to shaft 84 on which the respective group of grooved rollers or rotary dies 82** are fixedly mounted.

Figure 26:
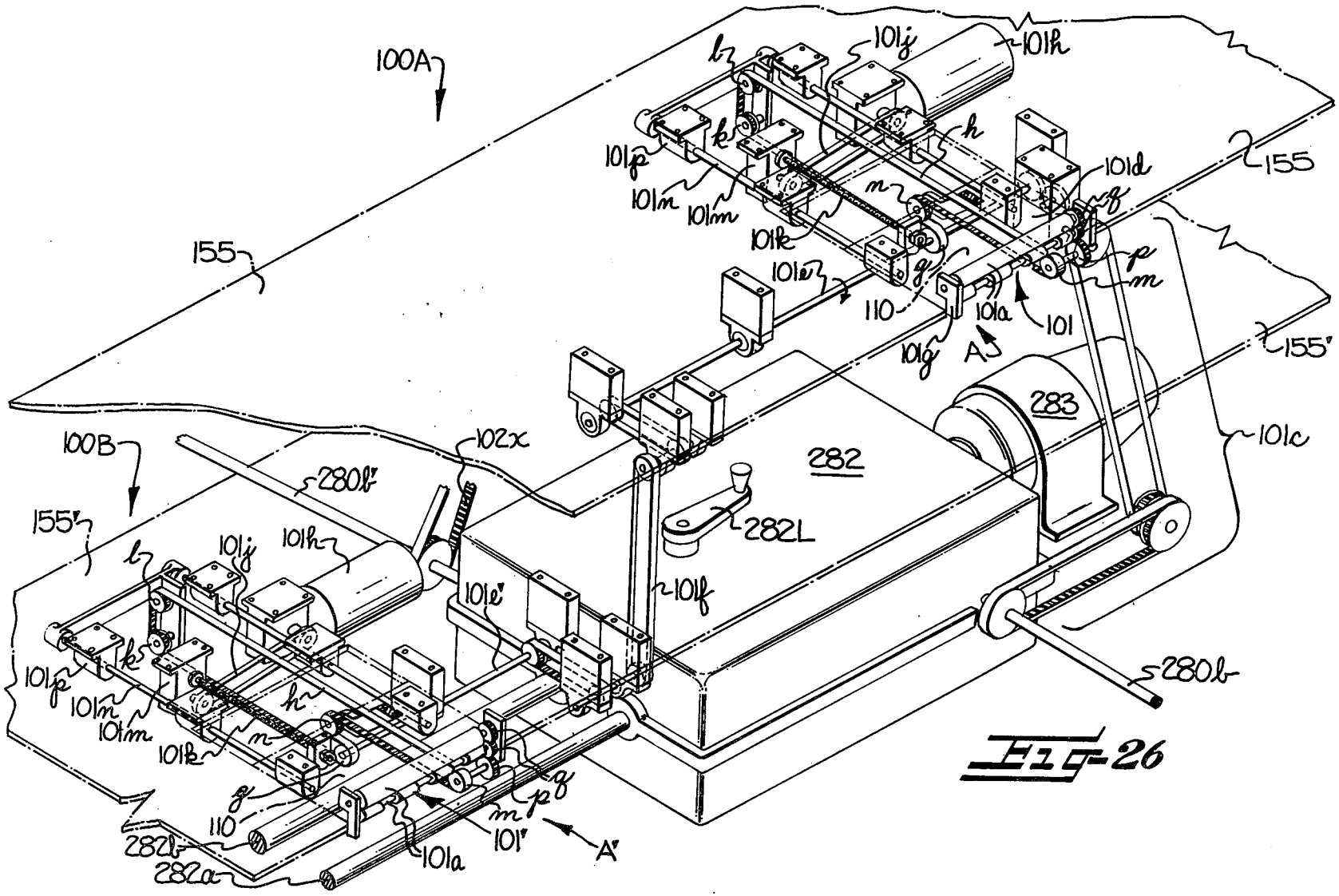
FIG. 26 is an enlarged fragmentary view looking generally in the direction of the arrow 26 of FIG. 1 and showing means for driving transverse-partition-delivery-rolls and for adjusting the same toward and away from the partition-strip-grooved-trackways.
Figure 30:
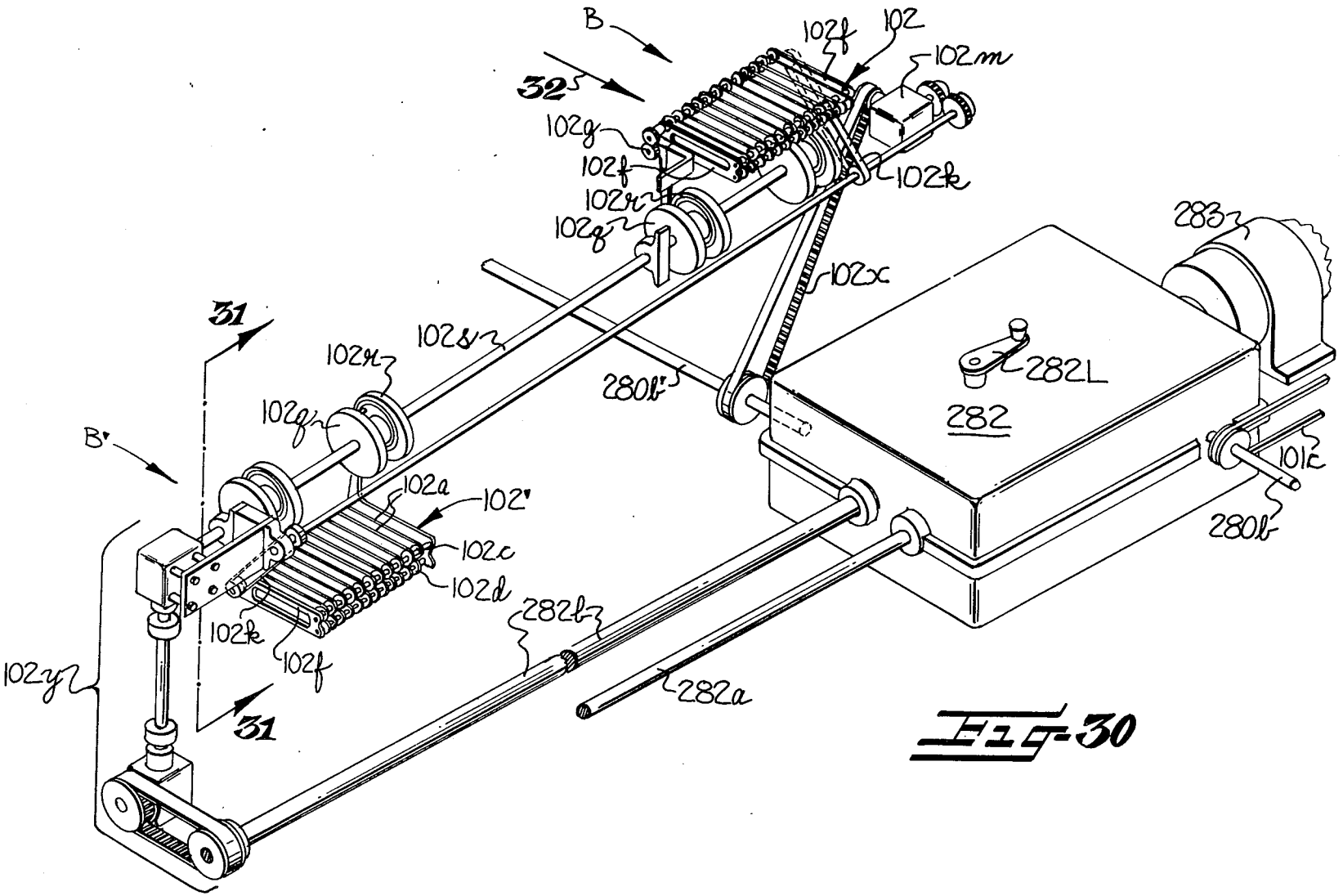
FIG. 30 is a schematic illustration of delivery mechanism for the longitudinal partition strip fabricating stations B, B′ in the region of the arrow 30 in the central portion of FIG. 1.

The driving connections **341*c* also serve to drivingly connect the output of each respective phase shift variator 341 (FIG. 24) to a partition strip transfer conveyor means 342, which cooperates with and may serve as part of the respective delivery and positioning means 101, 101' for the transverse partition strips T, T' and the delivery and positioning means 102, 102' for the respective longitudinal partition strips L, L' (see FIGS. 26 and 30**, respectively).

It is to be noted that any changes in the output speed of the anvil roll drive motor 325 (FIG. 5) effected by the sensor 263A coincident with any change effected in the radial position of the cutter blades 254 (FIG. 16) at each strip cutting station 70, is reflected in a change in the angular positions of the rolls **92, 326*a* of the intermediate conveyor means 326. More specifically, with particular reference to FIG. 24, assuming that element 341 is a differential mechanism whose input and output shafts are normally positioned in direct in-phase relationship, such as a 1 to 2 ratio, with motor 341*b* normally occupying an "off" position, when motor 341*b* is energized, there is a phase shift between the input and output shafts of phase shift variator 341, which changes the angular position of the slot cutter blades 81 (FIG. 23) with respect to the edge of the corresponding partition strip at the instant that the strip enters into the respective slot cutting station 80. Elements 340 and 340*b* have essentially the same effect on the detaching rolls 92 as do elements 341, 341*b* on cutter blades 81**.

It is apparent that changes in the angular position or phase of cutter blades 81 changes the length of the slots N formed by such blades. Of course, it is to be understood that, during any radial adjustment of the cutting blades 254 (FIG. 16), with consequent concurrent vertical adjustment of the racks 331, 332 (FIGS. 19–21) relative to the encoders **331*b*, 332*b* and concurrent with consequent changes in the phased relationship of various components of the apparatus, it is apparent that the apparatus may be operating; e.g., the main motor 283** should be operating.

An explanation of the manner in which the driving relationship between the end flanges 251 and the blade adjusting rotors 253 is normally effected will not be given with particular reference to FIGS. 14 through 18B. As heretofore described with particular reference to FIG. 18A, the blade adjusting rotors 253 are, in effect, free to rotate on shaft 252. However, shaft 261 normally drives, through gears 260, the blade adjusting rotors at the same rotational speed as shaft 252. This can be clearly understood when it is realized that shaft 261 passes through the gear box 262 and is geared therein to a differential mechanism, not shown, which is geared to shaft 252. The manually operable reversible motor 263 is also connected to the differential mechanism within gear box 262 and is normally in the unenergized mode. Thus, when motor 263 is energized, a difference in speed occurs between the input and output shafts of the differential mechanism in gear box 262, this having the effect of changing the relative angular positions between the flanges 251 and the blade adjusting rotors 253. Of course, as heretofore indicated, when the rotors 253 rotate with respect to the flanges 251, the cutter blades 254 and blade holders 255 are moved inwardly or outwardly with respect to shaft 252 in accordance with the direction in which reversible motor 263 is operated. With this mechanism, the height of the partition strips being cut can be changed at any time regardless of whether the cutter heads 250, 250' are rotating or are stationary. It will be noted that this also facilitates such height adjustment without loosening any fasteners or other elements in order to effect the height adjustment.

As heretofore indicated, the output shafts **280*b*, 280*b*' on opposite sides of the main gear box 282 shown in the right-hand portion of FIG. 25 and in FIGS. 48 and 49, serve as the input shafts for the respective auxiliary gear boxes 280, 280'. Now, by referring to FIGS. 26 and 32, respectively, it will be observed that said shafts 280*b*, 280*b*' also serve to drive the delivery means 101, 101', 102, 102'. As heretofore indicated, the ouput of gear box 102*m* (FIGS. 30, 32 and 33) is drivingly connected to the conveyor belts 102*a*, 102*b* of the primary and secondary delivery means 102, 102'. Accordingly, it will also be observed in FIGS. 30, 32 and 33 that suitable driving connections 102*x* are provided for transmitting rotation from shaft 280*b*' to the input of gear box 102*m***.

It will be observed in FIGS. 25, 48 and 49 that the main gear box 282 also has a pair of forwardly extending output shafts **282*a*, 282*b* thereon, the former being relatively shorter than the latter. The shaft 282*b* has suitable driving connections 102*y* extending from a medial portion thereof (FIGS. 30 and 48) to the cam shaft 102*s*** for imparting rotation thereto.

With particular reference to FIGS. 25 and 26, drive mechanisms will now be described to clearly explain how the delivery means 101, 101' for the transverse partition strips T, T' are constructed and driven to deliver the transverse partition strips to the openings of the grooved trackways 120–123 of the partition assembling stations 100A, 100B (FIG. 1) at a rate compatible with the rate at which the longitudinal partition strips L, L' are delivered to the slots of the corresponding grooved trackways 131–133 by the delivery means 102, 102'. Also, the description of the delivery means 101, 101' for the transverse partition strips T, T' will explain how the delivery means 101, 101' are adjusted in response to changes in the condition of the sensor 263A (FIGS. 19–21) to accommodate changes in the heights of the partition strips T, T' being produced at the corresponding transverse partition strip fabricating stations A, A'.

At the outset, it should be pointed out that although each of the two phase shift variators 341 (only one of which is shown in FIGS. 24 and 49) is effective to adjust the angular position of the segmental cutters 81 of the respective slot cutting station 80, while also being effective to drive the conveyor means 342 as well as the cutting blades of the respective slot cutting station 80, the rate of movement of the strip engaging surfaces of the conveyor means 342, and the surface speed of the delivery rolls **101*a* of each respective delivery means 101, 101' coincide with each other to effectively transfer the corresponding transverse partition strips T, T' into the openings of the grooved trackways 120–123 of the respective partition assembly stations 100A, 100B**.

As heretofore stated, the delivery means 101, 101' and the delivery means 102, 102' are driven by the respective output shafts **280*b*, 280*b*' extending from main gear box 282. Accordingly, it will be observed in FIGS. 26 and 48 that suitable drive connections 101*c* drivingly connect the shaft 280*b* to a gear box 101*d* (FIG. 26) suitably secured to and depending from platform 155. The output portion of gear box 101*d* is drivingly connected to a jack shaft 101*e* suitably rotatably suspended from platform 155. Driving connections 101*f* drivingly connect the jack shaft 101*e* to a similar jack shaft 101*e*' which is a part of the secondary delivery means 101' and is suspendingly rotatably supported by the secondary platform 155'**.

As observed in FIG. 26, the delivery means 101, 101' are of similar construction and, therefore, only the delivery means 101 will be further described and the delivery means 101' will bear same reference characters as the delivery means 101, where applicable, to avoid repetitive description.

Figure 4:
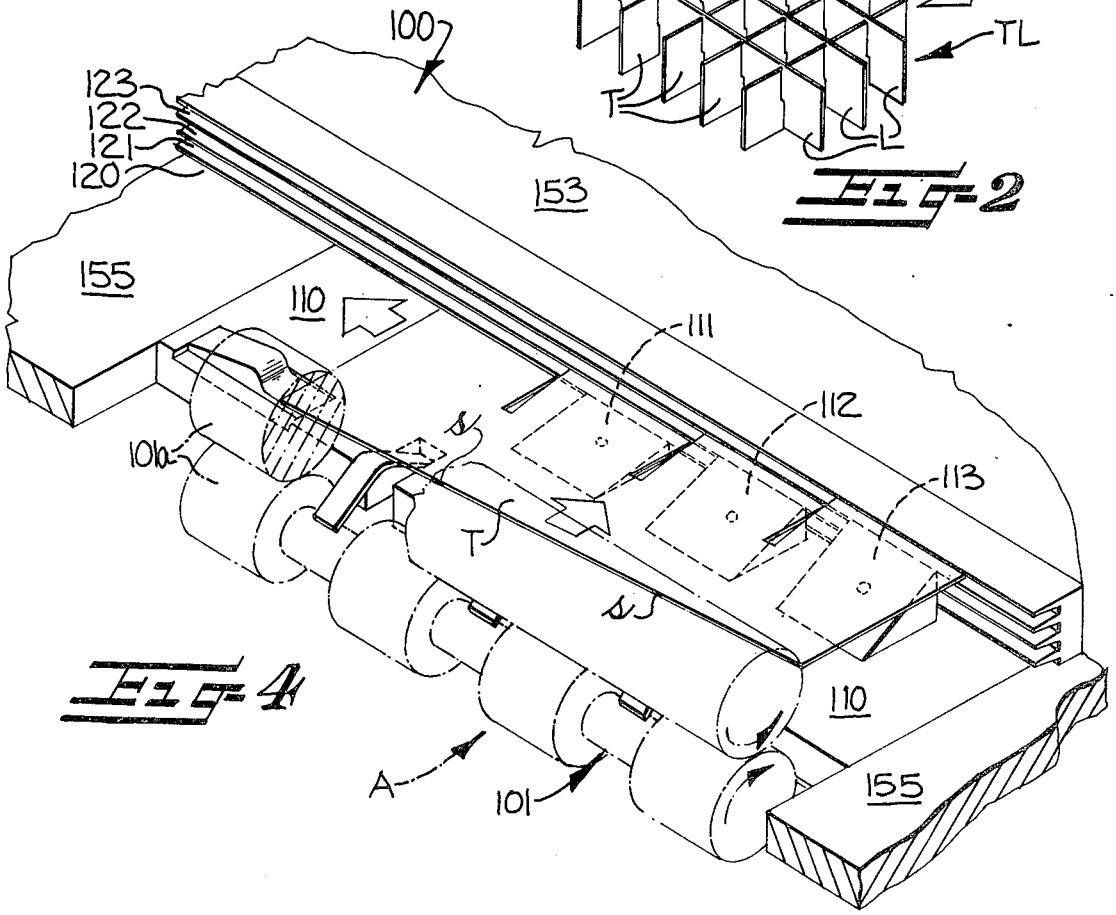
FIG. 4 is an enlarged view of the partition flap-offsetting unit and respective cooperating grooved trackways shown in the upper right-hand portion of FIG. 3.

As heretofore described with particular reference to FIG. 4, the flap a of each successive transverse partition strip T is moved along a surface 110 and into the corresponding lower grooved trackway 120. Thus, in effect, the surface 110 is actually in the form of a plate which partially defines the bottom wall of the corresponding lower transverse-partition-strip-receiving grooved trackway 120. Accordingly, it will be observed in FIG. 26 that the pair of delivery rolls 101*a* there shown are journaled in suitable bearings 101*g* welded or otherwise suitably secured to the outer edge portion of plate 110.

In order to adjust the delivery rolls 101*a* toward and away from the discharge ends of the conveyor means 342 (FIGS. 22 and 24), and to also transmit rotation from jack shaft 101*e* to delivery rolls 101*a*, plate 110 is adapted to be moved inwardly and outwardly, in a suitable opening provided in platform 155, by means of a reversible electric motor 101*h*. Electric motor 101*h* is electrically connected to sensor 263A (FIGS. 19–21) and is driven in response to the signal received from the sensor 263A.

Electric motor 101*h* is suitably suspended from platform 155 and has suitable driving connections 101*j* drivingly connecting the same to an elongate screw 101*k* through the medium of a gear box 101*m* carried by and suspended from platform 155. Gear box 101*m* serves as a driven internally threaded means engaging screw 101*k* so that, upon gear box 101*m* being driven by electric motor 101*h*, screw 101*k* is moved inwardly or outwardly, as the case may be. The outer portion of screw 101*k* is suitably connected to plate 110. It follows, therefore, that rotation of screw 101*k* effects inward or outward movement to delivery rolls 101*a*. It should be noted that the plate 110 is suitably secured to the outer end portions of elongate guide members 101*n* carried by suitable guide blocks 101*p* suitably suspendingly secured to platform 155 so as to guide plate 110 during its inward and outward movement and to maintain the axes of the delivery rolls 101*a* parallel to trackways 120–123.

Since plate 110 and delivery rolls 101*a* most move inwardly and outwardly during adjustment thereof relative to platform 155, a belt and pulley arrangement may be utilized as in FIG. 26 for transmitting rotation from jack shaft 101*e* to delivery rolls 101*a*, the latter belt and pulley arrangement being similar to the chain and sprocket wheel arrangement of FIGS. 14 and 15 utilized for driving the vertically adjustable cutter heads 250, 250'. Accordingly, it will be observed in FIG. 26 that a pulley g, fixed on jack shaft 100*e*, is engaged by an endless belt h which is also entrained partially around pulleys k–n, the pulleys k, l being suitably suspendingly rotatably supported by platform 155, and the pulley m being arranged in fixed axial relation to a gear p rotatably supported by one of the bearings 101*g*. Gear p is geared to corresponding ends of the delivery roll 101*a*, as by gears q.

It should be noted that the pulley n is suitably suspendingly supported for rotation by plate 110 so that, as plate 110 is moved inwardly and outwardly in the manner heretofore described, pulleys m, l and k also move inwardly and outwardly therewith to maintain the endless belt H taut as the belt passes over and about halfway around pulley n and then passes over and about half-way around pulley g, with the loop thus formed in endless belt h, between pulleys g, n, being enlarged or decreased in size in accordance with the direction in which plate 110 is being moved by electric motor 101*h* (FIG. 26).

The drive mechanisms for the various conveyor means 161, 170, 181, 187 and 200 extending longitudinally of the partition assembling stations 100A, 100B will now be described. Referring to FIGS. 25 and 48, it wil be observed that the two transverse-strip-staggering conveyor means 161 are driven by the output shaft 282*a* of main gear box 282, through the medium of belt and pulley connections 161*c*, three vertically spaced gear boxes 161*d*, an upright shaft 161*e* interconnecting the gearing in the gear boxes 161*d*, and substantially horizontal or lateral shafts 161*f* which extend inwardly and on whose inner ends the sprocket wheels 161*b* are fixedly mounted. The shafts 161*e*, 161*f* are suitably rotatably supported by the frame of the partition assembling stations 100A, 100B, any may be supported in substantially the same manner as will be presently described for similar shafts in the drive mechanisms between the output shaft 282*b* of the main gear box 282 and the front portions of the conveyor means 170, 187, 200.

In this regard, it will be observed in FIGS. 25, 37 and 38 that a pair of upright shafts 170*e*, 187*e* are suitably rotatably supported by the platforms 155, 155', and other adjacent frame members of the apparatus, adjacent the shafts 170*d*, 186*a* which support the front end portions of the upper and lower partition-grouping conveyor means 170 on the one hand, and the upper and lower longitudinal partition-strip-grouping conveyor means 187 on the other hand, as best shown in FIGS. 37 and 38.

The lower portions of the shafts 170*e*, 187*e* are supported in, and driven by, suitable gearing in respective gear boxes 170*f*, 187*f* carried by a base plate 155" (FIGS. 37 and 48) on which the vertically spaced primary and secondary partition assembling stations 100A, 100B are supported. As best shown in FIG. 38, the upper end portion, and a medial portion, of upright shaft 170*e* are drivingly connected, by suitable bevel or miter gearing 170*g*, to corresponding end portions of the upper and lower shafts 170*d* on which the front sprocket wheels 170*b* for the transverse-partition-strip-grouping conveyor means 170 are mounted.

To facilitate the longitudinal adjustment of the conveyor chains 171–175 (FIG. 27) and the propelling fingers 171*a*–175*a* carried thereby, for the purposes heretofore described, it will be observed in FIG. 38 that a medial portion of each shaft 170*d* has a sleeve 170*h* suitably secured thereon on which the respective set of five sprocket wheels 170*b* is rotatably mounted. However, suitable friction discs 170*i* are also mounted on each of the sleeves 170*h* and more normally in frictional engagement with opposite sides of each of the sprocket wheels 170*a* in the respective group or set, the sprocket wheels 170*a* and the corresponding discs 170*a* being held in frictional engagement with each other by a suitable nut 170*j* threaded onto one end of the sleeve 170*h*. It should be noted that the end of sleeve 170*h* remote from the respective nut 170*j* is provided with an enlarged shoulder portion 170*k* thereon. The sprocket wheels 170*a* of FIGS. 27 and 28 may be freely rotatable on shaft 170*c*, with shaft 170*c* being suitably supported for forward and rearward adjustment to tighten or loosen chains 171–175, as desired.

Since the sprocket wheels 170*a* supporting the front portions of conveyor chains 171–175 in FIG. 27 are rotatably mounted on the corresponding shaft 170*c*, if follows that manual relative adjustment of the sprocket chains 171–175 may be readily effected by loosening the nut **170*j* (FIG. 38) in each instance, following which the sprocket wheels 170*b* of the corresponding set may be angularly adjusted about the respective sleeve 170*h***.

With further regard to the transverse-partition-strip-grouping conveyor means 170, it will be observed in FIGS. 27, 27A, 28 and 29 that the cam tracks 177 are also mounted for relative longitudinal adjustment in the frame of the apparatus so as to insure that the partition strip propelling fingers **171*a*–175*a* are lowered in the proper order and at the proper time in accordance with the size of the particular transverse partition strip being advanced thereby. Accordingly, to facilitate adjustment of the elongate cam tracks 177, it will be observed in FIGS. 27 and 27A that each of the cam tracks is serrated or provided with teeth in the upper portion thereof which are engaged by a respective pinion 177*a* fixed on a shaft 177*b* suitably journaled in the frame of the apparatus and having a suitable handle means 177*c* thereon (see also FIG. 29) which may be manually manipulated for adjusting the longitudinal position of the respective cam track 177**.

Referring again to the upright shaft **187*e* shown in FIGS. 37 and 38, it will be observed that shaft 187*e* is drivingly connected, as by spur gears 187*g*, to the lower portion of shaft 200*d* heretofore described (FIGS. 9A, 37 and 38). As heretofore indicated, upright shaft 200*d* has the sprocket wheels 200*b* of the longitudinal partition strip advancing conveyor means 200 fixed thereon immediately above the upper and lower platform 155, 155'. It will also be observed in FIG. 38 that upright shaft 200*d* is drivingly connected to the two shafts 186*a* by means of respective pairs of intermeshing bevel or miter gears 200*g* for driving the sprocket wheels 187*b* mounted thereon, to in turn, drive the three conveyor chains 191 of the longitudinal-partition-strip-grouping conveyor means 187, as well as the preliminary advancing means 181 associated therewith (FIG. 35**).

The sprocket wheels **185*b*, 187*a* (FIG. 35) and 187*b* may be mounted on the respective shafts 186, 186*a* in essentially the same manner as that in which the sprocket wheels 170*b* of the transverse-partition-strip-grouping conveyor means 170 (FIGS. 1 and 27) are mounted. Accordingly, a further description of the manner in which the sprocket wheels 185*b*, 187*a*, 187*b* are mounted is deemed unnecessary. It should be noted, however, that the sprocket wheels 187*a*, as well as the lower sprocket wheel 185*b*, are mounted on the corresponding shaft 186 in substantially the same manner as that in which the sprocket wheels 170*b* are mounted in FIG. 38, so as to effect movement to the preliminary longitudinal strip advancing means 181 of FIG. 35**.

Figure 44:
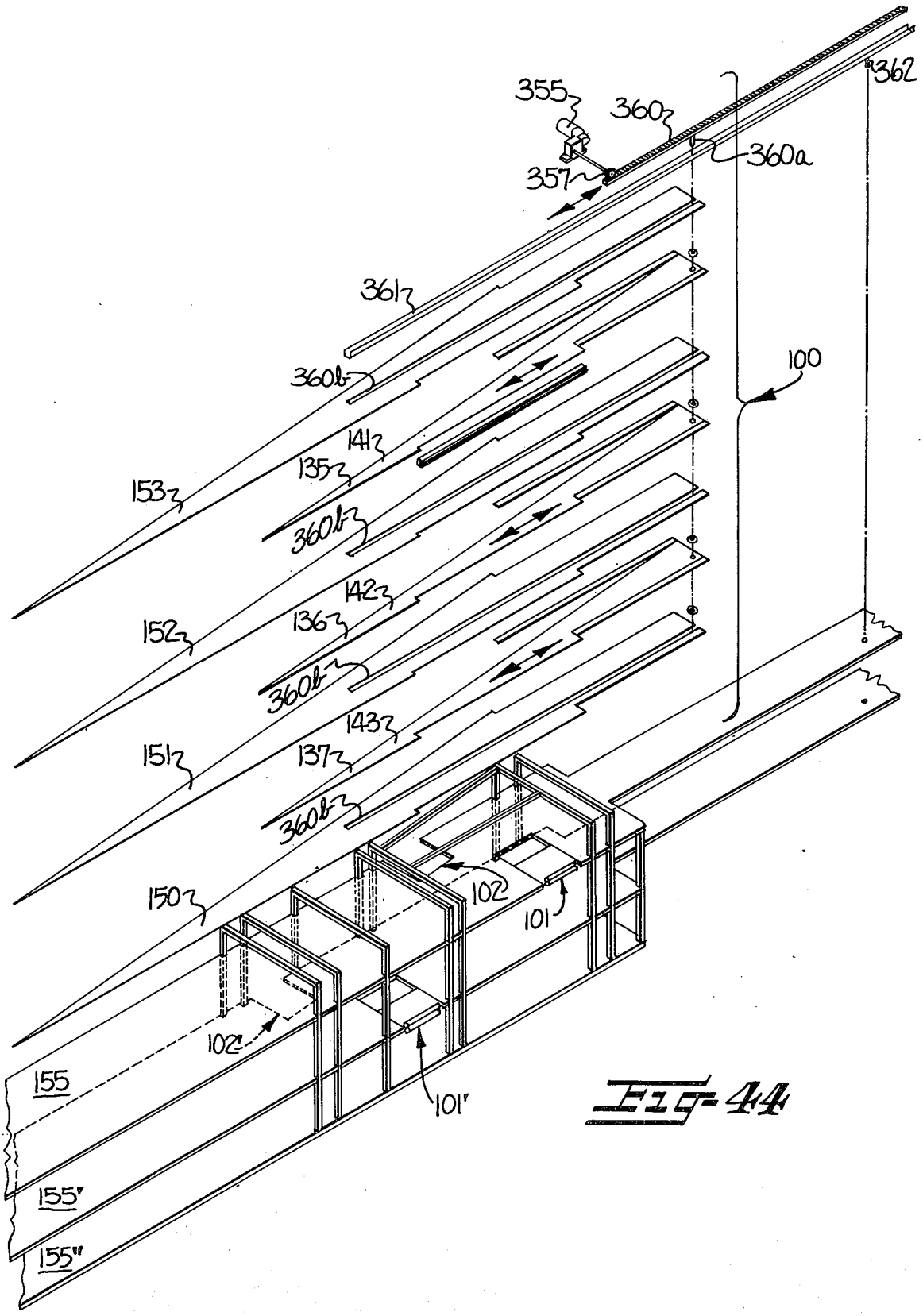
FIG. 44 is an exploded fragmentary perspective view of the partition trackway guide means and related elongate cam means for converging the primary partition strips at opposite sides thereof into intermeshing relationship.
Figure 45:
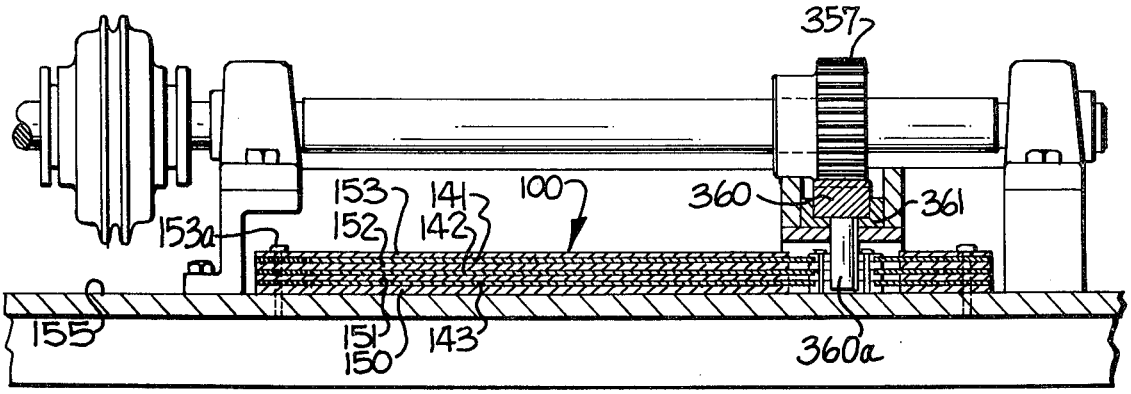
FIG. 45 is an enlarged transverse vertical sectional view taken substantially along the line 45—45 in FIG. 1.
Figure 46:
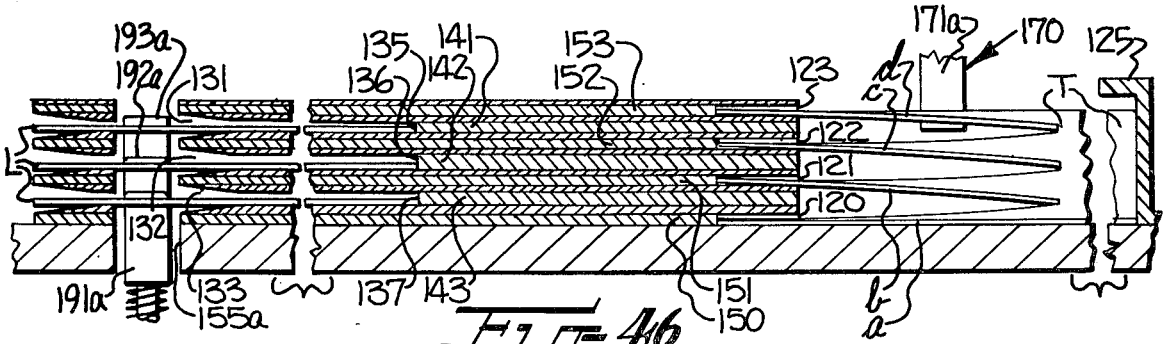
FIG. 46 is an enlarged transverse vertical sectional view taken substantially along the line 46—46 in FIG. 9.
Figure 47:
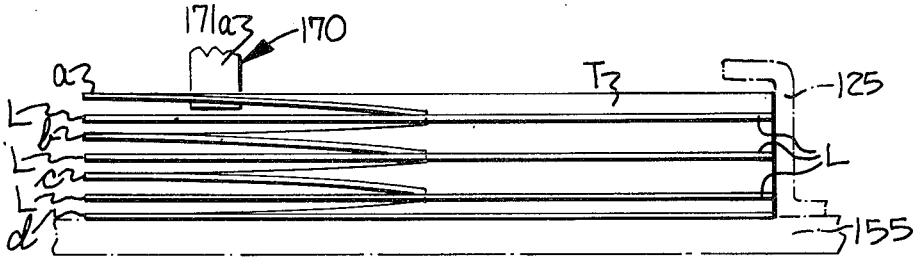
FIG. 47 is an enlarged transverse vertical sectional view taken substantially along the line 47—47 in FIG. 9A.

With particular reference to FIGS. 1 and 44, mechanism and structure will now be described which facilitate longitudinal adjustment of the cam plates 141–143 of each of the guide means 100 of the partition assembling stations 100A, 100B. Although only that converging cam means mounted on the upper platform 155 is shown in FIG. 44, it is apparent that a similar converging cam means is provided on the lower platform 155' to accommodate the secondary production line.

Referring to the upper portion of FIG. 44, there will be observed a reversible electric motor 355 which is electrically connected to the "BCD bit rate multiplier" CR-1 of FIG. 49 and is responsive thereto for imparting either forward or rearward rotation to a pinion 357 on the output shaft of electric motor 355. Pinion 357 engages a forwardly and rearwardly extending elongate rack 360 (FIGS. 1, 44 and 45) guided for longitudinal movement in a longitudinally slotted guideway 361 whose forward portion overlies a rearward portion of the upper guide plate 153. The rear end portion of guideway 361 is suitably secured on a rear portion of the corresponding platform 155, as at 362.

Stationary guide plates 150–153 of each guide means 100 are configured generally according to the configuration of the cam plates 141–143 having the respective cam surfaces 135–137 thereon. However, at least portions of the stationary plates 150–153 are wider than corresponding portions of the cam plates 141–143 to facilitate securing all the plates 150–153 together and to the upper surface of the platform 155, as at **153*a* in FIG. 45, with cam plates 141–143 slidably adjustable between guide plates 150–153**.

As best shown in the upper portion of FIG. 44, a medial portion of rack 360 has a downwardly projection pilot pin or rod **360*a* thereon which extends through the rear portions of all the cam tracks 141–143 for imparting forward and rearward movement thereto coincident with forward and rearward movement of rack 360 as imparted thereto bgy energization of electric motor 355. Since the pilot pin 360*a* must move forwardly and rearwardly relative to the guide plates 150, 153 in order to impart corresponding forward and rearward movements to the cam plates 141–143, each guide plate 150–153 is provided with a longitudinally extending slot 360*b* therethrough (FIG. 44) which is loosely penetrated by pilot pin 360*a* throughout longitudinal adjustment of the cam plates 141–143**.

IV. Typical Adjustment Procedures:

The operation of the partition strip fabricating and assembling apparatus has been clearly explained throughout the foregoing description. Now, the operations involved in change-over of the apparatus from the formation of one type of partition strip assembly; e.g., a 24-cell assembly such as that shown in FIG. 2, to another type of partition strip assembly will be described. In the description of this change-over, it will be assumed that a 12-cell assembly is to be produced having cells of the same cross-sectional area as, but of about one-fourth greater height than, the 24-cell partition strip assemblies for which the apparatus was previously set up. The steps involved in such a change-over may be effected while the apparatus is at rest and are substantially as follows:

1. Replace each roll 50 in the two transverse partition strip fabricating stations A, A' with a roll of sheet material 51 about one-fourth narrower than the existing roll 50, and also replace each of the rolls 50 in the longitudinal partition strip fabricating stations B, B' with a roll of sheet material 51 about one-third narrower than the existing roll 50. This is desirable because each transverse partition strip will be provided with only three flaps, and each longitudinal partition strip will be provided with only four flaps.

2. Replace those slot cutting blade assemblies (FIG. 23) of the two slot cutting stations 80 of the transverse partition strip fabricating stations A, A' with similar assemblies wherein each such assembly is provided with only two segmental rotary cutting blades 81 and cooperating grooved rollers 82, it being noted that each transverse partition strip in a 12-cell partition strip assembly need only be provided with two slots therein defining three flaps thereon. Also, the phase shifters 341 would be properly adjusted and the rolls 91 and rolls leading to and in the positioning means 101 would be properly positioned.

3. Similar to Step 2, replace the assemblies of the slot cutting stations 80 of the two longitudinal partition strip fabricating stations B, B' with similar slot cutting assemblies wherein each such assembly is provided with only three segmental rotary cutting blades 81 and cooperating grooved rollers 82 therein, it being noted that each longitudinal partition strip of a 12-cell partition strip assembly need only be provided with three slots therein defining four flaps thereon.

4. Axially adjust the rotary cams 102*q*, 102*r* (FIGS. 30 and 32) on the cam shaft 102*s* to move the cams 102*q* out of engagement with follower means 102*p* and to move the respective cams 102*r* into engagement with follower means 102*p*.

a. Upon subsequent operation of the apparatus, the latter changes in the positions of the cams 102*q*, 102*r* result in the nip at the discharge ends of the belts 102*b*, 102*a* of the two delivery and positioning means 102, 102' alternately being brought substantially into alignment with the two upper trackways 131, 132 (FIG. 7A) of the guide means 100 of the respective primary and secondary production lines, it being noted that only two longitudinal partition strips are employed in the formation of each 12-cell partition strip assembly.

5. Manually shift the control lever 282L on the main gear box 282 (FIGS. 25, 26, 30, 48 and 49) from a predetermined "24-cell" position to a predetermined "12-cell" position so as to change the ratio between the speeds at which output shafts 282*a*, 282*b* will be driven.

a. The change in the speed ratio between shafts 282*a*, 282*b* should be such as to increase the effective speed of all those strip-advancing conveyors 170 (FIGS. 9, 9A, 27, 27A, 28, 29 and 48), 181 (FIG. 35), 187 and 200, as well as the rate at which each cam shaft 102*s* will be rotated, relative to the effective speed of each transverse-partition-strip-staggering conveyor 161. Such speed ratio should be such that each transverse-partition-strip-grouping conveyor 170 will be caused to move at such faster linear speed than the respective strip-staggering conveyor 161 that only the three rearmost strip-propelling fingers 173*a*, 174*a*, 175*a* of each successive group will engage and advance respective three-flap transverse partition strips T along the corresponding grooved trackways 121–123; and the other two fingers 171*a*, 172*a* of each such group will simply move along above the space between successive groups of three three-flap transverse partition strips T thus being formed and without engaging any such strips.

b. It is apparent that the effective speeds of the longitudinal-partition-strip conveyors 181, 187, 200 are increased to the same extent as that of the transverse-partition-strip-grouping conveyor means 170 because the groups of longitudinal partition strips L must advance along the guide means 100 of each assembling station at the same linear speed as the respective groups of transverse partition strips T.

c. Since the change-over of the apparatus, in this example, does not require any consideration for a change in the lengths of the individual flaps of the partition strips, no change is required in the spatial relation of the various strip-propelling fingers on the conveyor means 160, 170, 181, 187. In this regard, it should be noted that the leading strip-propelling finger 191*a* of each group thereof (FIGS. 35 and 36) on the longitudinal-partition-strip-grouping conveyor means 187 passes beneath the two upper grooved trackways 131, 132 in FIG. 36. Thus, with the apparatus in the "12-cell" mode, each successive leading finger 191*a* will not be advancing any longitudinal partition strip, since no strips will be fed into the lowermost trackway 133.

It is to be noted that the foregoing Steps 1–5 are not required in those cases wherein the change-over does not involve changing the length of the partition strips and/or changing the number of flaps to be present on each respective partition strip of which the partition strip assemblies are to be formed. On the other hand, the Step 6 set forth below is required only in the event that the height of each partition strip is to be changed.

6. Adjust the strip cutting blades 254 of each of the four strip cutting stations 70 while also adjusting the sensor 263A (FIGS. 15 and 19–21) by energizing that electric motor 263 (FIGS. 15, 25 and 49) associated with those two cutting stations 70 in the transverse-partition-strip-fabricating stations A, A', which energization is effecting by manual operation of the reversing switch SW-3 of FIG. 49.

a. By manually operating the latter motor 263 through switch SW-3, this adjusts radially outwardly the blades 254 (FIGS. 15, 16, 18A and 18B) of those cutter heads 250, 250' of the transverse-partition-strip-fabricating stations A, A' while thereby increasing the distance between the blades to the extent of the desired increased height of the transverse partition strips to be formed, and while proportionally raising the cutter heads 250, 250' last mentioned, via operation of the jacks 290 (FIG. 14).

b. The manual operation of the latter motor 263 effects like operation of the encoder 332*b* of the motor 263 of those two strip cutting stations 70 in the longitudinal-partition-strip-fabricating stations B, B' (FIG. 1), thus changing the effective rotational speed of all four anvil rolls 264 (FIGS. 14 and 15) and the phase of the phase shift variators 340, 341 (FIG. 49) on both sides of the apparatus. The motor 340*b* adjusts phase shift variator 340 to correlate the angular position of the detaching rolls 92 with the leading edge of the partially severed sheet material being fed from roll 91. The motor 341*b* then adjusts the phase shift variator 341 to change the angular position of the slot cutting blades about their axis so that they will be in sufficient cutting engagement with each successive partition strip being delivered thereto so that each slot is of a depth equal to about one-half the height of each such partition strip. The operational multiplier CR-1 regulates the speed of motor 325 (FIGS. 14, 15, 22 and 49) in response to the frequency of signals received from pulse generator M2 and position encoder 332*b* to accommodate the increased width of the partition strips to be produced. Note that motor 325 drives the anvil rolls 264 and the intermediate conveyor means 326 at each respective side of the apparatus. The control motors 101*h* (FIG. 26) adjust the respective pairs of transverse-partition-strip delivery rolls 101*a* outwardly away from the respective sets of grooved trackways 120–123 (see FIG. 4) to accommodate the increased-height partition strips between the delivery rolls 101*a* and the inner extremities of the corresponding trackways 120–123. The rolls in delivery conveyor means 34 would also be suitably positioned to accommodate the increased height partitions. The motor 355 adjusts the cam plates 141–143 (FIGS. 9, 9A, 13 and 44) longitudinally toward the partition-strip-receiving end of each respective assembling station 100A, 100B, and during which the cam surfaces 135–137 progressively recede away from the adjacent outer surfaces of the guide plates 150–153 between which the cam plates are adjustably positioned. Such adjustment continues until the space between each strip delivery means 102, 102' and its respective set of cam plates 141–143 is sufficient to accommodate the longitudinal partition strips of the increased height therebetween.

Upon effecting the above-enumerated change-over steps; which need not be effected in precisely the order given, the apparatus is in condition for operation to produce 12-cell partition strip assemblies having greater height than that of the 24-cell partition strip assemblies for which the apparatus was previously set up. However, there will have been substantially no change in other dimensions of the individual cells of the partition strip assemblies.

In the event that the height of the transverse and longitudinal partition strips to be produced exceeds the maximum distance which might reasonably be obtained between the cutting edges of the blades 254 of each strip cutter head 250, 250' (FIGS. 15, 16, 18A and 18B), it is contemplated that alternate cutting blades 254 may be removed from the respective cutter heads 250, 250', preferably by removing the screws which fasten the blades 254 to the respective blade carriers 255 (see FIG. 18B). In actual designing of the apparatus, the range of lengths of material which could be cut with all of the cutting blades 254 in place on a cutter head 250 was from about three to about six inches. By omitting alternate blades 254, the length of cut material could be about six to twelve inches or more. Accordingly, since the ratio of the linear travel of each cutting blade 254 is considerably increased, when alternate blades are omitted, with respect to the normal rate of rotation of the output shafts 280*a*, 280*c* of the auxiliary gear boxes 280, 280', such ratio is partially compensated for by shifting the manual control levers 280L, 280L' from a low-ratio position to a high-ratio position. Such positions may be identified on the gear boxes as "6-inch position" and "12-inch position", respectively, if desired.

As indicated in the foregoing exemplary change-over procedure, the width of the flaps longitudinally of each respective partition strip, and the position of the slots N between the flaps were not to be changed. In the event that such change is desired in lieu of or in addition to the foregoing change-over procedure, the following change-over procedure is contemplated:

7. Axially adjust the segmental cutting blades 81 (FIG. 23) on the respective shaft 83 in each slot cutting station 80 (FIG. 1) to obtain the desired spacing between such blades and thereby to obtain flaps of the desired number and width on the successive partition strips to be fabricated. A similar adjustment of the grooved rollers 82 (FIG. 23) on the respective shaft 84 will also be required.

8. Adjust the wedge-shaped members defining the flap-offsetting surfaces 111, 112, 113 (FIGS. 3 and 4) longitudinally of the respective partition strip assembling stations 100A, 100B to accommodate the change effected in Step No. 7, above.

9. Assuming that the distance between the strip-propelling fingers 160 of each strip-staggering conveyor means 161 (FIGS. 3, 4, 9, 9A, 25 and 27–29) is greater than the maximum width of each flap on any size or type partition strip which is to be fabricated on the apparatus, adjust the spacing between the transverse-strip-propelling fingers 171*a*–175*a* (FIGS. 27 and 27A), by adjusting the chains 171–175 of each conveyor means 170 in the manner explained earlier herein, so that the spacing of the latter fingers is in accord with the adjustment of the segmental cutting blades 81 in Step No. 7, above.

10. Adjust the cam tracks 177 longitudinally of the partition strip assembling stations 100A, 100B, in the manner hereinbefore explained, to effect actuation of the strip-propelling fingers (171*a*–175*a* of the respective transverse-partition-strip-grouping conveyors 170 at the desired intervals to effect the desired grouping of the transverse partition strips in the manner hereinbefore described. In effecting adjustment of the fingers 171*a*–175*a* relative to each other, it is contemplated that the trailing finger 175*a* of each group will remain in its original adjusted position and the other four fingers 171*a*–174*a* of each such group will be adjusted relative to the respective finger 175*a*. Also, that cam track 177 adapted to be engaged by each successive strip-propelling finger 175*a* of each conveyor means 170 would remain in its original adjusted position, with the other cam tracks 177 being adjusted relative thereto.

11. At the "longitudinal-strip" side of the apparatus, adjust the strip-propelling fingers 191*a*, 192*a* (FIGS. 35 and 36) of each longitudinal-partition-strip-grouping conveyor means 187 relative to each other and relative to the respective trailing strip-propelling finger 193*a* of each respective group thereof, so that the spacing of the fingers 191*a*–193*a* is in accord with the adjustment of the segmental cutting blades in Step No. 7, above. The cam tracks 197, 198 require no adjustment in this particular change-over procedure. Also, it is unnecessary to adjust the primary conveyor means 181 or to change the positions of the strip-propelling fingers thereon in this change-over procedure.

It is thus seen that the apparatus of this invention may be readily adjusted to effect changes in the length and/or height of the partition strips, as well as changes in the size and/or number of flaps to be present in each partition strip during subsequent production of partition strip assemblies therefrom, and whereby partition strip assemblies having the desired number, size and depth or height of cells may be produced.

In the drawings and specification, there has been set forth a preferred embodiment of the invention, and although specific terms are employed, they are used in a generic and descriptive sense only and not for purposes of limitation.

That which is claimed is:

1. Apparatus for successively fabricating slotted partition strips from a continuous length of material for use in assembling multi-cell partitions utilized in cartons, crates and the like, said apparatus being characterized by a construction providing for substantially continuous flow of the material and strips during fabrication and for adjustability thereof for fabrication of varying sizes and types of partition strips, said apparatus comprises:

means for supplying a continuous length of material such as paperboard;

means for successively transversely cutting the continuous length of material into individual strips of desired height as the material is continuously fed therethrough;

adjustment means for varying the height of the strips cut by said strip cutting means;

means for successively longitudinally cutting a desired number of spaced-apart slots in each of the cut strips extending inwardly a desired distance from a cut edge thereof to define a predetermined number of flaps on the edge as the strips are continuously fed therethrough;

adjustment means for varying the height of the slots cut in the strips by said slot cutting means;

means for continuously feeding the material and cut transverse strips in a generally linear path of travel from said supply means through said strip cutting means and said slot cutting means; and sets of driven feed rolls positioned between said strip cutting means and said slot cutting means and adjacent said slot cutting means for receiving the interconnected and cut partition strips therebetween and for separating said partition strips by rupturing the small tabs therebetween and for feeding the separated cut strips into said slot cutting means.

2. Apparatus, as set forth in claim 1, in which said material supply means comprises:

a supply roll stand mechanism for carrying a roll of a continuous length of material to be fabricated into partition strips, driven feed rolls for receiving the material from the supply roll and feeding the material in a forward path of travel therebetween into a catenary loop, and means operatively connected with said feed rolls for sensing the size of the catenary loop of material and for controlling the speed of the feeding of the material thereby.

3. Apparatus, as set forth in claim 1, in which said strip cutting means comprises:

a rotary anvil roll means, and a rotary cutter head having a plurality of radially-extending radially-adjustable circumferentially-spaced cutter means operatively positioned with respect to said rotary anvil roll means for receiving the continuous length of material therebetween for transversely cutting the continuous length of material into individual strips of desired heights corresponding to the circumferential spacing between said cutter means.

4. Apparatus as set forth in claim 3, in which each of said cutter means of said strip cutting means includes an interrupted cutting edge thereon so that said strip cutting means will not completely sever the continuous length of material when cutting individual strips and allow the individual strips to remain partially interconnected by small unsevered tabs to aid in feeding and spacing of the strips as they are fed through said fabricating apparatus to said slot cutting means by said feeding means.

5. Apparatus, as set forth in claim 1, in which said slot cutting means comprises:

a rotary anvil roll means, and a rotary cutter having a predetermined number of transversely spaced-apart cutting blade means thereon of segmental circular configuration and mounted on said rotary cutter for rotation in the longitudinal direction wherein the outer cutting surface of each of said blade means forms a predetermined portion of the circumference of a circle and being operatively positioned with respect to said rotary anvil roll means for receiving the cut individual partition strips therebetween and for longitudinally cutting spaced slots in each strip extending inwardly a desired distance from the leading cut edge thereof.

6. Apparatus, as set forth in claim 5, in which said rotary cutter of said slot cutting means of said partition strip fabricating means further includes means for utilizing a different predetermined number of spaced cutting blade means to vary the number of desired slots cut in each strip for varying types of partitions and number of cells therein.

7. Apparatus, as set forth in claim 5, in which said adjustment means for varying the height of the slots cut in the strips by said slot cutting means comprises:

means for adjusting the phase or angular relationship of said rotary cutter of said slot cutting means relative to the feeding of the partition strips through said slot cutting means by said feeding means so that said segmental outer cutting surfaces of said cutting blade means are in sufficient cutting engagement with the partition strips for cutting slots of desired height therein.

8. Apparatus for successively fabricating slotted partition strips from a continuous length of material for use in assembling multi-cell partitions utilized in cartons, crates and the like, said apparatus being characterized by a construction providing for substantially continuous flow of the material and strips during fabrication and for adjustability thereof for fabrication of varying sizes and types of partition strips, said apparatus comprises:

means for supplying a continuous length of material such as paperboard;

means for successively transversely cutting the continuous length of material into individual strips comprising a rotary anvil roll means, and a rotary cutter head having a plurality of radially-extending radially-adjustable circumferentially-spaced cutter means operatively positioned with respect to said rotary anvil roll means for receiving the continuous length of material therebetween for transversely cutting the continuous length of material into individual strips of desired heights corresponding to the circumferential spacing between said cutter means;

adjustment means connected with said cutter means for radially adjusting said cutter means inwardly and outwardly on said rotary cutter head for varying the circumferential spacing between said cutter means for adjusting the desired height of the partition strips cut thereby;

means for successively longitudinally cutting a desired number of spaced-apart slots in each of the cut strips extending inwardly a desired distance from a cut edge thereof to define a predetermined number of flaps on the edge as the strips are continuously fed therethrough;

adjustment means for varying the height of the slots cut in the strips by said slot cutting means; and means for continuously feeding the material and cut transverse strips in a generally linear path of travel from said supply means through said strip cutting means and said slot cutting means.

9. Apparatus, as set forth in claim 8, in which said adjustment means for varying the cut height of the partition strips further includes means for removably mounting said cutter means in said rotary cutter head for removal of certain of said cutter means to increase the circumferential spacing between said cutter means for providing a wider range of adjustment of desired heights of individual strips being cut.

10. Apparatus for successively fabricating slotted partition strips from a continuous length of material for use in assembling multi-cell partitions utilized in cartons, crates and the like, said apparatus being characterized by a construction providing for substantially continuous flow of the material and strips during fabrication and for adjustability thereof for fabrication of varying sizes and types of partition strips, said apparatus comprises:

means for supplying a continuous length of material such as paperboard;

means for successively transversely cutting the continuous length of material into individual strips of desired height as the material is continuously fed therethrough;

adjustment means for varying the height of the strips cut by said strip cutting means;

means for successively longitudinally cutting a desired number of spaced-apart slots in each of the cut strips extending inwardly a desired distance from a cut edge thereof to define a predetermined number of flaps on the edge as the strips are continuously fed therethrough;

adjustment means for varying the height of the slots cut in the strips by said slot cutting means;

main drive means operatively connected with said strip cutting means, said slot cutting means, and said strip feeding means for driving all of said means in predetermined correlated relationship for fabricating slotted partition strips;

separate drive means connected with said adjustment means for said strip cutting means for driving same to change the height of the strips cut thereby; and control and sensing means connected with said drive means of said adjustment means of said strip cutting means, said adjustment means of said slot cutting means, and said main drive means for sensing an adjustment in said strip cutting means and effecting corresponding desired adjustments in said slot cutting means and said main drive means for fabricating partition strips of a different height.

11. Apparatus for successively fabricating slotted partition strips for use in assembling multi-cell partitions utilized in cartons, crates and the like, said apparatus being characterized by a construction providing for adjustability thereof for fabrication of varying sizes and types of partition strips, said apparatus comprising:

means for supplying a continuous length of material such as paper board;

means for successively transversely cutting the continuous length of material into individual strips comprising a rotary anvil means, and a rotary cutter head having a plurality of radially-extending radially-adjustable circumferentially-spaced cutter means operatively positioned with respect to said rotary anvil roll means for receiving the continuous length of material therebetween for transversely cutting the continuous length of material into individual strips of desired heights corresponding to the circumferential spacing between said cutter means, said cutter means including an interrupted cutting edge thereon so that said strip cutting means will not completely sever the continuous length of material when cutting individual strips and allow the individual strips to remain partially interconnected by small unsevered tabs to aid in feeding and spacing of the strips as they are fed forwardly from said strip cutting means;

adjustment means for varying the height of the strips cut by said strip cutting means comprising means connected with said cutter means for radially adjusting said cutter means inwardly and outwardly on said rotary cutter head for varying the circumferential spacing between said cutter means for adjusting the desired height of the partition strips cut thereby, and means for removably mounting said cutter means in said rotary cutter head for removal of certain of said cutter means to increase the circumferential spacing between said cutter means for providing a wider range of adjustment of desired heights of individual strips being cut;

means for successively longitudinally cutting a desired number of spaced-apart slots in each of the cut strips extending inwardly a desired distance from the leading cut end thereof to define a predetermined number of flaps on the leading end comprising a rotary anvil roll means, and a rotary cutter having a predetermined number of spaced-apart cutting blade means thereon of segmental circular configuration and mounted on said rotary cutter for rotation in the longitudinal direction wherein the outer cutting surface of each of said blade means forms a predetermined portion of the circumference of a circle and being operatively positioned with respect to said rotary anvil roll means for receiving the cut individual partition strips therebetween and for longitudinally cutting the spaced slots in each strip extending inwardly a desired distance from the leading cut end thereof;

adjustment means for varying the number and the height of the slots cut in the strips by said slot cutting means comprising means for utilizing a different predetermined number of spaced cutting blade means to vary the number of desired slots cut in each strip for varying sizes and types of partitions, and means for adjusting the phase or angular relationship of said rotary cutter of said slot cutting means relative to the feeding of the partition strips through said slot cutting means by said feeding means so that said segmental outer cutting surfaces of said cutting blade means are in sufficient cutting engagement with the partition strips for cutting slots of desired height therein; and means for continuously feeding the material and cut transverse strips in a generally linear path of travel from said supply means through said strip cutting means and said slot cutting means and including sets of driven feed rolls positioned between said strip cutting means and said slot cutting means for receiving the interconnected and cut partition strips therebetween and for overfeeding to separate said partition strips by rupturing the small tabs therebetween and for feeding the separated cut strips into said slot cutting means.

* * * * *

UNITED STATES PATENT AND TRADEMARK OFFICE

CERTIFICATE OF CORRECTION

PATENT NO. : 4,171,666

DATED : October 23, 1979

INVENTOR(S) : Dale Russell Swenson et al.

It is certified that error appears in the above—identified patent and that said Letters Patent is hereby corrected as shown below:

Column 1, line 21, "No." should read -- Nos. --. Column 5, line 28, "of", first occurrence, should read -- for --. Column 6, line 5, after "groups" insert -- of --. Column 7, line 33, "of" should read -- in --. Column 9, line 34, "15" should read -- 51 --. Column 10, line 63, after "of" insert -- each of --. Column 11, line 32, "shafts" should read -- shaft --. Column 19, line 23, "surface" should read -- surfaces --. Column 19, line 38, "102b" should read -- 102g --. Column 20, line 14, "herefore" should read -- heretofore --. Column 20, line 33, "partitioned" should read -- positioned --. Column 33, line 45, "generally" should read -- generically --. Column 35, line 5, "Figure 5" should read -- Figure 15 --. Column 37, line 42, "most" should read -- must --. Column 38, line 8, "wil" should read -- will --. Column 38, line 17, "any" should read -- and --. Column 38, line 53, "more" should read -- are --. Column 38, line 56, "170a", second occurrence, should read -- 170i --.

UNITED STATES PATENT AND TRADEMARK OFFICE

CERTIFICATE OF CORRECTION

PATENT NO. : 4,171,666

DATED : October 23, 1979

INVENTOR(S) : Dale Russell Swenson et al.

It is certified that error appears in the above—identified patent and that said Letters Patent is hereby corrected as shown below:

Column 40, line 24, "bgy" should read -- by --.

Signed and Sealed this

First Day of April 1980

[SEAL]

Attest:

SIDNEY A. DIAMOND

Attesting Officer

Commissioner of Patents and Trademarks